US012703830B2

(12) United States Patent
Prisco

(10) Patent No.: US 12,703,830 B2
(45) Date of Patent: Aug. 11, 2026

(54) AMMONIA-HYDROCARBON FUEL COMPOSITIONS, METHOD OF USE, AND SYSTEMS THEREOF

(71) Applicants: Nathan A. Prisco, Richland, WA (US); Mighty Pipeline, Inc., Richland, WA (US)

(72) Inventor: Nathan A. Prisco, Richland, WA (US)

(73) Assignees: Nathan Prisco, Richland, WA (US); Mighty Pipeline, Inc., Richland, WA (US)

( * ) Notice: Subject to any disclaimer, the term of this patent is extended or adjusted under 35 U.S.C. 154(b) by 87 days.

(21) Appl. No.: 18/727,797

(22) PCT Filed: Jan. 11, 2023

(86) PCT No.: PCT/US2023/060445

§ 371 (c)(1),
(2) Date: Jul. 10, 2024

(87) PCT Pub. No.: WO2023/137304

PCT Pub. Date: Jul. 20, 2023

(65) Prior Publication Data

US 2025/0354077 A1 Nov. 20, 2025

Related U.S. Application Data

(60) Provisional application No. 63/266,669, filed on Jan. 11, 2022.

(51) Int. Cl.
*C10L 1/12* (2006.01)

(52) U.S. Cl.
CPC ..... *C10L 1/1266* (2013.01); *C10L 2250/06* (2013.01); *C10L 2290/06* (2013.01)

(58) Field of Classification Search
CPC . C10L 1/1266; C10L 2250/06; C10L 2290/06
USPC ..... 44/458
See application file for complete search history.

(56) References Cited

U.S. PATENT DOCUMENTS 3,480,024 A * 11/1969 Scheuerman ..... F17D 1/16 507/90
7,938,183 B2 * 5/2011 Hart ..... E21B 43/2408 507/248
2005/0049316 A1 3/2005 Burrington et al.
2005/0257420 A1 11/2005 Wenzel
2008/0148627 A1 * 6/2008 Suraci ..... C10L 10/02 44/302

(Continued)

OTHER PUBLICATIONS

International Search Report dated Jun. 28, 2023, PCT/US23/60445.

*Primary Examiner* — Ellen M Mcavoy
(74) *Attorney, Agent, or Firm* — Finnegan, Henderson, Farabow, Garrett & Dunner, LLP

(57) ABSTRACT

The present disclosure is directed to fuel compositions comprising a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm. Further, the disclosure provides for systems and methods for using the fuel compositions.

43 Claims, 24 Drawing Sheets

(56) References Cited

U.S. PATENT DOCUMENTS

| | | | | |
|---|---|---|---|---|
| 2009/0049737 | A1 | 2/2009 | Suraci et al. | |
| 2011/0048354 | A1* | 3/2011 | Hollingshurst | C10L 10/04<br>44/422 |
| 2012/0180741 | A1 | 7/2012 | Strey et al. | |
| 2013/0036670 | A1 | 2/2013 | McAlister | |
| 2014/0196902 | A1* | 7/2014 | Southwick | E21B 43/20<br>507/224 |
| 2015/0152318 | A1* | 6/2015 | Travis | E21B 27/02<br>166/280.1 |
| 2021/0363451 | A1 | 11/2021 | Hansch et al. | |

* cited by examiner

*Lifecycle of a Dispersion*

1) Foamy Mixing Process
2) More Stable at <25 °C
3) More Unstable at >25 °C
4) Separable – Ammonia Removed

AMMONIA-HYDROCARBON FUEL COMPOSITIONS, METHOD OF USE, AND SYSTEMS THEREOF

This application claims priority to U.S. Provisional Application No. 63/266,669, filed Jan. 11, 2022; this application is incorporated herein by reference in its entirety.

This disclosure was supported in part by an appointment with the Arctic Advanced Manufacturing Innovator Program sponsored by the U.S. Department of Energy (DOE), Office of Energy Efficiency and Renewable Energy, and Advanced Manufacturing Office. This program is administered by the Oak Ridge Institute for Science and Education (ORISE) for the DOE. ORISE is managed by ORAU under DOE contract number DESC0014664.

Disclosed herein are fuel compositions comprising a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm. Further, the disclosure provides for systems and methods for using the fuel compositions.

Ammonia is gaining favor over molecular hydrogen as a carbon-free energy commodity in several markets due to its improved transportability and lower storage cost. Further, ammonia is known to be a convenient vehicle for transporting or storing hydrogen atoms. Ammonia is easier to handle than is molecular hydrogen but still transportation is a cost driver for conventional ammonia markets (e.g., fertilizer, refrigerant, pollution control, etc.). Low-cost production sites, typically those situated above a natural gas reservoir, however, are far removed from demand centers resulting in challenging logistics. For this reason, most clean ammonia production sites are typically built in coastal areas with marine terminal access even when lower cost production is possible in non-coastal areas. Because traditional ammonia markets involve smaller volumes in comparison to the trade of fossil commodities, rarely is the use of a pipeline system economically favorable for ammonia distribution. Similar logistical challenges are encountered in oil and gas production, but a vast interconnected network of transportation and storage systems exist to buffer against short-term fluctuations in supply or demand. There is a need for an improved method for transporting liquid ammonia from non-coastal production sites to marine terminals or far away demand centers.

Historically, the high-energy density of hydrocarbon deposits has motivated the development of an expansive network of infrastructure devoted to hydrocarbon extraction. Without access to such infrastructure, distribution of "green" ammonia (produced using renewable electricity) and "blue" ammonia (produced using fossil resources with carbon mitigation) products are economically disadvantaged in comparison to fossil commodities. Transporting mixtures of carbon-free and conventional commodities appraised, in part, according to their respective environmental impact, adds significant complexity to a material transfer process. Even so, legacy hydrocarbon systems convey multi-phase hydrocarbon mixtures, and operators have devised systems and tools for appraising the value of mixed hydrocarbon streams from diverse sources. In the case of ammonia, a commodity that is readily separable from hydrocarbon but may be sold into non-fossil markets, there are market opportunities to either recover the ammonia or to sell it blended with hydrocarbon as a fuel oil.

Were ammonia able to be transported or stored along with hydrocarbons, then barriers to its adoption as a carbon-free energy commodity would be reduced. Further, by leveraging hydrocarbon distribution infrastructure, ammonia may be stored and transported with hydrocarbon improving the economic viability of pipeline transport for ammonia distribution to conventional markets. Although ammonia is partially miscible with hydrocarbon liquid, ammonia-oil dispersions have the tendency to separate into an ammonia-rich fraction and a hydrocarbon-rich fraction over time. During transport or storage, poor stability or unintentional separation of the ammonia-hydrocarbon dispersions can lead to severe environmental or economic damages to a hydrocarbon processing system. Conversely, if the ammonia-hydrocarbon dispersion cannot be economically separated on account of it being too stable, then its value as a mixture will be restricted to a few specialized markets. In addition, mixtures of concentrated ammonia incorporated into a hydrocarbon mixture for energy related applications face hurdles in view of the challenges associated with handling ammonia. For example, general research laboratories often lack pressure equipment necessary for the handling, manipulation, or storage of ammonia-hydrocarbon mixtures. Furthermore, specialized petroleum laboratories are likely discouraged from using ammonia due to its incompatibly with commonly used polymeric seals/gaskets (under reservoir conditions); paucity of published research pertaining to ammonia-rich hydrocarbon mixtures (apart from vapor-liquid equilibrium; refrigeration applications; or astrochemical studies pertaining to cryovolcanism on Titan, Pluto, or other celestial bodies); an absence of predictive thermodynamic equations of state applicable to ammonia-hydrocarbon mixtures; and, of course, due to a widespread perception that ammonia is exceptionally toxic and corrosive. While there are very real hazards associated with using ammonia as a fuel, much of this can be attributed to a lack of methods/apparatuses pertaining to the safe, practical, and gainful use of ammonia within conventional hydrocarbon processing systems.

To a limited extent, ammonia and hydrocarbon can and have been induced to form mixtures to facilitate pipeline transport as exemplified by U.S. Pat. No. 3,480,024; however, the method greatly constrains the conditions under which the system as a whole may be operated. Additionally, there exist many primary, secondary, and tertiary oil production methods but 'chemical enhanced oil recovery' (chemical EOR) processes utilizing ammonia have had little commercial relevance despite their technical potential. U.S. Pat. No. 7,938,183 relates to the use of ammonia as part of a steam-assisted gravity drainage process. U.S. Pat. No. U.S. Pat. No. 2014/0196902 A1 relates to the use of ammonia as part of a miscible polymer waterflood. W.O. Pat. No. 2013/184506 A1 relates to the injection of ammonia under controlled temperature and pressure conditions into a heavy oil reservoir. U.S. Pat. No. 2015/019556 A1, U.S. Pat. No. 2015/10689567 B2, and U.S. Pat. No. 2015/0152318 A1 pertain to the use of an ammonia fluid as a treatment or fracture fluid in a subterranean reservoir. While those references describe the potential utility of using ammonia in a subsurface hydrocarbon extraction process, such practices hitherto now have been economically challenged due to the lack of a suitable method for shuttling ammonia and hydrocarbon together. Another concept is described in U.S. Pat. No. 8,495,974/U.S. Pat. No. 3,937,445 which together relate to a system for producing and combusting an ammonia-diesel dispersion. But here too, the issue is that the dispersion is produced by transference of material from a dual-fuel tank system by a method which does not produce an ammonia-hydrocarbon dispersion of sufficient stability for practical use in long-distance voyages. As such, challenges remain in creating ammonia fuel mixtures.

Another issue associated with an ammonia fuel supply chain is that ammonia production facilities are costly. The limited availability of capital resources may restrict an ammonia production facility to smaller plant capacities whose cumulative yearly output of ammonia is wholly insufficient to motivate the conversion of a legacy hydrocarbon system to ammonia-service on a year-round basis. In those circumstances, the ammonia might be stored near the production location until it is available in large supply or market forces are sufficiently compelling to motivate its dispatch to market. Here, an issue is that storage facilities are costly, especially with respect to ammonia since it is two to three times less energy-dense than liquid hydrocarbon and must be stored under controlled temperature or pressure conditions. As is practiced in the storage of hydrogen or propane, subsurface ammonia storage has technical, economic, and environmental advantages over the use of a large, specialized ammonia tank farm located at a surface facility. As a complicating logistical factor, hydrocarbon production generally cannot be ceased without incurring economic damages to the reservoir.

Accordingly, there continues to be a need to not only transport ammonia with hydrocarbons, but also systems and methods for using such fuel compositions. The present disclosure is directed to fuel compositions comprising a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon. Further, the disclosure provides for systems and methods for using the fuel compositions.

Disclosed herein is a fuel composition comprising: a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm.

In some embodiments, the droplet size ranges from about 100 nm to about 10 μm. In some embodiments, the fuel composition is thermodynamically stable. In some embodiments, the fuel composition is kinetically stable, as 90% of the fuel composition remains homogenous for at least ten hours.

In some embodiments, the fuel composition further comprises a surfactant. In some embodiments, the surfactant is chosen from nonionic surfactants, anionic surfactants, and combinations thereof. In some embodiments, the nonionic surfactant is chosen from amides, diamides, polyglycol esters, alkyl polyglycosides, sorbitan esters, methyl glucoside esters, fluorocarbon polymers, alkylphenol ethoxylates, alcohol ethoxylates, and combinations thereof. In some embodiments, the anionic surfactant is chosen from stearates, gluconates, glutamates, sarcosinates, lactylates, fatty acid carboxylates, naphthenates, and combinations thereof.

In some embodiments, the non-polar based discontinuous phase is saturated or under-saturated in view of the liquid ammonia. In some embodiments, the polar based continuous phase further comprises a polar co-solvent. In some embodiments, the polar co-solvent is chosen from water, alcohol, ether, and combinations thereof. In some embodiments, the polar based continuous phase further comprises from about 0.1% to about 19.0% by v/v of total polar phase of a polar co-solvent and a surfactant, wherein the surfactant comprises a nonionic surfactant chosen from amides, diamides, polyglycol esters, alkyl polyglycosides, sorbitan esters, methyl glucoside esters, fluorocarbon polymers, alkylphenol ethoxylates, alcohol ethoxylates, and combinations thereof; and/or an anionic surfactant chosen from stearates, gluconates, glutamates, sarcosinates, lactylates, fatty acid carboxylates, naphthenates, lignosulfonates, organic sulfonates, organic sulfates, organic sulfites, organic phosphates, and organic sulfosuccinates preferably containing an alkali metal, alkaline earth metal, transition metal, an ammonium cation, and combinations thereof.

In some embodiments, the fuel composition further comprises an inorganic salt. In some embodiments, the inorganic salt is chosen from ammonium nitrite, ammonium nitrate, ammonium chloride, ammonium bromide, ammonium iodide, ammonium hypochlorite, ammonium thiocyanate, sodium nitrate, potassium nitrate, cesium nitrate, sodium iodide, potassium iodide, and cesium iodide.

In some embodiments, the non-polar based discontinuous phase further comprises a non-polar co-solvent. In some embodiments, the non-polar co-solvent is chosen from propane, other liquefied hydrocarbon gases, and combinations thereof.

In some embodiments, the present disclosure is directed to a method for preparing a fuel product comprising: inverting a fuel composition with a physical stimulus, wherein the fuel composition comprises: a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm to generate the fuel product, and wherein the physical stimulus is chosen from a change in temperature, a change in pressure, a change in composition, and combinations thereof. In some embodiments, further comprising storing the fuel product in a tank or a vessel at a temperature ranging from about minus 92° C. to about 45° C.

In some embodiments, the present disclosure is directed to a fuel dispensing system for transporting, storing and/or delivering a fuel composition comprising at least a pipeline or flow conduit, wherein the fuel composition comprises: a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm. In some embodiment, the method further comprises one or more of: (a) a storage vessel or reservoir; (b) a dispersion manufacturing production facility; (c) an offtake facility; (d) an ontake facility; (e) a product dispensing facility; (f) a data processing facility; and/or (g) a document generating facility. In some embodiments, the system comprises elements (a)-(g).

In some embodiments, the present disclosure is directed to a method for transporting a fuel composition comprising: preparing a fuel composition comprising a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm; and transferring the fuel composition to a pipeline system to transport the fuel composition to a location of use or a production or storage location. In some embodiments, the pipeline system is at a temperature ranging from a freezing point of the polar based continuous phase to about 10° C. In some embodiments, the method further comprises removing the polar based continuous phase and/or the non-polar based discontinuous phase from the composition at an offtake point along the pipeline system generating a remaining fuel composition and continuing to transfer the remaining fuel composition in the pipeline system to the location of use, wherein the remaining fuel composition does not invert. In some embodiments, the method further comprises adding a polar and/or a non-polar additive to an ontake point along the pipeline system forming a remaining fuel composition, wherein the remaining fuel composition does not invert.

In some embodiments, the step of transferring the fuel composition further comprises a value-enhancing document to identify an origin of the fuel composition. In some embodiments, the value-enhancing document is transferred via a certificate swap with a third party. In some embodiments, the step of transferring the composition comprises supervising the composition by a system administrator and verifying the value-enhancing document of the composition.

In some embodiments, the pipeline system is chosen from a crude oil sales pipeline system, a crude oil production pipeline system, a legacy hydrocarbon system, and combinations thereof. In some embodiments, the method further comprises, before or after transferring the fuel composition, implementing a delivery schedule of the fuel composition. In some embodiments, the location of use is a subterranean reservoir.

In some embodiments, the frozen hydrocarbon is an ammonia saturated crude oil handled at a temperature below the gel point of the ammonia saturated crude oil. In some embodiments, the viscous liquid hydrocarbon is an ammonia saturated crude oil handled at a temperature above the gel point of the ammonia saturated crude oil. In some embodiments, the liquefied volatile hydrocarbon is propane. In some embodiments, the storage location is chosen from a marine vessel, a fuel tank, a combustion system, and combinations thereof. In some embodiments, the method further comprises, after transferring, processing the fuel composition at a distribution facility to form a ready-to-use partially decarbonized fuel, and delivering the fuel.

In some embodiments, the present disclosure is directed to a method for preparing a fuel composition of an ammonia-hydrocarbon dispersion comprising: combining ammonia, hydrocarbon, and a stabilization agent under temperature, pressure, and/or composition conditions to form an ammonia-hydrocarbon dispersion with a HLD>0; using temperature, pressure, and/or composition conditions to modify the ammonia-hydrocarbon dispersion to HLD~0; and transporting or storing the ammonia-hydrocarbon dispersion under temperature or pressure conditions corresponding to HLD<0. In some embodiments, the ammonia-hydrocarbon dispersion is a kinetically stable dispersion. In some embodiments, the stabilization agent is chosen from a surfactant, an inorganic clay, a pH-buffering composition, a polymer gelation agent, and combinations thereof.

BRIEF DESCRIPTION OF DRAWING(S)

Figure 9A:
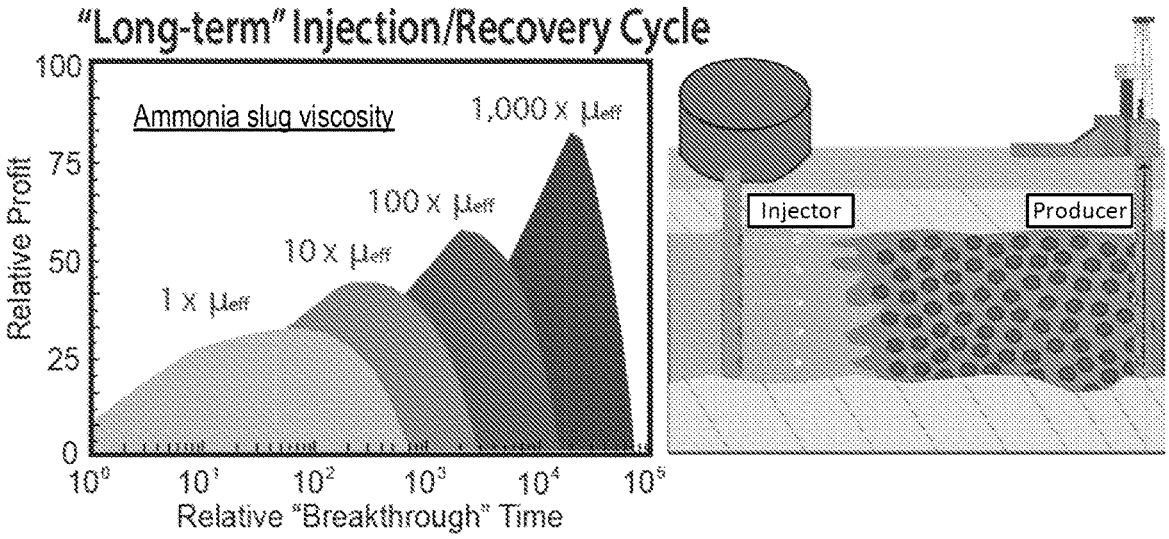
Figure 9B:
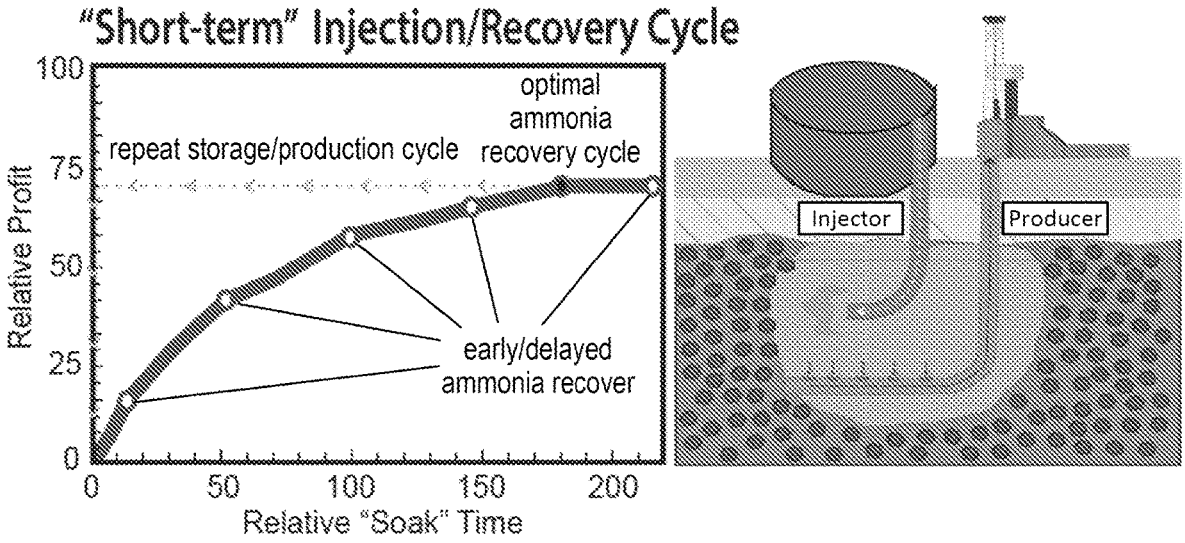

FIGS. 9(A) and 9(B) illustrate embodiments of revenue-generating storage systems that provide for a carbon-free, partially decarbonized, or "gray" commodity introduced into a subterranean reservoir when not scheduled for immediate delivery, as provided in some embodiments of the present disclosure.

Figure 10A:
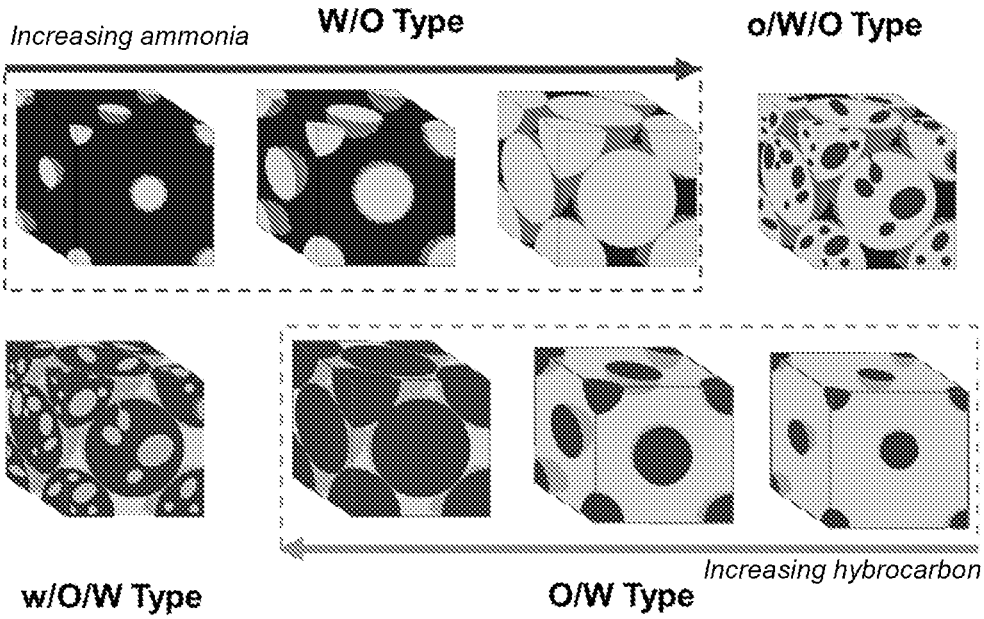
Figure 10B:
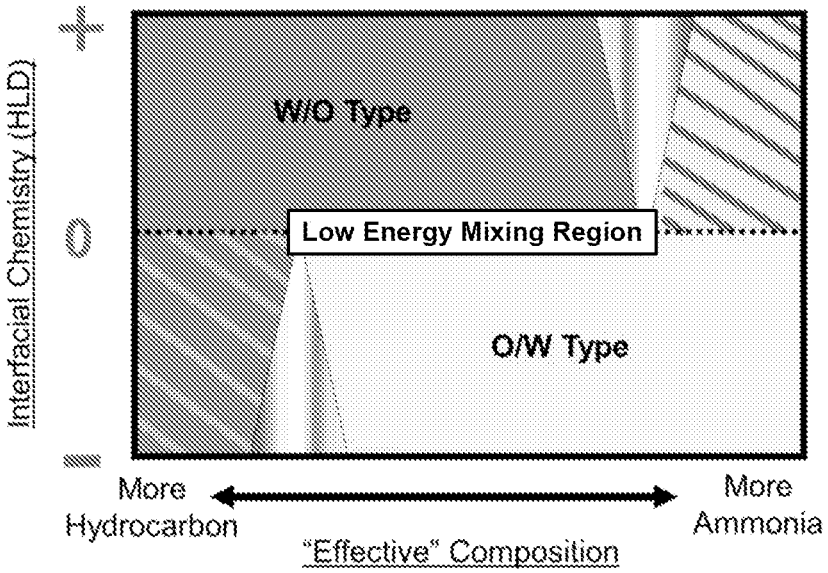

FIGS. 10(A) and 10(B) illustrate composition-structure-property relationships relevant to the handling of an ammonia-hydrocarbon dispersion.

Figure 11:
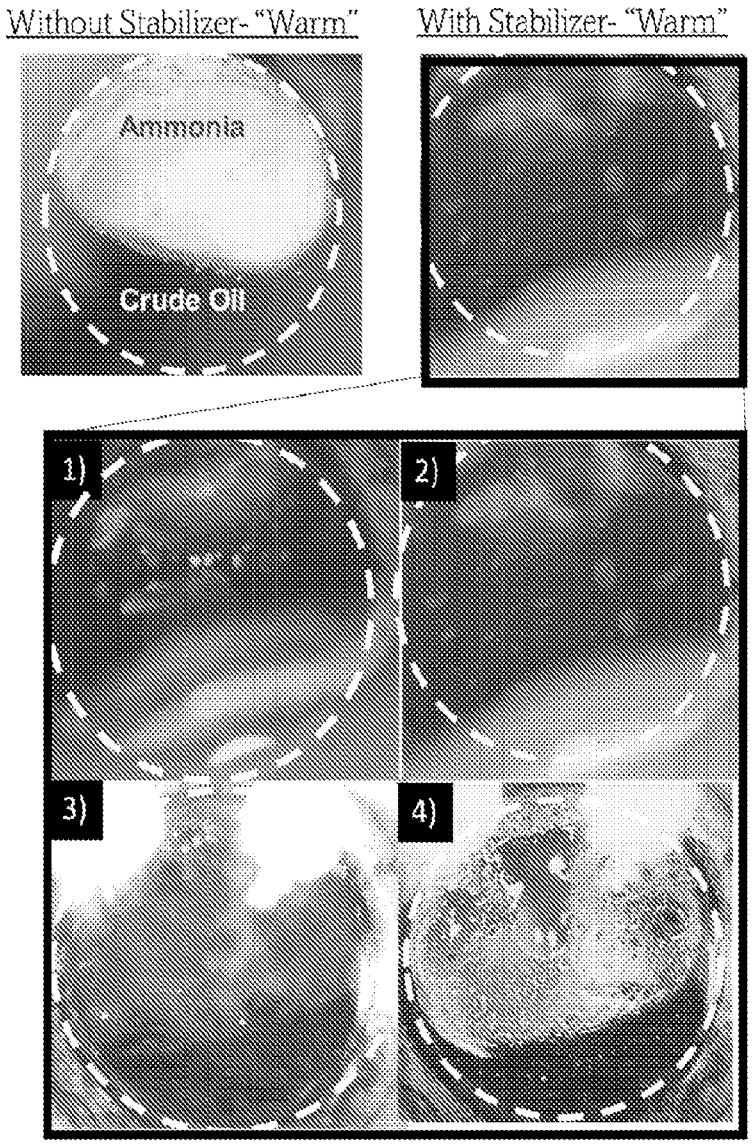

FIG. 11 depicts annotated images of ammonia-hydrocarbon dispersions prepared with or without stabilizing surfactants, as provide in some embodiments of the present disclosure.

Figure 12A:
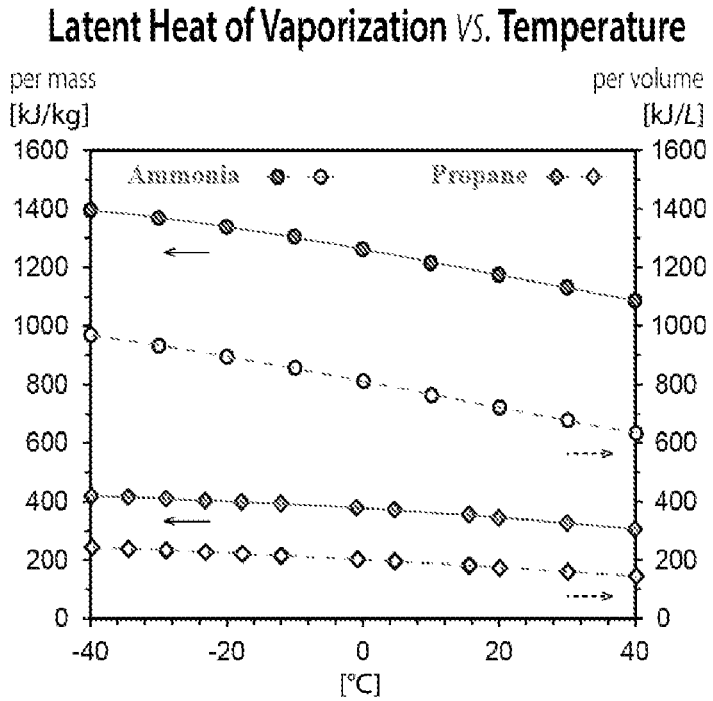
Figure 12B:
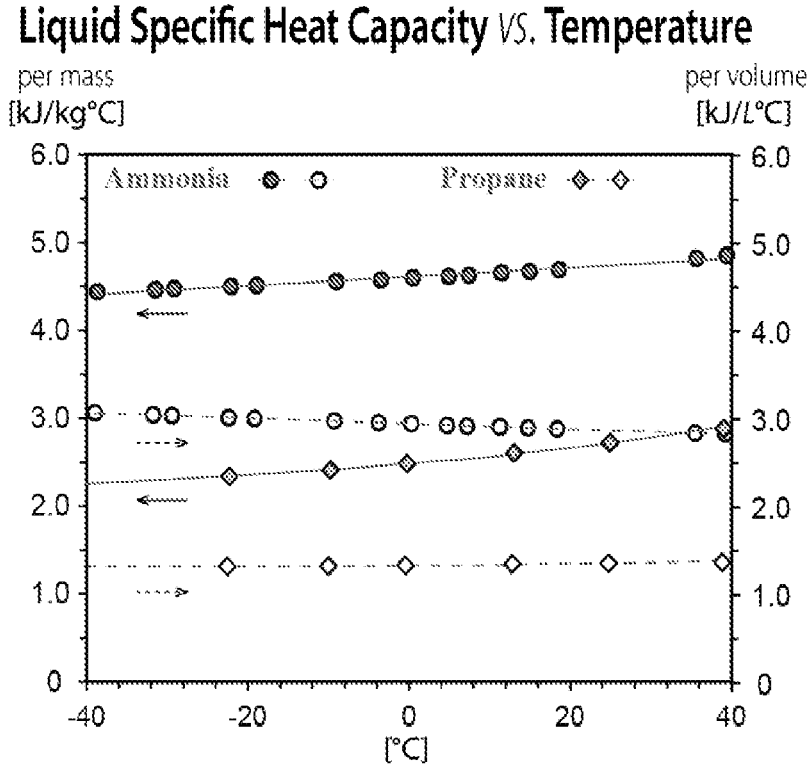

FIGS. 12(A) and 12(B) depict the thermodynamic properties of liquid ammonia in comparison to liquid propane, a volatile hydrocarbon.

Figure 13A:
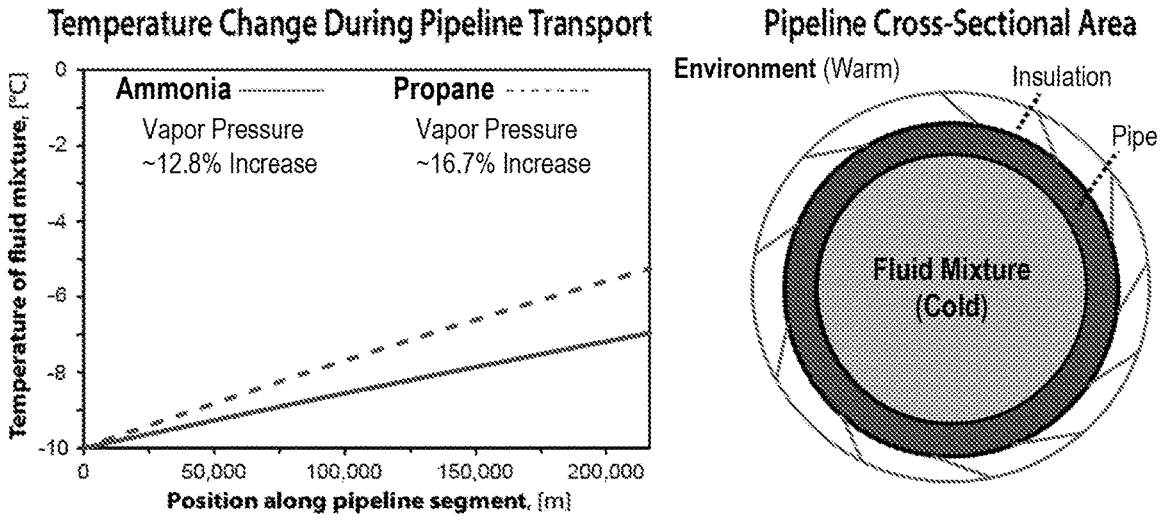
Figure 13B:
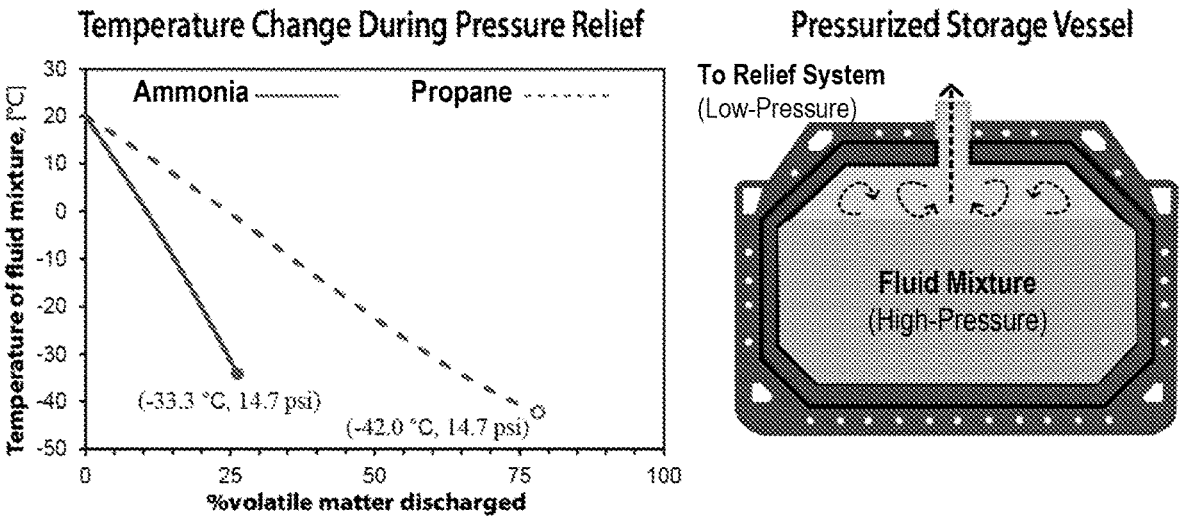

FIGS. 13(A) and 13(B) illustrate some embodiments of the present disclosure with the transportation of volatile hydrocarbon in thermal contact with ammonia-rich media resisting changes in temperature during pipeline transmission and reduces vapor hazards associated with release from a storage tank.

Figure 14:
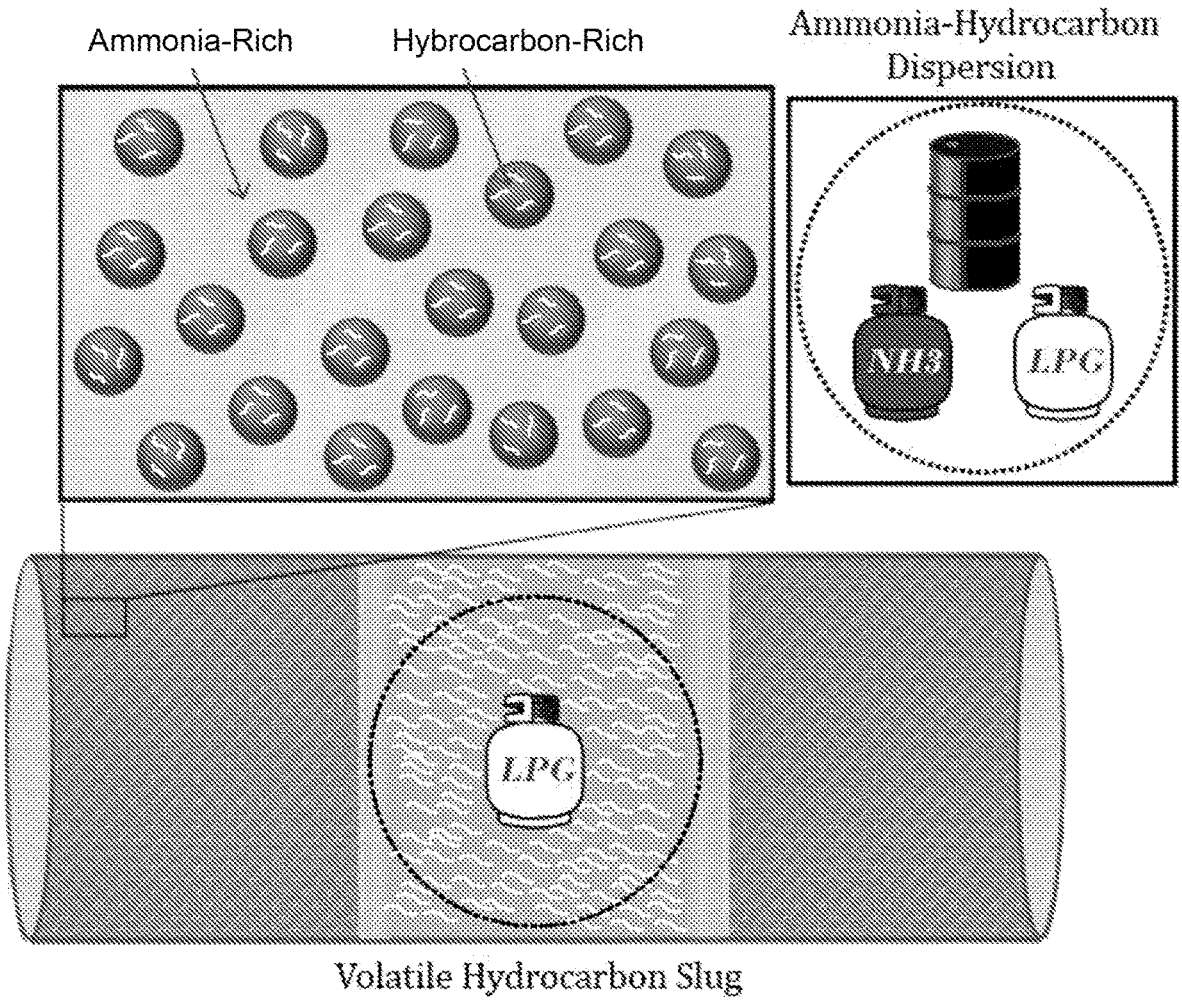

FIG. 14 illustrates the transportation of ammonia, viscous hydrocarbon, and volatile hydrocarbon within a shared pipeline system.

Figure 15:
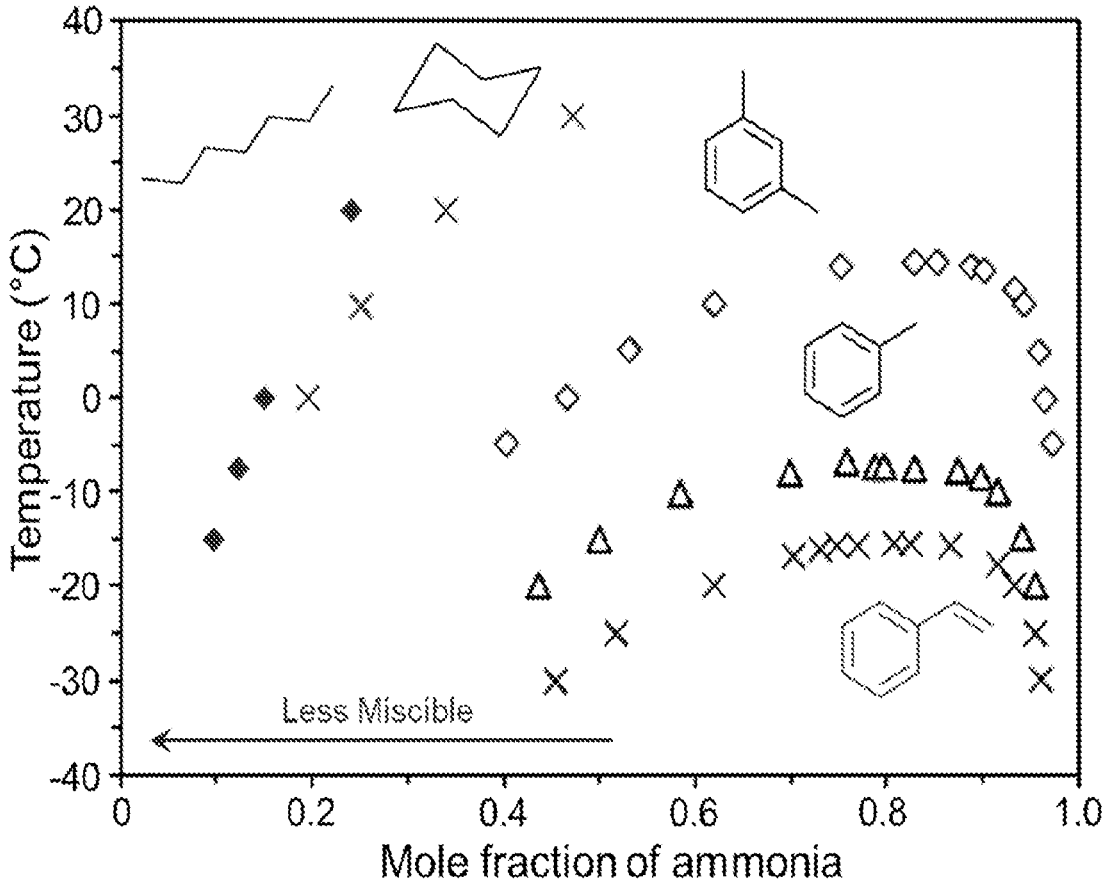

FIG. 15 graphically depicts ammonia's solvent affinity for aromatic/olefinic hydrocarbons over paraffinic hydrocarbons at low temperatures produced using data from I. Kiyoharu, "Mutual Solubilities of Some Hydrocarbon Oils and Liquid Ammonia. I. Solubility Data", *Bulletin of the Chemical Society of Japan* (1958), vol. 31, no. 2, pp 143-148.

Figure 16:
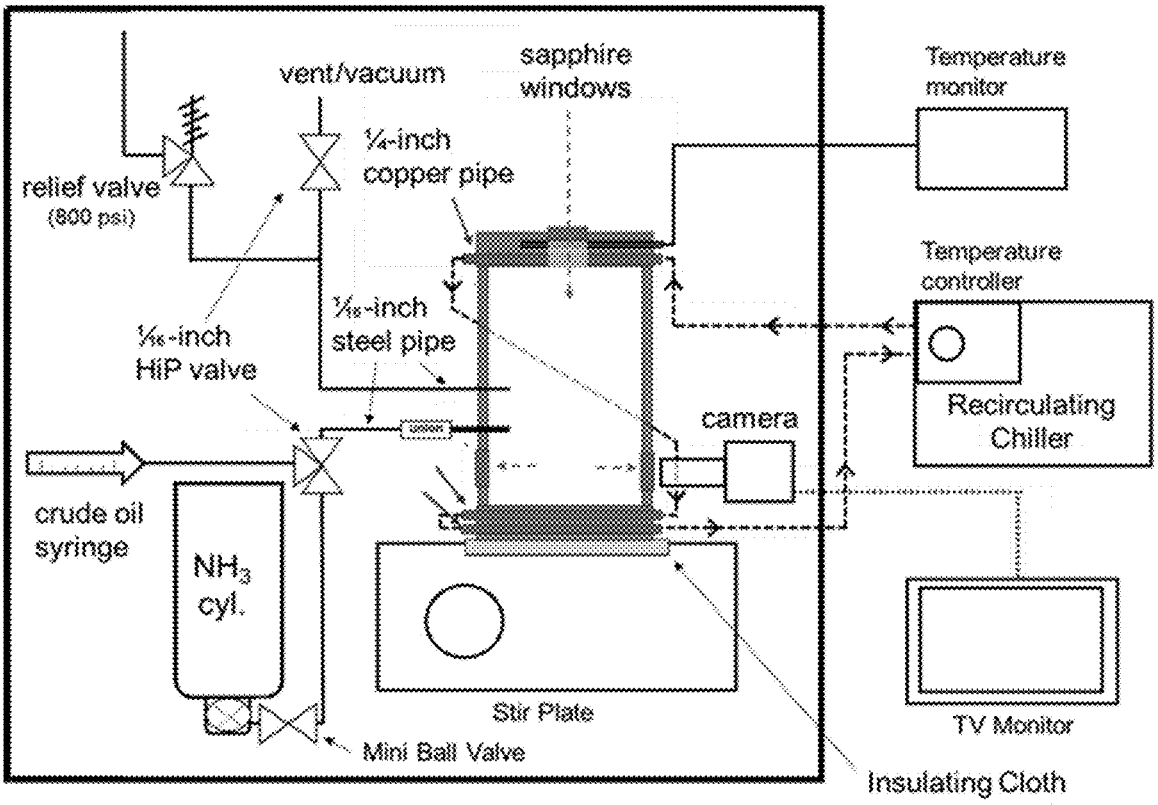
Figure 16:
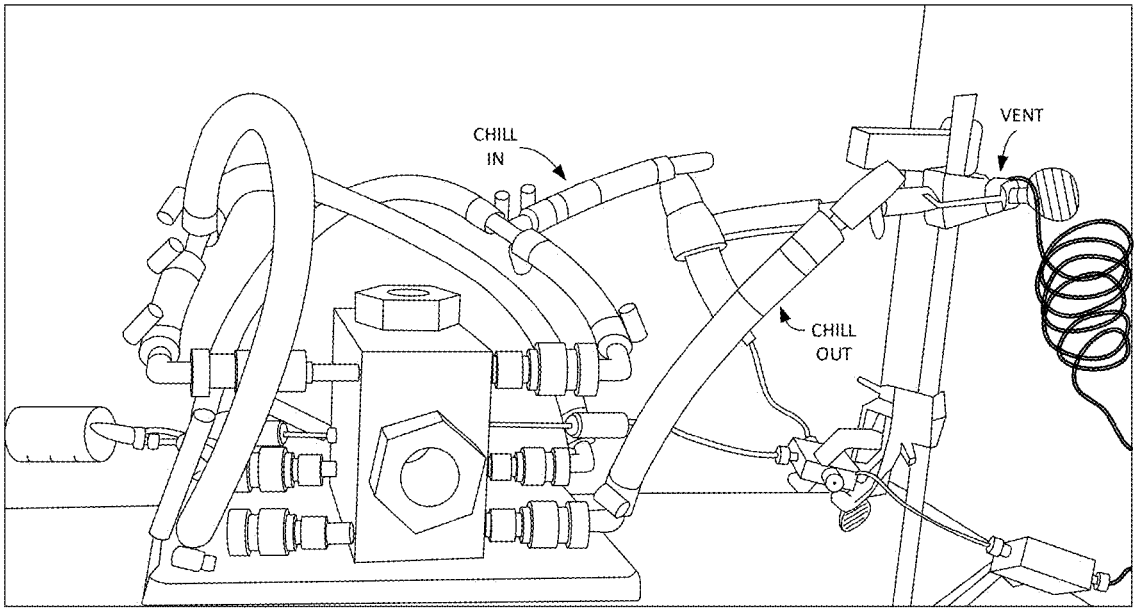

FIG. 16 is a schematic diagram and photograph of the view-cell apparatus used in the Examples, according to some embodiments of the present disclosure.

Figure 17:
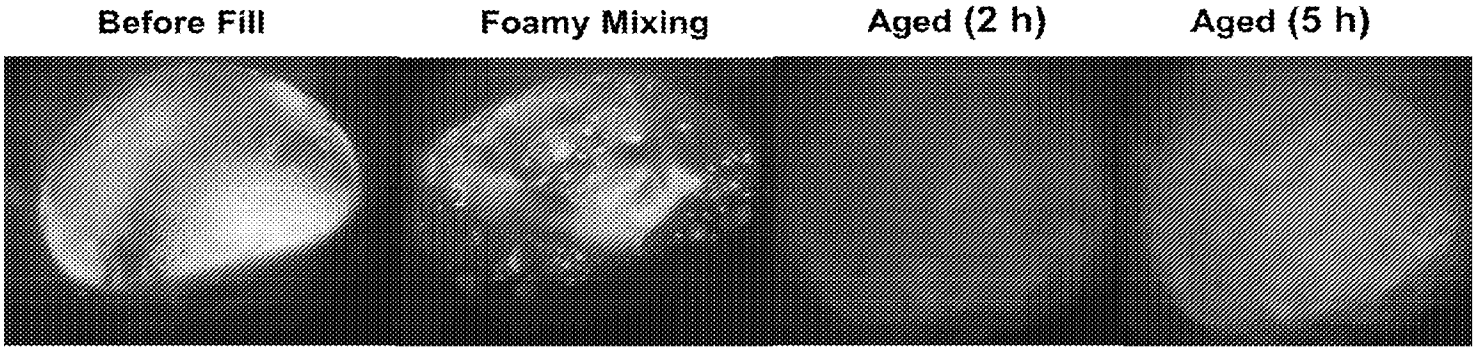

FIG. 17 depicts the differences in the refractive properties between ammonia-hydrocarbon dispersions AHD-3 of the third Example stored for two hours and at five hours, according to some embodiments of the present disclosure.

Figure 18:
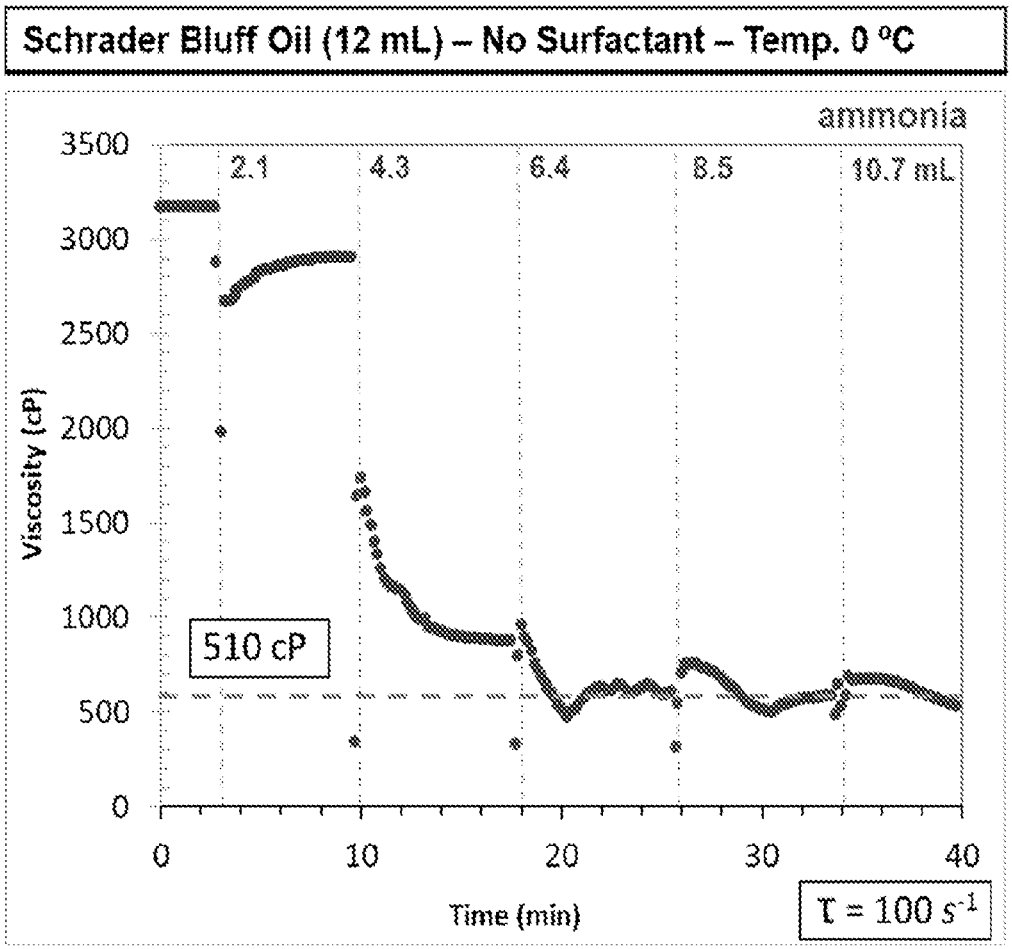

FIG. 18 illustrates the viscosity data presented in Schrader Bluff Oil (12 mL) with no surfactant at a temperature of 0° C.

Figure 19:
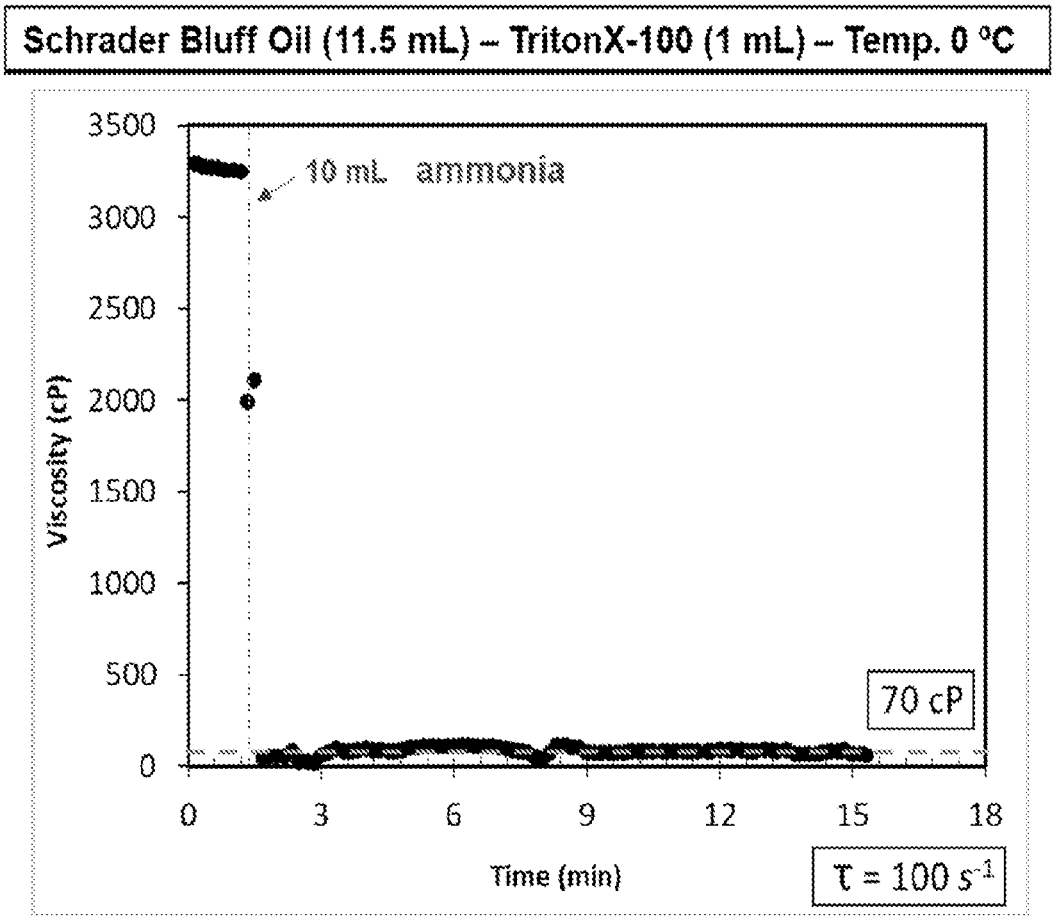

FIG. 19 illustrates the viscosity data presented in Schrader Bluff Oil (111.52 mL) with Triton X-100 (1 mL) at a temperature of 0° C.

Figure 20:
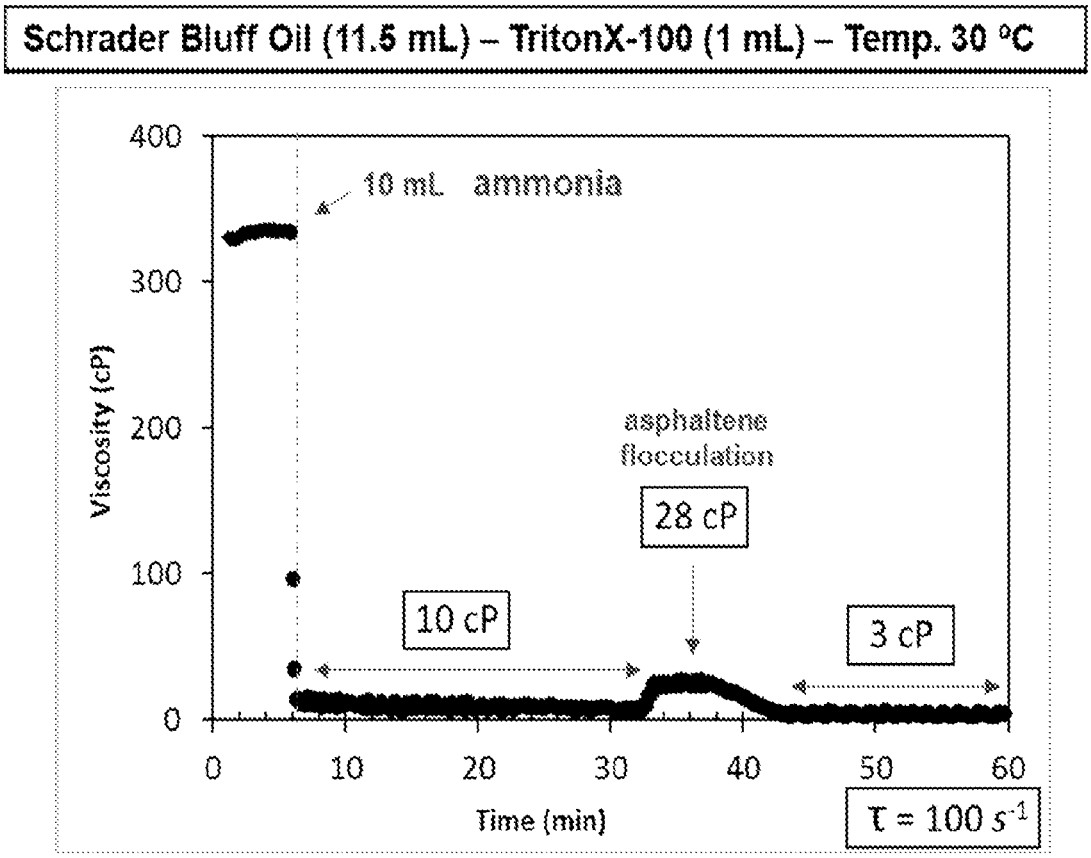

FIG. 20 illustrates the viscosity data presented in Schrader Bluff Oil (111.52 mL) with Triton X-100 (1 mL) at a temperature of 30° C.

Figure 21A:
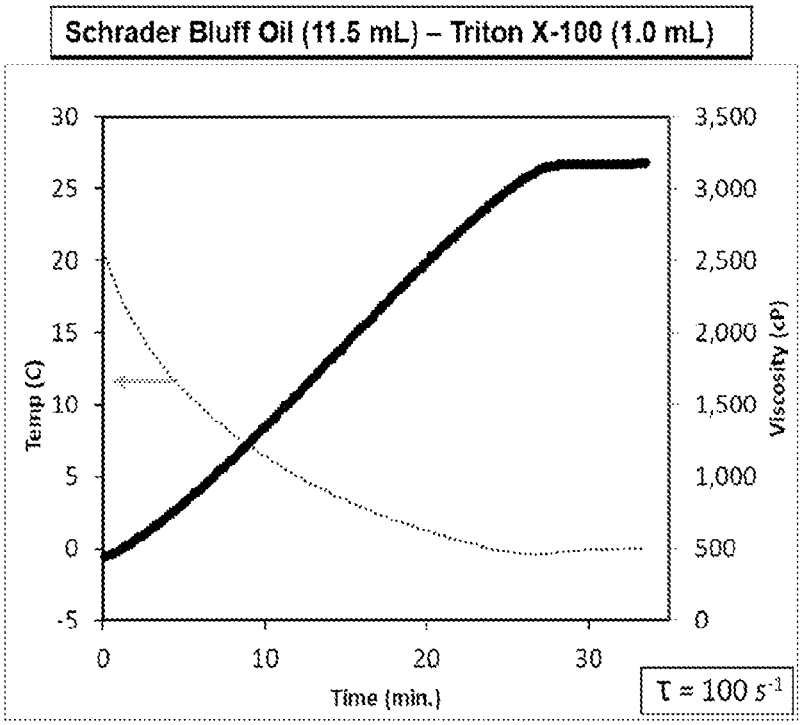
Figure 21B:
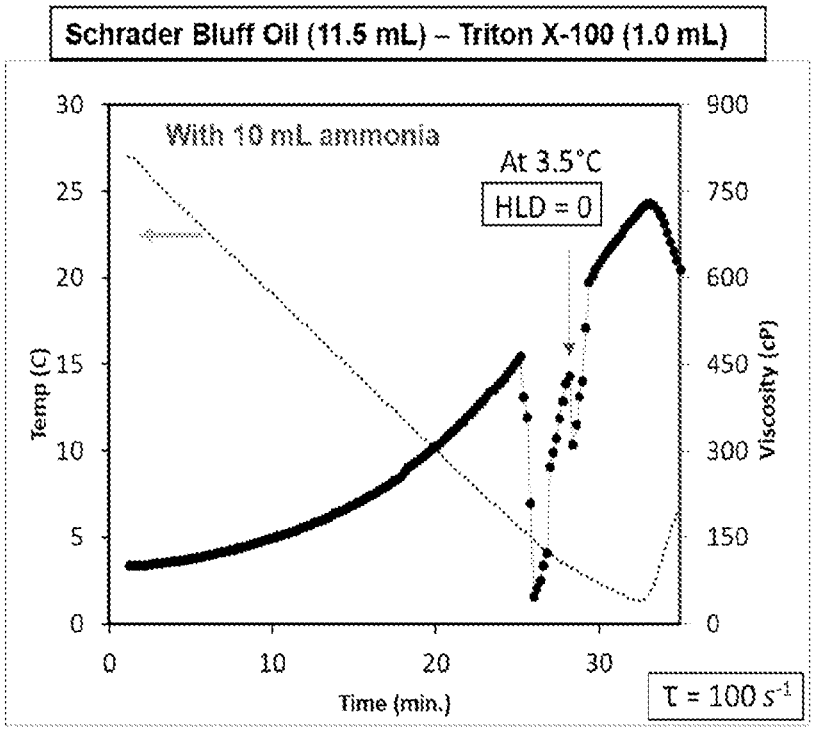

FIG. 21A illustrates the viscosity of a mixture of Schrader Bluff and nonionic surfactant measured in a rheometer cell using a concentric cylinder spindle operating at a constant shear rate of 100 $s^{-1}$ as the hydrocarbon was cooled slowly from about 20° C. to about 0° C. FIG. 21B illustrates the viscosity of a mixture of Schrader Bluff oil, liquid ammonia, and nonionic alcohol ethoxylate surfactant measured in a rheometer cell using a concentric cylinder spindle operated at a constant shear of 100 $s^{-1}$ as the mixture was cooled slowly from about 27° C. to about 1° C.

Figure 22:
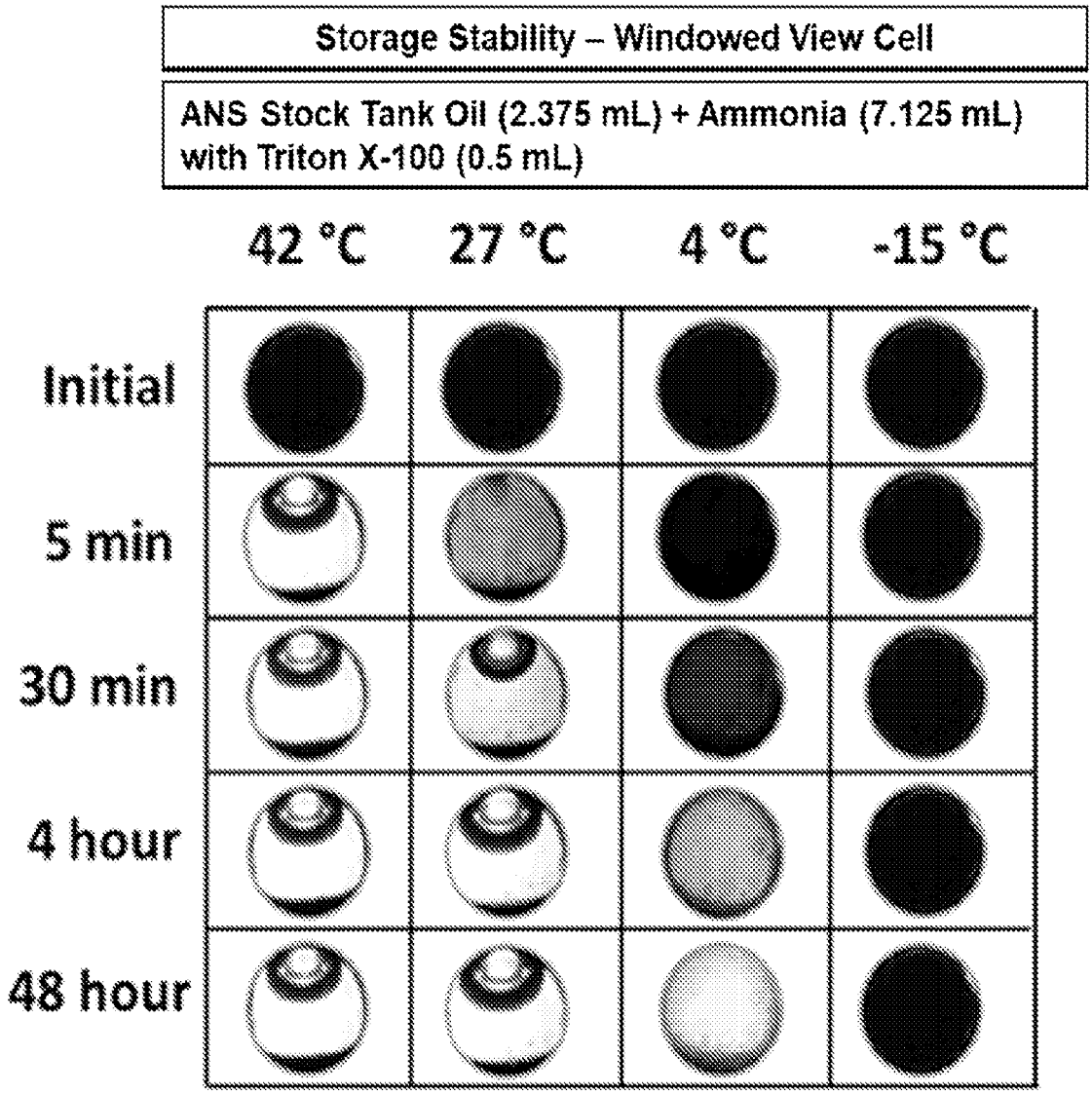

FIG. 22 depicts images from long-term storage stability screening conducted using 2.375 mL ANS Stock Tank oil, 7.125 mL liquid ammonia, and 0.5 mL Triton X-100.

Figure 23:
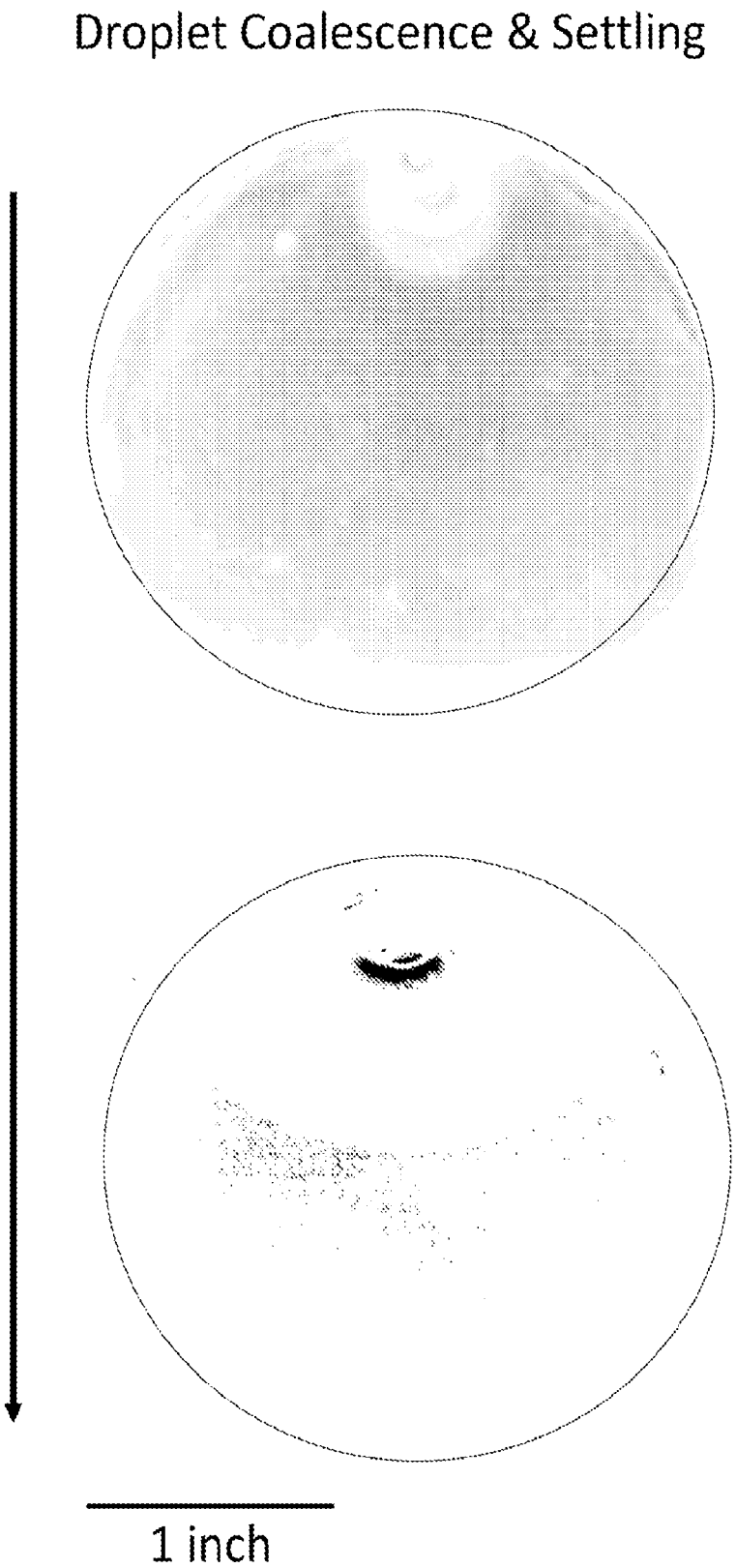

FIG. 23 illustrates droplet coalescence and settling.

Figure 24:
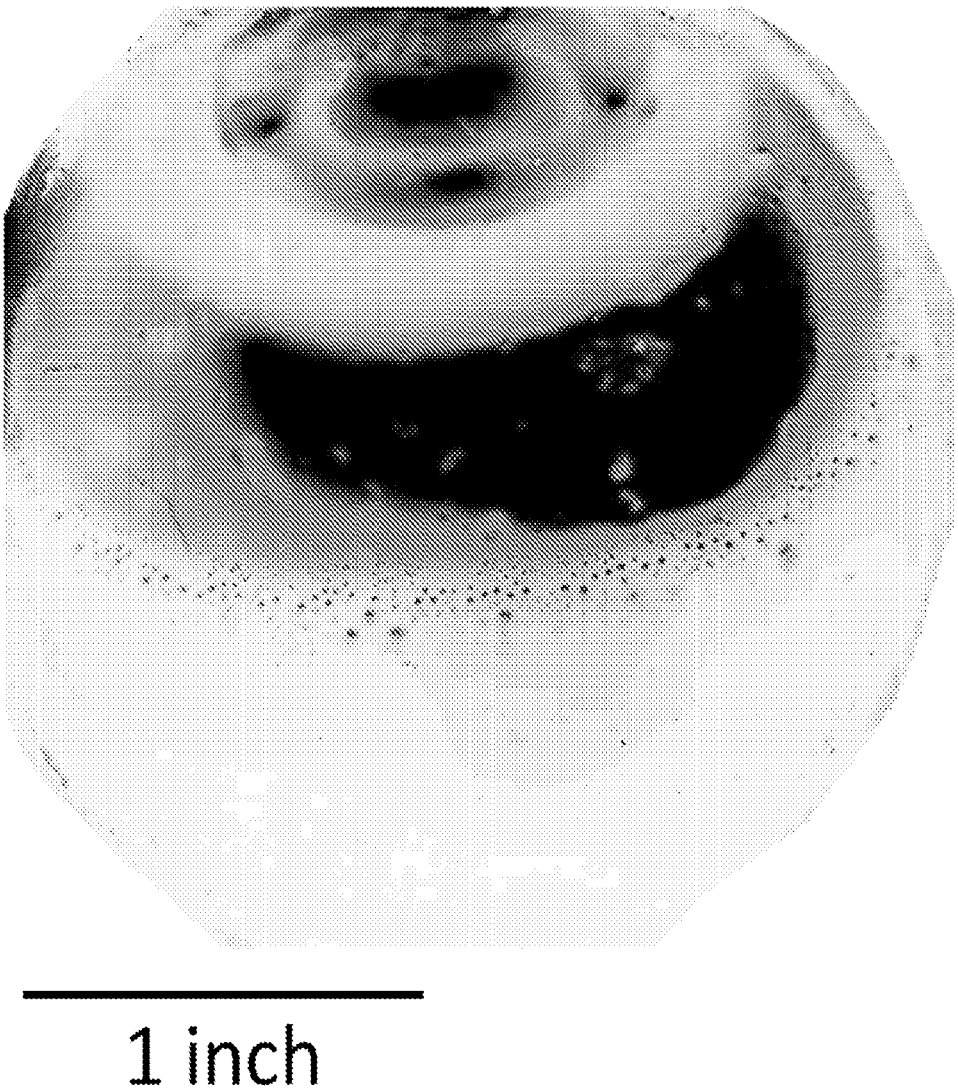

FIG. 24 is a picture of a hydrocarbon-rich lower phase that is the inverse fuel composition, which comprises a hydrocarbon continuous phase comprising ammonia droplets, and an ammonia-rich upper phase.

DEFINITIONS

As used herein, "a" or "an" entity refers to one or more of that entity, e.g., "a compound" refers to one or more compounds or at least one compound unless stated otherwise. As such, the terms "a" (or "an"), "one or more", and "at least one" are used interchangeably herein.

As used herein, the term "about" means approximately, in the region of, roughly, or around. When the term "about" is used in conjunction with a numerical range, it modifies that range by extending the boundaries above and below the numerical values set forth. In general, the term "about" is used herein to modify a numerical value above and below the stated value by a variance of 10%.

As used herein, the term "crude oil" is interchangeable with bitumen, heavy oil, tar, residual oil, distillate oil, or any other hydrocarbon product. When crude oil is produced at the wellhead, it may be referred to as 'live oil' if it contains volatile hydrocarbon and dissolved gases. Prior to transport through a sales pipeline, it is common practice that the volatile components are removed to obtain a de-volatized 'dead oil' having improved compatibility with respect to the hydrocarbon system.

The following description provides the various embodiments of the different aspects of the disclosed compositions, methods, and processes. For example, the present disclosure is directed to fuel compositions comprising a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm. Additionally, the present disclosure is directed to methods for preparing a fuel product comprising: inverting a fuel composition with a physical stimulus, wherein the composition comprises: a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm, and wherein the physical stimulus is chosen from a change in temperature, a change in pressure, a change in composition, and combinations thereof. Further, the present disclosure is directed to a fuel dispensing system for transporting, storing and/or delivering a fuel composition comprising a pipeline or flow conduit, wherein the fuel composition comprises a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm. The fuel dispensing system further comprises one or more of the following: (a) a storage vessel or reservoir; (b) a dispersion manufacturing production facility; (c) an offtake facility; (d) an ontake facility; (e) a product dispensing facility; (f) a data processing facility; and/or (g) a document generating facility.

In addition, the present disclosure is directed to methods for transporting a fuel composition comprising: preparing a fuel composition comprising a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm; and transferring the fuel composition to a pipeline system to transport the fuel composition to a location of use or a production or storage location.

As provided in the present disclosure, a liquid ammonia is used as a major constituent of a continuous dispersing fluid of the fuel composition disclosed herein. Although the handling of ammonia poses a comparable risk portfolio to that associated with the handling of liquid hydrocarbon fuels, the former has a lower explosion hazard but elevated toxicity hazard. Additionally, ammonia is known to be corrosive to steel under operating conditions corresponding to a hot oil pipeline with a temperature range of about 30° C. to about 65° C. For the same temperature range, a compounding issue is that ammonia's high vapor pressure requires operating pressures greater than about 155 psig to about 415 psig to maintain ammonia in the liquid state. Higher operating pressures increase the likelihood of pipeline rupture and raise transportation costs due to the need for additional pumping stations to maintain the line pressure. Other factors discouraging the use of ammonia as a continuous dispersing fluid are material compatibility issues (e.g., polymeric gaskets, brass fittings, etc.), a paucity of data pertaining to the properties of ammonia-hydrocarbon mixtures, and since carbon-containing dispersing media (i.e., methanol, dimethyl ether, etc.) would likely be used over ammonia in "business-as-usual" climate scenarios. Thus, the present disclosure provides an improved method for transporting ammonia by pipeline and to provide a method of manufacturing ammonia-hydrocarbon dispersions, i.e., fuel compositions.

Despite the challenges associated with ammonia, there are several potential benefits associated with the use of ammonia as a dispersing media over more conventional dispersing media such as water or alcohol. At ambient temperature, the surface tension of saturated liquid ammonia is about 25 dyn/cm, whereas that of saturated liquid water is about 73 dyn/cm. Further, at ambient temperature, saturated liquid hydrocarbon typically has a surface tension of about 5 dyn/cm-15 dyn/cm depending on composition. In manufacturing, with a dispersion via high-pressure homogenization, a greater difference in surface tension between the continuous and discontinuous fluids requires a greater input mixing energy to produce a dispersion. Thus, the use of ammonia as a dispersing media allows a process to be facilitated at more moderate pressures albeit under sufficient pressure that ammonia is maintained in the liquid state. With respect to performance, liquid ammonia excels as a dispersing medium due to its relatively low viscosity and low mass density which, lowers pumping costs and increases maximum volumetric throughput associated with pipeline transport.

Although ammonia's high vapor pressure poses challenges to the transport or storage of ammonia-hydrocarbon dispersions, its high vapor pressure allows for ammonia to be easily degassed from crude oil at downstream facilities avoiding contamination issues. With respect to value-added processing, liquid ammonia is distinguishable from other polar fluids as a solvent in that it has a preferential interaction for aromatic/olefinic hydrocarbons over paraffinic hydrocarbons, which may be exploited in the solvent fractionation of crude oil to recover high-value aromatic/olefinic-rich hydrocarbon products. Due to its high alkalinity, the use of ammonia allows for the transportation of acidic crudes whereby stability is benefited by the neutralization of petroleum acids and low-temperature corrosion caused by sulfur compounds (i.e., $H_2S$) is mitigated. At the molecular level, ammonia is also distinguished from other protic polar solvents in that it is considered a universal hydrogen-bond acceptor but is a remarkably poor hydrogen-bond donor as discussed in the article by D. Nelson, G. T. Fraser Jr., and W. Klemperer titled "Does Ammonia Hydrogen Bond?" published in Science (1987), vol. 238, pp 1670-1674. For example, the function of ammonia as a hydrogen-bond acceptor is useful in dispersion manufacturing as it promotes interfacial stability via interactions with petroleum acids and polar hydrocarbon compounds such as asphaltenes. For pipeline transport of dispersions, the unique properties of the ammonia molecule including low surface tension (i.e., a macroscopic manifestation of poor hydrogen-bonding network connectivity), is associated with weaker capillary forces than are typically encountered in water or alcohol dispersions. In some embodiments, this is beneficial as stronger capillary forces are typically associated with higher effective viscosity values and higher stability dispersions that are challenging to disassociate at a separation facility.

Fuel Composition(s)

Disclosed herein are fuel compositions comprising: a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm.

As used herein, the term "an emulsion" is defined as a suspension of 'Liquid A' droplets dispersed into a pool of 'Liquid B' and the reverse emulsion as a suspension of 'Liquid B' droplets dispersed into a pool of 'Liquid A'. Another type of mixture is a solid-dispersion which is here defined as a suspension of 'Solid A' droplets in a pool of 'Liquid B' or likewise the reverse solid-dispersion, a suspension of 'Solid B' droplets in a pool of 'Liquid A'. As provided herein, 'Species A' and 'Species B' refer to a hydrocarbon-rich and ammonia-rich fraction, respectively. Hereafter, both emulsions and solid-dispersions will be simply referred to as 'dispersions' as the distinction between liquid or solid is difficult to ascertain for complex multi-component hydrocarbon mixtures such as crude oil. In some embodiments, specific mention of the physical state of the various constituents may be indicated when pertinent to the practice of the present disclosure. The compositions of the present disclosure may be described as an emulsion, dispersion, and/or a mixture; composition, emulsion, dispersion, and mixture are used interchangeably.

The fuel compositions disclosed herein are provided for use in a fuel dispensing system comprising at least a pipeline or flow conduit. In some embodiments of the present disclosure, the fuel compositions are fuel products or fuels. As used herein, a fuel product or fuel include, but are not limited to, gasoline, diesel fuel, fossil fuels, biofuels, petroleum gas (e.g., methane, butane and propane), and any other combustible fluids or materials. Fuel products or fuels are generally used in the aviation, marine, or automotive industries. Most fuels and fuel products are supplied, refined, and distributed. Hydrocarbon fuels are the most common fuels and fuel products. Fuels and fuel products rely upon the combustion of hydrogen and carbon molecules to produce energy. In some embodiments, the fuel compositions according to the present disclosure can be a fuel product or a fuel with or without any further processing or modification. In some embodiment, however, further processing of the present disclosed fuel composition is needed to arrive at the fuel product or fuel.

Chemical, Physical, & Rheological Properties

Because the present disclosure pertains to the production, handling, transporting, and modification of ammonia-hydrocarbon dispersions at unconventionally low-temperatures, the present disclosure provides for an overview of the properties of the constituents of the fuel compositions.

For comparison, the three cheapest non-hydrocarbon dispersing fluids available at global commodity scale are typically water, methanol, and ammonia in that order on a mass basis. In TABLE I below, the properties of these non-hydrocarbon dispersing fluids are compared with those of hydrocarbon fluids. In relation to its volatility, ammonia presents greater processing challenges in comparison to the other non-hydrocarbon dispersing fluids but is favorable in downstream processing if the separation of ammonia and hydrocarbon is desired. Furthermore, in some embodiments, ammonia's lower mass density, lower viscosity, high heat capacity, and high enthalpy of vaporization imparts greater characteristics to the operation of a legacy hydrocarbon system. As used herein, the term "a legacy hydrocarbon system" refers to as an existing pipeline system or storage tank farm which was previously operated exclusively (defined as >95% of total volumetric flowrate) for the handling of hydrocarbon material but which is modified for the handling of the ammonia-hydrocarbon dispersion, such as operating at temperatures below about 5° C. where corrosion rates are reduced and dispersion stability improved.

TABLE I

| | Normal Boiling Point ($T_{b.p.}$) [° C.] | Liquid Density (20° C., 10 atm) [kg/m$^3$] | Liquid Viscosity (20° C., 10 atm) [c]P] | Liquid Heat Capacity 20° C., 10 atm) [kJ/kg-° C.] | Normal Enthalpy of Vapor-ization [kJ/kg] |
|---|---|---|---|---|---|
| *†Water | 100 | 999 | 1.00 | 4.18 | 2,256 |
| *†Methanol | 65 | 793 | 0.57 | 2.50 | 1,100 |
| *†Ammonia | −33 | 610 | 0.14 | 4.74 | 1,371 |
| †Propane | −42 | 501 | 0.10 | 2.67 | 368 |
| †Benzene | 80 | 880 | 0.66 | 1.69 | 394 |
| ‡ANS Light Oil | N/A | 869 | ~9.3 | ~1.69 | N/A |
| §ANS Heavy Oil | N/A | 983 | ~2,200 | ~1.69 | N/A |

*Indicates high potential for use a low-cost polar dispersing medium.

†Eric W. Lemmon, Mark O. McLinden and Daniel G. Friend, "Thermophysical Properties of Fluid Systems" in NIST Chemistry WebBook, NIST Standard Reference Database Number 69, Eds. P.J. Linstrom and W.G. Mallard, National Institute of Standards and Technology, Gaithersburg MD, 20899, https://doi.org/10.18434/T4D303, (retrieved Oct. 10, 2021).

‡S. Nerella, D.K. Das, G.A. Chukwu, A.Y. Dandekar, S. Khataniar, and S.L. Patil, "Heat Transfer Analys is for Gas-to-Liquids Transportation Through Trans Alaska Pipeline". *Petroleum Science and Technology* (2003), vol 21, issue 7&8, pp 1275-1294.

§I. Bazyleva, B. Akeredolu and M.W. Liberatore, "Viscosity of Alaska Heavy Oil Saturated with Methane". *Energy Fuels* (2013), vol 27, issue 2, pp 743-751.

TABLE II

Comparative physicochemical and rheological properties of low-cost polar dispersing media (Liquid-Phase) and representative non-polar hydrocarbon liquids emphasizing how ammonia is greatly distinguished from water or methanol.

| Component Sat. Pressure @$T_{B.P.}$ [atm] | Properties of Saturated Liquid at Boiling Point* Boiling Point [° C.] | Sat. Liq. Density [kg/m$^3$] | Sat. Liq. Viscosity [cP] | Sat. Liq. Surface Tension [dyn/cm] | Polarizability †Dielectric Constant [dimensionless] | Safety Flash Point [° C.] |
|---|---|---|---|---|---|---|
| Water | | | | | | N/A |
| @(1 atm) | 100.0 | 998 | 1.00 | 72.7 | @20° C. $\gamma_{H2O}$ = 80.1 | below |
| @(10 atm) | 180.5 | 887 | 0.15 | 42.1 | | below |
| @(80 atm) | 295.9 | 720 | 0.09 | 15.3 | | below |
| Methanol | | | | | | 9.0 |
| @(1 atm) | 64.5 | 748 | 0.33 | 18.9 | @20° C. $\gamma_{MeOH}$ = 32.7 | flash risk |
| @(10 atm) | 137.1 | 665 | 0.13 | 11.9 | | flash risk |
| @(80 atm) | 239.5 | 328 | 0.06 | <0.1 | | flash risk |
| Ammonia | | | | | | 132.0 |
| @(1 atm) | -33.3 | 682 | 0.26 | 44.8 | @20° C. $\gamma_{NH3}$ = 16.6 | below |
| @(10 atm) | 25.3 | 602 | 0.13 | 24.7 | | below |
| @(80 atm) | 113.6 | 413 | 0.05 | 2.6 | | below |
| Propane | | | | | | -104.4 |
| @(1 atm) | -42.1 | 581 | 0.20 | 15.8 | @20° C. $\gamma_{Propane}$ = 1.7 | flash risk |
| @(10 atm) | 27.5 | 489 | 0.09 | 6.7 | | flash risk |
| @(80 atm) | super critical | — | — | — | | — |
| Benzene | | | | | | -11.6 |
| @(1 atm) | 80.1 | 779 | 0.31 | 21.1 | @20° C. $\gamma_{Benzene}$ = 1.7 | flash risk |
| @(10 atm) | 179.2 | 689 | 0.13 | 9.6 | | flash risk |
| @(80 atm) | super critical | — | — | — | | — |

"Eric W. Lemmon, Mark O. McLinden and Daniel G. Friend, "Thermophysical Properties of Fluid Systems" in NIST Chemistry WebBook, NIST Standard Reference Database Number 69, Eds. P.J. Linstrom and W.G. Mallard, National Institute of Standards and Technology, Gaithersburg MD, 20899, https://doi.org/10.18434/T4D303, (retrieved Oct. 10, 2021).

†Israelachvili, Jacob. "Intermolecular and Surface Forces". Academic Press, Jul. 22, 2011 - Science - 704 pages. Noting, that the dielectric constant is related to, but not interchangeable with, the concept of polarizability and is an important factor influencing the properties of dispersions.

In TABLE II above, it is shown that with respect to certain hazards, the handling of ammonia poses less of a risk in comparison to liquid methanol or hydrocarbon. For example, within process equipment or a pipeline system at pressures up to 80 atmospheres, saturated liquid ammonia does not exceed its flash point of 132° C., thus reducing the risk of fire or an explosion in emergency situations.

As can been seen in FIG. 12(B), ammonia-rich dispersing media has a high specific heat capacity which exceeds that of even water. When transporting volatile hydrocarbon through a pipeline system, there is a substantial risk of boil off as the volatile hydrocarbon adsorbs heat from the environment. To address this issue, it is often necessary to use costly insulation or to install several chiller stations along the pipeline route to prevent unsafe temperature rises. In some embodiments, an ammonia-rich dispersing media is used as a thermal sink to resist temperature changes occurring during transport or storage. Upon release, anhydrous ammonia rapidly forms a vapor cloud that may pose risks to human health or the environment. In some embodiments, such as transport and storage, the ammonia-hydrocarbon dispersion has improved safety characteristics over anhydrous ammonia.

For example, FIG. 13(A) presents a simulation of the temperature rise occurring during the shuttling mixtures comprised of 50% w of crude oil and 50% w of a volatile compound which is ammonia or propane, respectively. This simulation corresponds to a 48-inch diameter 100-mile pipeline segment, a fluid inlet temperature of −10° C., and an ambient air temperature of 20° C. Here, ammonia's heat capacity is higher than that of liquid propane, or other hydrocarbon, and its presence is beneficial as a thermal sink enhancing resistance to temperature changes during transit. As shown in FIG. 14, this is realized both for ammonia-hydrocarbon dispersions and with respect to the transport of a volatile hydrocarbon slug whereby thermal contact between the pipeline walls and the hydrocarbon fluid occurs whether or not the hydrocarbon is comingled with the ammonia media. According to some embodiments of the present disclosure, volatile hydrocarbon may be dissolved into the viscous hydrocarbon or transported in a batched configuration. Notably, even during batched transmission, the presence of ammonia-rich media is beneficial as a thermal sink whereby heat transfer to the pipeline walls mitigates boil-off of propane or other volatile hydrocarbon transported as a batched slug.

In addition to its high heat capacity, in some embodiments, the high enthalpy of vaporization of ammonia media as shown in FIG. 12(B) lowers processing costs and enhances safety. In some embodiments, the former is because portions of ammonia can be flashed off resulting in a significant evaporative cooling effect without the need for external refrigerant. The latter is demonstrated by FIG. 13(B) which presents a simulation of the venting of a storage vessel containing 50% w of crude oil and 50% w of a volatile compound which is ammonia or propane, respectively. This simulation corresponds to an initial fluid temperature of 20° C. under the self-pressure exerted by the volatile compound which is subsequently vented at 1 atm of pressure. Boil-off of volatile compound results in evaporative cooling during which process a portion of the volatile compound is released as a vapor. Here, it is demonstrated that ammonia has a stronger evaporative cooling effect than does propane, or any other hydrocarbon, such that less material is lost during the initial vapor flash. Thus, the presence of ammonia in a hydrocarbon mixture containing volatiles such as propane is advantageous in mitigating the formation of vapor that may occur in storage or during transport. With respect to maritime applications, this reduces the risk of explosion or vapor inhalation in the event of unintentional release. With respect to pipeline applications, this reduces the risk of a slack-line flow condition developing as boil-off of ammonia lowers the fluid temperature to safer operating limits more so than the boil-off of volatile hydrocarbon.

Temperature, Pressure, and Compositional Conditions

In some embodiments, the ammonia-hydrocarbon dispersions may be prepared, handled, stored, or transported under conditions that are amenable to prolonging its stable lifetime, accelerating its separation into fractions, or improving its utility as a pipeline transmission fluid or partially decarbonized fuel oil. In some embodiments, once formed, the dispersion is handled under pressures equal to or exceeding the true vapor pressure of the ammonia-hydrocarbon mixture. For example, handling ammonia-hydrocarbon dispersions at unconventionally low temperature within a pipeline or storage system. In some embodiments, with respect to pipeline transport, legacy hydrocarbon systems are vulnerable to declining oil productivity which occurs as fields age and as oil demand decreases. During winter months, heat loss from the pipeline to the environment may result in the deposition of paraffin wax on pipeline walls and the freezing of entrained water which leads to high transportation cost. Here, the presence of liquid ammonia in a hydrocarbon pipeline is useful to enhance volumetric throughput as oil flows decline and to suppress the freezing of entrained water.

As shown in TABLE III below, in some embodiments, the use of concentrated ammonia, as the polar based continuous phase, is also used as a freeze-suppressant maintaining fluidity at temperatures below about 0° C. In some embodiments, the use of concentrated ammonia as the dispersing media, allows for operating at temperatures lower than about −77.7° C. In some embodiments, methanol or water co-solvent may be incorporated into the ammonia media by any means for the purpose of depressing the freezing point of the ammonia media. Although lower melting-point (M.P.) eutectics exist for ammonia-water or ammonia-methanol mixtures, to avoid processing costs, in the compositions of the present disclosure, the ammonia concentration ranges from about 81.4% to about 100% (mol ammonia/mol total polar liquid), such as about 99.5% (mol ammonia/mol total polar liquid. In some embodiments, the minimum operating temperature at which ammonia-hydrocarbon dispersions remain flowable may be extended by use of a polar co-solvent where minimum operating temperature is depressed from about-77.7° C., to about −87.5° C. for the concentrated ammonia-methanol eutectic composition, and further for example, to about −92.5° C. for the concentrated ammonia-water eutectic composition. Further for example, in some embodiments, specifying the eutectic composition as a lower bound for ammonia/polar cosolvent ratio provides for, at low temperatures, results in a steeper increase in continuous phase viscosity.

TABLE III

Melting Point of Select Polar Liquid Dispersing Media and of their Eutectic Mixtures

| Homogeneous Composition | M.P. | Eutectic Composition | M.P. |
|---|---|---|---|
| 100% Ammonia | −77.7° C. | 86.6% Ammonia<br>13.4% Methanol | −87.5° C. |
| 100% Methanol | −97.6° C. | | |

TABLE III-continued

| Melting Point of Select Polar Liquid Dispersing Media and of their Eutectic Mixtures | | | |
|---|---|---|---|
| Homogeneous Composition | M.P. | Eutectic Composition | M.P. |
| 100% Water | 0° C. | 81.4% Ammonia<br>18.6% Water | −92.5° C. |

Further, crude oil is described by SARA analysis as a complex mixture of saturates (a.k.a., paraffins), aromatics, resins, and asphaltenes that may also comprise minor quantities of water, chemical additives, inorganic salt, and solid particles. Because crude oil specimens are compositionally variable by respective physical origin, ammonia-hydrocarbon dispersions formulation to achieve desired performance may also vary.

As provided in FIGS. 10(A) and 10(B), the phase maps describe the range of ammonia/oil ratios that can be induced to form an ammonia-hydrocarbon dispersion, e.g., a polar based continuous phase. Although a similar phase map is widely used in the formulation of water-based hydrocarbon dispersions, both the y-axis and x-axis differ for systems containing concentrated ammonia due to its temperature-dependent partial miscibility with hydrocarbon which is greatly influenced by the presence of polar cosolvent.

The x-axis is the ratio between the volume fraction of the ammonia-rich media and the total volume of the ammonia-hydrocarbon mixture. Unlike water-based systems, ammonia is partially miscible with hydrocarbon such that the ammonia-rich media contains dissolved hydrocarbon, and the hydrocarbon-rich media contains dissolved ammonia. FIG. 15 illustrates ammonia's solvent affinity for aromatic/olefinic hydrocarbons over paraffinic hydrocarbons at low temperatures produced using data from I. Kiyoharu, "Mutual Solubilities of Some Hydrocarbon Oils and Liquid Ammonia. I. Solubility Data", *Bulletin of the Chemical Society of Japan* (1958), vol. 31, no. 2, pp 143-148. Because ammonia is more soluble with hydrocarbon at temperatures greater than about 25° C. and is less soluble at progressively lower temperatures, the maximum or minimum permissible ammonia/oil ratio is both dependent on temperature and the hydrocarbon composition. Other factors influencing the maximum or minimum permissible ammonia/oil ratio include, e.g., the particle-size distribution of the dispersed hydrocarbon, the viscosity of the hydrocarbon, and the presence of additives such as solubilizers which enhance ammonia-hydrocarbon solubility.

In some embodiments, the compositions of the present disclosure (i.e., an ammonia-hydrocarbon dispersions) comprise:

a polar based continuous phase ranging from about 20% to 85% (volume/total volume), such as ranging from about 20% to about 40% (volume/total volume), of greater than about 81.4% mol ammonia, such as ranging from about 95% to about 100% mol ammonia. In some embodiments, the polar based continuous phase further comprises a polar co-solvent. In some embodiments, the polar co-solvent is chosen from water, alcohol, and combinations thereof, wherein with the % mol balance comprising a water or alcohol co-solvent.

a non-polar based discontinuous phase comprising one or more of a frozen hydrocarbon, a viscous liquid hydrocarbon, and a liquefied volatile hydrocarbon. In some embodiments, a non-polar based discontinuous phase ranging from about 15% to about 80% (volume/total volume), such as ranging from about 60% to about 80% (volume/total volume), of a liquid or solid hydrocarbon. In some embodiments, an example of a frozen hydrocarbon can be, but is not limited to, crude oil saturated with respect to ammonia which is handled at temperatures below the gel point of the ammonia saturated crude oil. In some embodiments, an example of a viscous liquid hydrocarbon can be, but is not limited to, crude oil saturated with respect to ammonia which is handled at temperatures above the gel point of the ammonia saturated crude oil. In some embodiments, an example of a liquefied volatile hydrocarbon can be, but is not limited to, a liquefied petroleum gas such as methane, ethane, propane, or butanes which is handled under temperature and pressure conditions such that the operating pressure is greater than the true vapor pressure of the liquefied petroleum gas in solution.

wherein the fuel composition has a droplet size ranging from about 100 nm to about 250 μm.

In some embodiments, the non-polar base discontinuous phase is saturated or under saturated in view of the liquid ammonia. In some embodiments, the fuel composition is thermodynamically stable. In some embodiments, the fuel composition is kinetically stable, as 90% of the fuel composition remains homogeneous for at least 10 hours.

In some embodiments, the compositions of the present disclosure (i.e., an ammonia-hydrocarbon dispersions) further comprise from about 0% to about 5% (volume/total volume), such as about ≤1% (volume/total volume), of a stabilization agent such as a surfactant but may also comprise a polymer or an inorganic particle.

In some embodiments, the compositions of the present disclosure (i.e., an ammonia-hydrocarbon dispersions) further comprise from less than about 1% (volume/total volume) of an additional component chosen from a corrosion inhibitor, oxygen scavenger, viscosity modifying agent, any other chemical additive, and combinations thereof. For example, a viscosity modifying agent can be, but is not limited to, a poly-(acrylic acid)-(acrylamide) copolymer. An example of an oxygen scavenger and corrosion inhibitor can be, but is not limited to, hydrazine. An example of chemical additive can be, but is not limited to, a fuel oxygenate such as methanol or dimethyl ether which, in some embodiments, improves the combustibility of an ammonia-hydrocarbon dispersion when used as fuel.

Empirical Correlations for Stability & Rheological Properties

For example, and by analogy to empirical correlations developed for the description of water-based hydrocarbon dispersions, theoretical predictions pertinent to the formulation of ammonia-based hydrocarbon dispersions are obtained:

In some embodiments, the stable lifetime of an ammonia-hydrocarbon dispersion depends in part on the density difference between the ammonia-rich and hydrocarbon-rich fraction as predicted by Stokes' Law of Sedimentation which pertains to a solid-liquid dispersion:

$$V_S = \frac{2}{9}\frac{(\rho_{solid} - \rho_{fluid})}{\mu_{fluid}} gR^2 \quad \text{Eqn (1)}$$

where $V_S$ is the particle settling velocity, R is the effective particle radius, g is the acceleration due to gravity, $\rho_{solid}$ is the mass density of the solid medium, $\rho_{liquid}$ is the mass density of the liquid medium, and $\mu_{fluid}$ is the dynamic viscosity of the liquid medium. Although lower $\rho_{liquid}$ and $\mu_{fluid}$ is advantageous to improving the pumpability of a dispersed hydrocarbon, it may be theoretically demonstrated by Eqn (1) that such qualities are disadvantageous with respect to stability. To address this, in some embodiments, a polymer, surfactant, inorganic clay, chemical additive, or co-solvent may be added to tune the properties of the ammonia-hydrocarbon dispersion to promote stability or to accelerate separation as desired. An example of a polymer can be, but is not limited to, any poly-(acrylic acid)-(acrylamide) copolymer such as having a molecular-weight exceeding 100 kDa, wherein the polymer increases the viscosity of the continuous phase and thus, enhances stability at the expense of pumpability. An example of an inorganic clay can be, but is not limited to, a phyllosilicate mineral such as having a mean particle-size ranging from 10 nm to 100 μm, wherein the presence of the inorganic clay enhances dispersion stability. An example of a stabilizing surfactant can be, but is not limited to, Triton X-100 (alcohol ethoxylate) or any other nonionic surfactant or polymer chosen from the fatty acid, alcohol ethoxylate, or alkylphenol ethoxylate family, wherein the presence of the surfactant enhances stability and lowers the mixing energy required to produce a dispersion. An example of a chemical additive can be, but is not limited to, an ethylene vinyl acetate compound introduced to inhibit wax formation. An example of a co-solvent can be, but is not limited to, a polar liquid such as methanol or dimethyl ether introduced as an emulsifier to improve the miscibility of paraffinic hydrocarbon compounds with the ammonia-rich fraction of an ammonia-hydrocarbon dispersion for any purpose such as inhibiting wax formation during pipeline transport. Like ammonia, but unlike water, methanol, and dimethyl ether (dehydrated methanol) can be used as carriers to transport hydrogen and are combustible as fuels.

Because stabilizing surfactants are costly, in some embodiments, the ammonia-hydrocarbon dispersions, i.e., the compositions disclosed herein, are handled at low temperatures (about <10° C.) to enhance dispersion stability even at low surfactant concentrations (about <1 to 2% of total weight). At low temperatures below about 10° C. down to the freezing point of the continuous phase (about −77.7° C. for anhydrous ammonia), there is a corresponding increase in mass density, $\rho_{liquid}$, and viscosity, $\mu_{fluid}$, values of the ammonia-rich fraction resulting in enhanced stable lifetime. Also, at lower temperature, the mobility of the viscous hydrocarbon-rich fraction is reduced which in some embodiments, such as in pipeline transport, the coalescence of droplets is suppressed leading to higher stability. For example, the droplet-size distribution of the dispersed discontinuous phase is centered at a value ranging from about 100 nm to about 250 μm, wherein smaller mean droplet-size (below about <10 μm) results in a longer stability lifetime due to Brownian motion and fluid dynamics which keeps small droplets entrained against gravitational forces that contribute to dispersion instability. Here, the term droplet refers to a suspended liquid and the term particle refers to a suspended solid. As discussed previously, crude oil may exhibit both liquid-like and solid-like behavior such that the terms "particle" or "droplet" may be used interchangeably. In some embodiments, the droplet size distribution can be measured via dynamic light scattering at low crude oil concentrations (such as about <40% volume). For example, the droplet size distribution is characterized by its polydispersity index which is the ratio between the mass-average and number-average mean droplet size. A uniform droplet size distribution refers to a low polydispersity index ranging in value from about 1.0 to about 2.0. In the present disclosure, the terms droplet and particle may be aptly used.

In some embodiments, an even smaller mean particle-size (below about <1 μm) enhances the value and utility of the dispersion as a fuel. For example, in some embodiments, an ammonia-hydrocarbon dispersion fuel composition, according to some embodiments of the present disclosure, having a small mean droplet-size (below about <1 μm, e.g., from about 100 nm to about 1 μm) provides for a more complete ammonia combustion as the ammonia-rich fraction is comingled with a more combustible hydrocarbon-rich fraction over sub-micron length scales. Additionally, fuel mixing is enhanced in the combustion chamber and a more uniform flame temperature is achieved in comparison to a dual-fuel combustion system. Further, in some embodiments, the combustion of smaller droplets (below about <1 μm) partially avoids the formation of 2.5 μm diameter particulate matter which is hazardous to human health. In addition to droplet size, the droplet size distribution is a factor influencing stability as a composition comprising a broad distribution of droplet sizes are more susceptible to Ostwald ripening which contributes to dispersion instability. In practice, in some embodiments, the production of fine droplets of about uniform size is challenging and may not be necessary to achieve the desired level of stability.

In some embodiments, the effective viscosity of an ammonia-hydrocarbon dispersion may be estimated from empirical models developed for water-based dispersions:

$$\mu_{eff} = \mu_{fluid}\left(1 - \frac{\phi}{\phi_{max}}\right)^{-\beta_N} \quad \text{Eqn (2)}$$

where $\mu_{eff}$ is the effective dynamic viscosity of the ammonia-hydrocarbon dispersion, $\mu_{fluid}$ is the effective dynamic viscosity of the ammonia-hydrocarbon continuous phase, $\beta_N$ is equal to 2 for spherical or elongated particles, ø is the concentration of dispersed hydrocarbon, and $\phi_{max}$ is the maximum flowable concentration of dispersed hydrocarbon. In certain embodiments, such as in the transport of heavy oil or blends thereof, the viscosity of the hydrocarbon may range from about 50 cP to about 50,000 cP. Here, in some embodiments, transporting the hydrocarbon in the form of an ammonia-hydrocarbon dispersion is that the effective viscosity of the dispersion, Jeff, is more comparable to the ammonia-rich carrier fluid, $\mu_{fluid}$ (25° C.)=0.17 cP, rather than the suspended viscous hydrocarbon. In some embodiments, in practice, the ammonia-rich phase will contain hydrocarbon and the hydrocarbon-rich phase will contain ammonia which influences the viscosity of each phase, respectively.

In some embodiments, by Eqn (2), of the presently disclosed compositions, i.e., ammonia-hydrocarbon dispersion, long-distance pipeline transport allows for the ammonia to be added or withdrawn from the flowing mixture without significantly affecting pumpability. In U.S. Pat. No. 3,480,024 pertaining to the pipeline transport of ammonia-hydrocarbon mixtures, the ammonia diluent is present at high temperatures and low concentrations at which it is fully soluble with the hydrocarbon. According to some embodiments of the present disclosure, the pipeline may be leveraged to recover resources distributed along the route of the pipeline system. When ammonia is used as a diluent, the removal of small quantities of ammonia would result in a loss of fluidity of the viscous hydrocarbon fraction. By comparison, ammonia-hydrocarbon dispersions remain pumpable as long as the removal of ammonia does not result in the crossing of the stability boundaries for a "O/W-type" dispersion established experimentally and presented as demonstrated by FIGS. 10(A) and 10(B). FIGS. 10(A) and 10(B) illustrate composition-structure-property relationships relevant to the handling of an ammonia-hydrocarbon dispersion which may be understood by use of an accompanying phase diagram. In FIG. 10(B), the y-axis of the phase diagram is analogous to the Hydrophilic-Lipophilic Difference (HLD) relevant to water-based systems and the x-axis corresponds to the relative volume fraction of the continuous and discontinuous media or "effective composition". In practice, both the y-axis and x-axis depart from understandings of water-based systems.

Furthermore, in some embodiments, there is no physical restriction to the amount of ammonia that can be incorporated into an ammonia-hydrocarbon dispersion.

In some embodiments, to preserve stability, chiller stations may be incorporated along the route of the pipeline to maintain low temperature operating conditions. Even at low temperatures, an ammonia-hydrocarbon dispersion is prone to sedimentation during pipeline transport as the entrained droplets may settle in response to frictional losses. Here, in some embodiments, using a larger diameter pipeline allows for a longer stable lifetime, as the ratio between the cross-sectional area and the pipeline circumference is reduced. In some embodiments, such as in long-distance pipeline transport, a large diameter pipeline (>about 8 inches) is used in shuttling the ammonia-hydrocarbon dispersion for the purpose of reducing the need for costly stabilizing agents.

Additional Components

In some embodiments, the stability of an ammonia-hydrocarbon dispersion is influenced by the relative density and viscosity of the ammonia-rich and hydrocarbon-rich fractions. Ammonia is lighter than crude oil such that upon separation the ammonia-rich fraction is situated above the hydrocarbon-rich fraction, water is heavier than crude oil such that upon separation the hydrocarbon-rich fraction is situated above the water-rich fraction. Liquefied petroleum gas (i.e., propane) may be incorporated into an ammonia-hydrocarbon dispersion by dissolution into a viscous hydrocarbon or, otherwise, may be transported via a batched configuration. While product delivery specifications may influence this decision, in some embodiments, the solubilizing liquefied petroleum gas is provided into the viscous hydrocarbon as a diluent. For example, the use of a hydrocarbon or non-hydrocarbon may assist in lowering the cost and environmental impacts associated with processing a viscous hydrocarbon.

In some embodiments of the methods and processes disclosed herein, the material transfer process comprises a mechanism for improving the stability of an ammonia-hydrocarbon dispersion during transport or storage by, e.g., "density matching" the ammonia-rich and hydrocarbon-rich fraction. For example, the density of the ammonia-rich fraction may be increased by (i) handling at low-temperature conditions ranging between −90° C. to 25° C.; (ii) handling at elevated pressure conditions several times greater than the true vapor pressure of the dispersion; or (iii) introducing a chemical additive such as but not limited to a co-solvent. In some embodiments, option (i) provides for improving compatibility of an ammonia-hydrocarbon dispersion with a legacy hydrocarbon system. In some embodiments, option (ii) uses a pressure-vessel, however, there may be some legacy hydrocarbon systems amenable to transport or storage at elevated pressure. In some embodiments, option (iii) uses costly chemical additives, may increase the cost of downstream separations, or may impact the value of the delivered ammonia molecule.

In some embodiments, the fuel composition further comprises a chemical additive that is a polymer. An example of a polymer includes, but is not limited to, a high molecular weight poly(acrylic acid-acrylamide) copolymer which, in some embodiments, is included to increase $\mu_{liq}$ by functioning as a viscosity enhancer. While an aspect of the present disclosure is directed to the minimization of the ammonia-hydrocarbon dispersion viscosity for improving pipeline transport or enhancing oil throughput; if the carrier fluid viscous is too low, there may be greater benefit in prioritizing stability over viscosity to avoid dispersion settling or viscous overrun. In some embodiments, the polymer may include functionalities that serve a purpose as a drag reducer, dispersant, slug-flow interfacial barrier, or flocculant. There are ways in which the use of poly(acrylic acid-acrylamide) copolymer can be used to achieve similar function. Those skilled in the art are aware of those ways to decorate such polymers to modulate function, and that the ammonia-hydrocarbon dispersion of this disclosure is distinguished from water-based dispersions. In some embodiments, ammonia is an alkaline substance with effect on the behavior of polymers as provided in, Kimura, Y.; Takahiro, S.; "Remarkable Expansion of the Poly(acrylic acid) Chain by Acid-Base Complexation with Lower Molecular Weight Amines". *Polymer Journal*, (2006), Vol. 38, No. 2, pp. 190-196. In practice, various cosolvents, surfactants, polymers, or inorganic substances may be added, altered, or removed to effect a change in the chemical, physical, or rheological properties of the ammonia-hydrocarbon dispersion without departing from the presently disclosed subject matter. As an example, in some embodiments, an additive may be incorporated to enhance stability as a viscosity modifier or a viscosity modifying agent. In other embodiments, an additive may be incorporated to enhance miscibility as an emulsifier, accelerate separation as a de-emulsifier, inhibit particle agglomeration as a dispersant, or introduced for the purpose of reducing frictional drag.

In some embodiments, the present fuel composition further comprises a surfactant. For example, a surfactant comprises one or more nonionic surfactants, anionic surfactants, and combinations thereof. An example of a stabilizing surfactant includes commercially available non-ionic alcohol ethoxylate surfactants such as Triton-X100 or high molecular weight Brij-35. In some embodiments, the use of ethoxylate surfactants as these compounds favor non-polar media (i.e., hydrocarbon) at temperatures greater than about 50° C. and polar media (i.e., ammonia) at temperatures below about 25° C. Further, in some embodiments, anionic or cationic surfactants may be used for any purpose such as to improve surfactant recovery from downstream products streams. The optimization of a surfactant system involves a multivariate series of experiments that, e.g., varies according to hydrocarbon composition, i.e., for the ammonia-based hydrocarbon dispersions of the present disclosure. Through pedagogical review of the selection processes used to formulate surfactants for use in water-based dispersions, the present disclosure highlights features of the selection process which are applicable to ammonia-rich systems.

In some embodiments, the surfactants may be selected on the basis of their interfacial chemistry as represented by a quantitative metric such as a hydrophilic-lipophilic difference (HLD) ratio, economic factors, or by consideration of their size whereby larger surfactant molecules may advantageously function as a dispersant. It should be noted that the HLD ratio is a physically robust concept employed in the formulation of water-based systems, but that ammonia has vastly different chemical interactions with hydrocarbon and other compounds than does water. In some embodiments, ammonia promotes the formation of a hydrocarbon dispersion. For example, ammonia is alkaline and reacts with petroleum acids to form surfactant in-situ. Additionally, as shown in TABLE II, the dielectric constant of liquid ammonia is more comparable to the dielectric constant of liquid hydrocarbon such that, in some embodiments, reduced quantities of surfactant are needed to stabilize interfacial chemistry. If warranted for stability, the use of non-ionic surfactants provides for phase inversion, as provided in the methods and process of the present disclosure. Notwithstanding, any combination of ionic or non-ionic surfactants may be used to alter the chemical, physical, or rheological properties of the ammonia-hydrocarbon dispersion without limitation cognizant of the fact that many water-soluble ionic surfactants are insoluble in ammonia-rich media.

In some embodiments, the present fuel composition comprises a nonionic surfactant chosen from amides, diamides, polyglycol esters, alkyl polyglycosides, sorbitan esters, methyl glucoside esters, fluorocarbon polymers, alkylphenol ethoxylates, alcohol ethoxylates, and combinations thereof.

In some embodiments, the present fuel composition comprises an anionic surfactant chosen from stearates, gluconates, glutamates, sarcosinates, lactylates, fatty acid carboxylates, naphthenates, lignosulfonates, organic sulfonates, organic sulfates, organic sulfites, organic phosphates, and organic sulfosuccinates preferably containing an alkali metal, alkaline earth metal, transition metal, an ammonium cation, and combinations thereof.

In some embodiments, the fuel composition further comprises various additive species, i.e., additional components, for example:

- Incorporating an interfacial stabilization agent such as a polymer, surfactant, inorganic clay, chemical additive, or co-solvent to improve the stability, workability, or value of an ammonia-hydrocarbon dispersion.
- Incorporating a viscosity modifying agent such as a polymer, surfactant, inorganic clay, chemical additive, or co-solvent to improve the stability, workability, or value of an ammonia-hydrocarbon dispersion.
- Incorporating a density modifying agent such as a polymer, surfactant, inorganic clay, chemical additive, or co-solvent to improve the stability, workability, or value of an ammonia-hydrocarbon dispersion.
- Incorporating a hydrogen-bonding network modifying agent such as a polymer, surfactant, inorganic clay, chemical additive, or co-solvent to improve the stability, workability, or value of an ammonia-hydrocarbon dispersion.
- Incorporating a polarity modifying agent such as a polymer, surfactant, inorganic clay, chemical additive or co-solvent to improve the stability, workability, or value of an ammonia-hydrocarbon dispersion.
- Using any additive for the purpose of inhibiting corrosion such as but not limited to removing free oxygen, passivating reactive sulfur, or altering the electrochemical properties of the fluid-steel interface.
- Using any additive for the purpose of increasing the value of the ammonia-hydrocarbon dispersion such as but not limited to the incorporation of combustion additives for improving fuel quality.

In some embodiments, the fuel composition further comprises a polar co-solvent. In some embodiments, the polar co-solvent is chosen from water, alcohol, and combinations thereof. In some embodiments, the polar based continuous phase further comprises from about 0.1% to about 19.0% by v/v of total polar phase of a polar co-solvent and a surfactant, wherein the surfactant comprises a nonionic surfactant chosen from amides, diamides, polyglycol esters, alkyl polyglycosides, sorbitan esters, methyl glucoside esters, fluorocarbon polymers, alkylphenol ethoxylates, alcohol ethoxylates, and combinations thereof; and/or an anionic surfactant chosen from stearates, gluconates, glutamates, sarcosinates, lactylates, fatty acid carboxylates, naphthenates, lignosulfonates, organic sulfonates, organic sulfates, organic sulfites, organic phosphates, and organic sulfosuccinates preferably containing an alkali metal, alkaline earth metal, transition metal, an ammonium cation, and combinations thereof.

In some embodiments, the presently disclosed fuel composition further comprises an inorganic salt. Examples of ammonia soluble inorganic salts include, but are not limited to, the following: ammonium nitrite, ammonium nitrate, ammonium chloride, ammonium bromide, ammonium iodide, ammonium hypochlorite, ammonium thiocyanate, sodium nitrate, potassium nitrate, cesium nitrate, sodium iodide, potassium iodide, and cesium iodide.

In some embodiments, the non-polar based discontinuous phase further comprises a non-polar co-solvent. In some embodiments, the non-polar co-solvent is chosen from propane, other liquefied hydrocarbon gases, and combinations thereof.

Preparing a Fuel Composition (Ammonia-Hydrocarbon Dispersion)

Dispersions are commonly described as either kinetically or thermodynamically stable. Thermodynamically stable dispersions can be formed spontaneously (e.g., in the absence of stirring) and persist indefinitely. Thermodynamically stable dispersions typically need high surfactant concentrations (e.g., up to 20% of total weight) to produce a fine dispersion (e.g., particle size centered around 100 nm to 10 μm as defined in the present disclosure). In some embodiments, the presently disclosed fuel composition is thermodynamically stable.

As further example, thermodynamically stable dispersions are referred to as "microemulsions" and comprise a low polydispersity dispersion comprising thermodynamically stable droplet sizes (hydraulic diameter) that are typically about 2 nm to 300 nm depending on surfactant composition.

Kinetically stable dispersions can be formed via high-energy or low-energy mixing processes but inevitably will separate over time, e.g., in view of the presently disclosed subject matter into an ammonia-rich and hydrocarbon-rich fraction. The terminology low-energy or high-energy mixing processes refers to whether or not, respectively, the emulsification process is carried out under conditions corresponding to HLD~0. Low-energy mixing processes, such as phase inversion, are mediated under conditions corresponding to HLD~0 and can be facilitated using simple process equipment such as a stirred tank, reflux column, or in-line mixer operated under modest pressures (less than about 10 bar). High-energy mixing processes, such as high-pressure homogenization, are mediated under conditions corresponding to HLD #0 and require more costly process equipment (e.g., a compressor) in addition to harsher processing conditions. The more that HLD values deviate in magnitude from zero (positive or negative), a greater mixing energy input is required to produce a kinetically stable ammonia-hydrocarbon dispersion. In some embodiments, kinetically stable dispersion compositions are technically and economically favorable to thermodynamically stable dispersions, as they may be prepared at low surfactant concentrations (about <1 to 2% of total weight) and that, in some embodiments, they can be an induced by a physical stimulus (e.g., increasing temperature up to about >30° C.) in conjunction with using a process unit, such as a hydrocyclone or settling tank, to accelerate the separation of the dispersion composition into an ammonia-rich and hydrocarbon-rich fraction. Although the fuel composition of the present disclosure corresponds to a kinetically stable dispersion, a thermodynamically stable dispersion fuel composition may also be used without limitation.

As further example, kinetically stable dispersions are typically referred to as either "nanoemulsions" or "macroemulsions" and comprise a low, moderate, or high polydispersity dispersion comprising thermodynamically unstable droplet sizes (hydraulic diameter) that typically range from about <100 nm to 2 μm or 2 μm to 250 μm, respectively, depending on surfactant composition and processing conditions.

In some embodiments, the composition-property relationships of the ammonia-hydrocarbon dispersion are exploited via the disclosed process herein to produce a kinetically stable fuel composition (ammonia-hydrocarbon dispersion) having sufficient stability for pipeline transport even at low <1 to 2% surfactant concentration. Depending on manufacturing and handling conditions, kinetically stable dispersions can persist for hours to years before inevitably separating into ammonia-rich and hydrocarbon-rich fractions. In some embodiments, the fuel compositions are kinetically stable, as about 90% of the fuel composition remains homogeneous for at least about 10 hours. Further, the present disclosure is directed to spontaneously mixing method for preparing an ammonia-hydrocarbon dispersion or a fuel composition, which comprises:

- combining a hydrocarbon, a surfactant, and a co-solvent to form a hydrocarbon-rich "precursor mixture", or in an alternative embodiment combining a liquid ammonia, a surfactant, and a cosolvent to form an ammonia-rich "precursor mixture"; and
- subsequently combining the hydrocarbon-rich "precursor mixture" with a liquid ammonia "makeup stream" that is under-saturated with respect to at least one surfactant or cosolvent comprised within the former, or in an alternative embodiment combining the ammonia-rich "precursor mixture" with hydrocarbon "makeup stream" that is under-saturated with respect to at least one surfactant or cosolvent comprised within the former, to produce an ammonia-hydrocarbon dispersion under conditions corresponding to HLD>0, HLD~0, or HLD<0.

Further, the present disclosure is directed to the presently disclosed phase inversion emulsification method for preparing an ammonia-hydrocarbon dispersion or a fuel composition of the present disclosure comprising:

- combining ammonia, hydrocarbon, and a stabilization agent under temperature, pressure, and/or composition conditions corresponding to HLD>0 (positive) for producing an ammonia-hydrocarbon dispersion (W/O type-inverted fuel composition);
- using temperature, pressure, and/or composition conditions to further modify the ammonia-hydrocarbon dispersion corresponding to HLD~0; and
- transporting or storing the ammonia-hydrocarbon dispersion (O/W type) produced at HLD~0 under temperature and/or pressure conditions corresponding to HLD<0 (negative), wherein the ammonia-hydrocarbon dispersion lifetime is enhanced.

In some embodiments, the ammonia-hydrocarbon dispersion is kinetically stable. These kinetically stable dispersion compositions are distinguished from thermodynamically stable dispersion compositions which persist indefinitely but are economically disadvantaged in that they typically require high surfactant concentrations (up to 20% of total weight) to produce a fine dispersion. Although the disclosed spontaneous mixing and phase inversion methods of producing an ammonia-hydrocarbon dispersion are used herein, any method may be employed producing the presently disclosed compositions. In some embodiments, the method of producing a dispersion is spontaneous mixing, which exploits an irreversible mixing phenomenon involving surfactant or cosolvent migration between a "precursor mixture" and "makeup stream". In some embodiments, the method of producing a dispersion is phase inversion, which entails the modification of temperature, pressure, and/or compositional conditions in a manner that promotes the formation of a kinetically stable dispersion. Low-energy processes, such as phase inversion, exploit physicochemical properties of the ammonia-hydrocarbon dispersion composition in a manner that minimizes processing costs but requires the presence of a stabilization agent. Further for example, high-energy processes such as high-pressure homogenization may incur greater processing costs but may reduce the need for costly chemical additives to stabilize the dispersion.

In some embodiments, a phase inversion process typically involves a pressure, temperature, and/or compositional change to facilitate the production of a hydrocarbon dispersion by low-energy mixing processes. Inversion of the composition results in the transformation of an ammonia continuous-hydrocarbon discontinuous dispersion ("O/W Type", see FIG. 10(A)), the composition for pipeline transport and/or a fuel product, into a hydrocarbon continuous-ammonia discontinuous dispersion ("W/O Type", see FIG. 10(A)), the fuel composition for fuel products. For example, the fuel composition may be transported through a pipeline system or flow conduit, discharged into a storage vessel, and subjected to a physical stimulus to obtain the inverted fuel composition, e.g., a hydrocarbon continuous-ammonia discontinuous ("W/O" type, as shown in FIG. 10 (*a*)) which in some embodiments is diesel engine combustion. In comparison to the fuel composition (e.g., an ammonia continuous-hydrocarbon discontinuous or "O/W Type" (FIG. 10(A)), the inverted fuel composition or fuel product has reduced corrosivity as the ammonia-rich fraction does not contact walls, a greater storage modulus which enhances stable lifetime, improved combustibility due to enhanced fuel atomization, and fewer hazardous emissions (NOx, particulate matter, etc.) arising from incomplete combustion processes. In some embodiments, a method for preparing a fuel product comprises: inverting a fuel composition with a physical stimulus, wherein the composition comprises: a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm, and wherein the physical stimuli is chosen from a change in temperature, a change in pressure conditions, a change in composition, and combinations thereof.

For example, a compositional change is directed to the introduction or withdrawal of either ammonia, hydrocarbon, or cosolvent. That is, with the addition of hydrocarbon or ammonia results in the inversion of "O/W" type to "W/O" type or vice versa. In some embodiments, an example of a frozen hydrocarbon can be, but is not limited to, crude oil saturated with respect to ammonia which is handled at temperatures below the gel point of the ammonia saturated crude oil. In some embodiments, an example of a viscous liquid hydrocarbon can be, but is not limited to, crude oil saturated with respect to ammonia which is handled at temperatures above the gel point of the ammonia saturated crude oil. In some embodiments, an example of a liquefied volatile hydrocarbon can be, but is not limited to, a liquefied petroleum gas such as methane, ethane, propane, or butanes which is handled under temperature and pressure conditions such that the operating pressure is greater than the true vapor pressure of the liquefied petroleum gas in solution.

In some embodiments, for example, polyoxyethylene surfactants (alcohol ethoxylate, alkylphenol ethoxylate, etc.) exhibit a greater affinity for lipophilic compounds (i.e., hydrocarbon) at temperatures greater than about 25° C. to 50° C. and a greater affinity for hydrophilic compounds (i.e., ammonia) at temperatures below about 25° C. In some embodiments, the use of ammonia-rich media in phase inversion provides a direct viscosity reduction associated with its partial miscibility and in exploiting its temperature-dependent solubility with hydrocarbon. As a chemical solvent, ammonia likes aromatic/olefinic hydrocarbons over paraffinic hydrocarbons as shown in FIG. 15.

For example, in some embodiments, an example of a stabilizing agent is Triton X-100 (HLB=13.4), but not limited to, a commercially available nonionic alcohol ethoxylate surfactant manufactured by Dow Chemical. The general structure of nonionic alcohol ethoxylates within the Triton sub-category is depicted below:

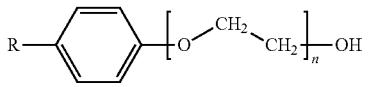

Where "R" comprises a linear or branched fully saturated carbon chain ranging from 8 to 18 carbon atoms. Where the length of the ethoxylate chain "n" varies from 3 to 12 ethylene oxide units. The selection of this surfactant sub-category in subsequent examples to follow was in part based on its widespread availability in research laboratories but further informed by ammonia-hydrocarbon mutual solubility data from the referenced research article I. Kiyoharu, "Mutual Solubilities of Some Hydrocarbon Oils and Liquid Ammonia. I. Solubility Data", Bulletin of the Chemical Society of Japan (1958), vol. 31, no. 2, pp 143-148. The hydrophilic-lyophilic balance (HLB) is a parameter reported for most commercially available surfactants. HLB values ranging from 8-16 are typically useful to formulate a water continuous hydrocarbon emulsion.

There is no literature on the useful HLB range to formulate a liquid ammonia continuous hydrocarbon emulsion. It is known, however, that liquid ammonia has a strong affinity for polar solvents including water, alcohol, and ether whereby the polyethoxylated chain constitutes an ether appendage. Further, it is observed from the above reference research article that, at temperatures between minus 30° C. to 0° C., a liquid ammonia has a strong affinity for aromatics and a weak affinity for paraffins. While not wishing to be bound to a particular theory, a temperature-dependent mechanism for using the above exemplified nonionic alcohol ethoxylate as a stabilization agent in ammonia-hydrocarbon dispersions is included to provide guidance on surfactant selection criteria in relation to ammonia-hydrocarbon dispersion stability. It is herein believed that at lower temperatures "R", the fully saturated carbon chain appendage, promotes affinity for the hydrocarbon discontinuous phase; the aromatic ring moiety promotes affinity for both the liquid ammonia continuous and hydrocarbon discontinuous phase thus functioning as an amphiphile; and the polyethoxylated chain moiety promotes affinity for the liquid ammonia continuous phase. A surfactant promotes stability when, in part, it has a strong association with the discontinuous phase and, in part, it has a strong affinity with the continuous phase. As such, fuel compositions comprising, e.g., the exemplified nonionic alcohol ethoxylate surfactant will become increasingly stable cooling from 0° C. to minus 30° C., which is useful since liquid ammonia is transported in refrigerated vessel at minus 33.4° C. In some embodiments, this improves the utility of the fuel composition allowing it to be transported long-distances in a marine vessel as a fuel or delivered to a refinery as a feedstock without disassociating under refrigerated storage conditions. With minor heating, a stable fuel composition can be delivered via a fuel nozzle into a combustion chamber or discharged via a hose into a storage tank prior to processing at a refinery.

Systems

In some embodiments, the present disclosure is directed to a fuel dispensing system for the transport, storage, or delivery of the fuel composition or the ammonia-hydrocarbon dispersions. For example, the present disclosure provides for a system for facilitating a material transfer process involving an ammonia-hydrocarbon dispersion under controlled temperature or pressure conditions. In some embodiments, the disclosed system provides a physical apparatus for effecting the material transfer process via manipulation of the chemical, physical, or rheological properties of the ammonia-hydrocarbon dispersion as part of a transportation or storage function. Those skilled in the art recognize that while non-inventive process equipment may be engaged in this transportation system, the method of using this equipment in shuttling an ammonia-hydrocarbon dispersion is provided. In some embodiments, the system is constructed via modification of a legacy hydrocarbon processing system. Notably, hydrocarbon processing systems differ according to local geographic and resource considerations and, likewise, the ammonia-hydrocarbon processing system of the present disclosure may be expected to vary accordingly to these and other economic, regulatory, or environmental factors. Instead of prescribing a configuration, specific reference is made to the functionality and general utility of system components as they pertain to the handling of an ammonia-hydrocarbon dispersion as provided in the presently disclosed subject matter.

In some embodiments, the present disclosure is directed to a fuel dispensing system for transporting, storing, and/or delivering a fuel composition comprising at least a pipeline or flow conduit, for example, constructed of a low-temperature steel alloy capable of operating from about −85° C. to about 35° C., but further for example, from about −40° C. to about 5° C., and having as large a pipe diameter as is practical, wherein the fuel composition comprises: a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm. In some embodiments, the fuel dispending system further comprises one or more of the following:

(a) a storage vessel or reservoir, wherein the storage vessel or reservoir comprises ammonia from a production facility for storage at or near a dispersion manufacturing production site with or without hydrocarbon in any physical form that is subsequently processed into a feedstock and transported to a dispersion manufacturing production facility;

(b) a dispersion manufacturing production facility where ammonia, hydrocarbon, and additives are combined by any physical means within a stirred tank, reflux column, or inline mixer, and processed into an ammonia-hydrocarbon dispersion, for example, mediated via a low-cost emulsification process that reduces the need for costly stabilizing surfactants and eliminates the need for high-cost process equipment;

(c) an offtake facility where ammonia, hydrocarbon, or fractions thereof may be removed from an ammonia-hydrocarbon dispersion and unused material may be returned as or processed into an ammonia-hydrocarbon dispersion for pipeline transport;

(d) an ontake facility where ammonia, hydrocarbon, or fractions thereof may be incorporated into an ammonia-hydrocarbon dispersion by any physical means, such as via a mixing process involving the introduction of ammonia, hydrocarbon, or factions thereof having a composition that is miscible with the continuous phase of the dispersion such that mixing energies and mass transfer resistances associated with the mixing process are reduced;

(e) a product dispensing facility where an ammonia-hydrocarbon dispersion is withdrawn from a pipeline, an offtake facility, or an ontake facility and is processed by any physical means into one or more of products comprised of ammonia, hydrocarbon, or fractions thereof into a fuel product that may or may not be packaged or marketed in association with a value-enhancing document;

(f) a data processing facility which receives data via an integrated network of sensors and computer hardware, processes that data via software tools or algorithms, and communicates information pertinent to the generation of a value-enhancing document or system operations by any physical means; and/or (g) a document generating device which receives information and generates a value-enhancing document or financial product that is used in facilitating a material transfer process involving the sale of a decarbonized or partially decarbonized commodity.

In some embodiment, the present disclosure is directed to a fuel dispending system for transporting, storing, and/or delivering a fuel composition comprising at least a pipeline or flow conduit and any two, three, four, five, six, or seven of the above disclosed elements (a)-(g) in any combination thereof. In some embodiments, the fuel dispending system comprises at least a pipeline or flow conduit and elements (a)-(g).

For example, ambient temperature conditions vary geographically and may influence the selection of separation equipment used in the processing of ammonia-hydrocarbon dispersions. That is, equatorial climates have higher and more seasonally uniform temperatures which allow for certain separation methods, such as ammonia distillation, in comparison to Arctic climates. Conversely, in some embodiments, as provided in the present disclosure, Arctic climates reduce the need for refrigeration equipment and increases the likelihood that a legacy hydrocarbon processing system was constructed using a low-temperature steel alloy. In some embodiments, the selection of process equipment used in operating the pipeline system may be influenced by geographic or resource considerations such as the frost-susceptibility of the soil or the composition of hydrocarbon being transported, respectively.

In some embodiments, the system may further extract ammonia or hydrocarbon from the ammonia-hydrocarbon dispersion at a product offtake port or refinery. In this case, additional system components to facilitate product fractionation are part of the disclosed system. Part of the material transfer process of the present disclosure is that the ammonia-hydrocarbon dispersion may be separated into a broad spectrum of potentially useful ammonia-rich or hydrocarbon-rich product fractions by application of gravity-based separation techniques (e.g., hydrocyclone, separator tanks, etc.) in conjunction with pressure, temperature, or compositional modification; the presently disclosed system can include additional components as part of the system. If unused hydrocarbon material is returned to the pipeline system, then another dispersion manufacturing facility may be required to redisperse hydrocarbon prior to its reintroduction into the pipeline system to avoid potential flow blockages. If desired, the ammonia and hydrocarbon can be completely separated at the terminus and sold independently to carbon-free and conventional fossil markets, respectively.

Methods

Figure 1:
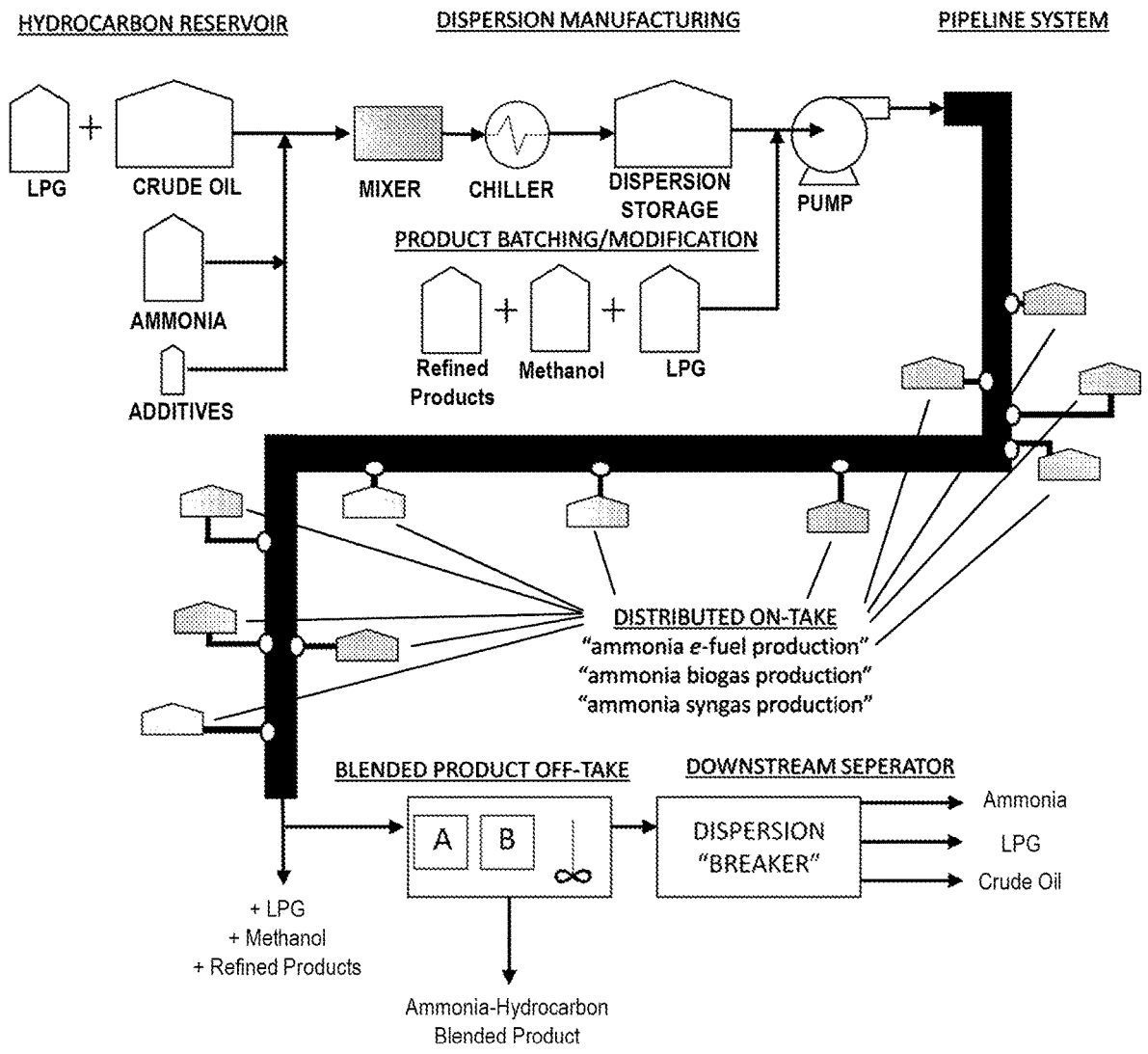
FIG. 1 illustrates methods, according to the present disclosure, for preparing, transporting, storing, and distributing (i.e., a material transfer process) of ammonia-hydrocarbon dispersions through a pipeline system.

The present disclosure is further directed to methods for transporting a fuel composition comprising: preparing a fuel composition comprising a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm; and transferring the fuel composition to a pipeline system to transport the composition to a location of use or a production or storage location. As provided in FIG. 1, it illustrates methods, according to the present disclosure, for preparing, transporting, storing, and distributing (i.e., a material transfer process) of ammonia-hydrocarbon dispersions through a pipeline system. For example, portions of ammonia can be introduced to or withdrawn from the inventive ammonia-hydrocarbon dispersion without comprising pumpability, as provided below. Because pipeline systems span vast geographic areas, small-volume ammonia production facilities can be installed along the pipeline route to harness distributed resources, which is further discussed below. At the pipeline terminus ammonia, viscous hydrocarbon, or volatile hydrocarbon can be separated into fractions or sold as a blended mixture.

In some embodiments, the pipeline system is chosen from a crude oil sales pipeline system, a crude oil production pipeline system, a legacy hydrocarbon system, and combinations thereof. One illustrative example pertains to the transport of ammonia-oil dispersions through a crude oil sales pipeline system which, notably, has substantially different technical, economic, or regulatory specifications than does a crude oil production pipeline system. Here, the term crude oil may be interpreted as being interchangeable with bitumen, heavy oil, tar, residual oil, distillate oil, or any other hydrocarbon product without departure from the spirit of the invention. When crude oil is produced at the wellhead, it may be referred to as 'live oil' if it contains volatile hydrocarbon and dissolved gases. Prior to transport through a sales pipeline, it is common practice that the volatile components are removed to obtain a de-volatized 'dead oil' having improved compatibility with respect to the hydrocarbon system. In some embodiments, hydrocarbon and ammonia, a volatile substance, are transported together in the form of a dispersion, as discussed above regarding the composition.

Figure 2:
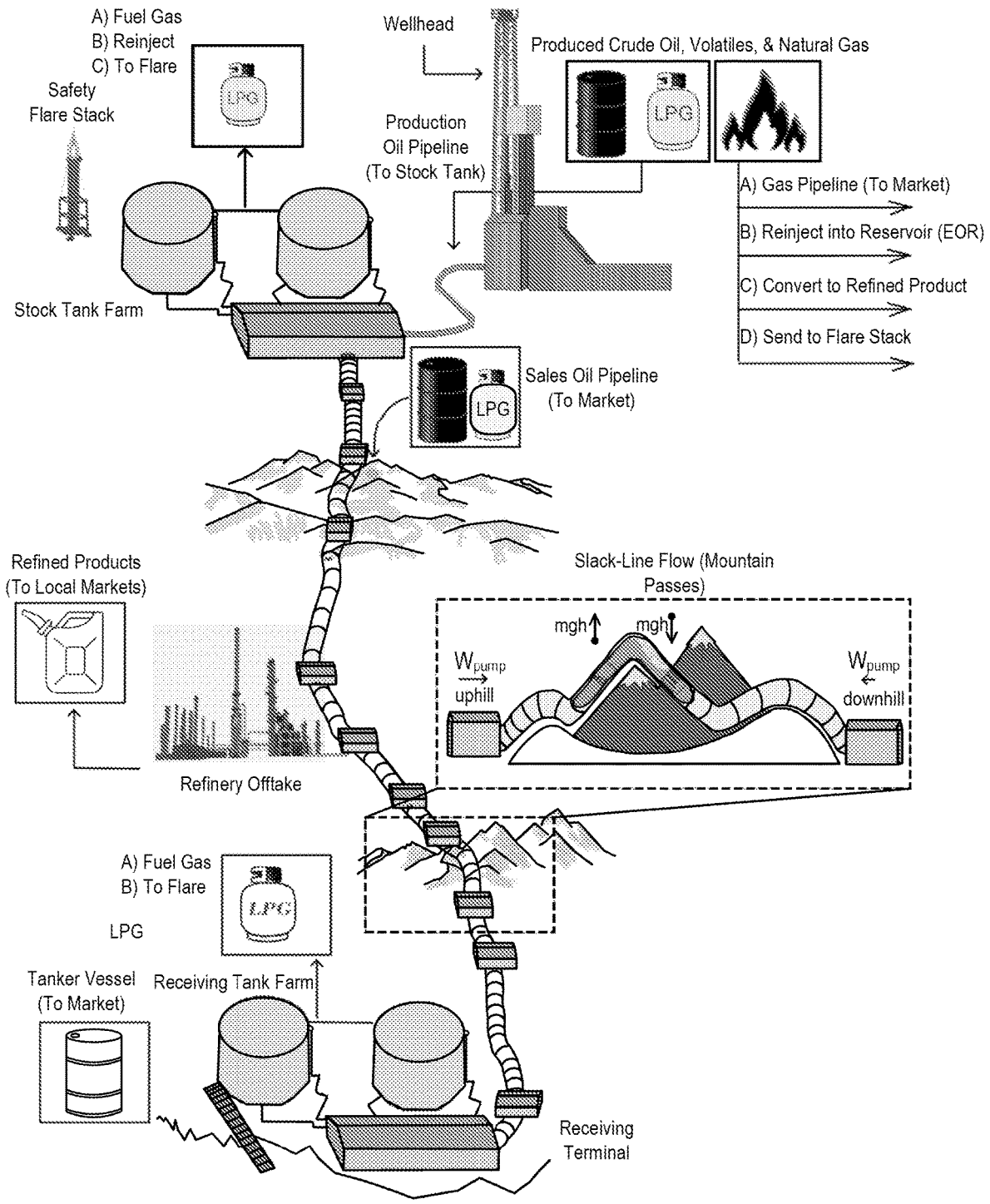
FIG. 2 illustrates an embodiment of a legacy hydrocarbon processing system.

As provided in FIG. 2, it illustrates an embodiment of a legacy hydrocarbon processing system. At the wellhead crude oil, liquified petroleum gas, and natural gas are produced together but crude oil is commonly separated and dispatched separately through a crude oil sales pipeline. Several pump stations are used to convey the viscous crude oil over distance. Along the pipeline route, material may be withdrawn and processed for sale into local markets. Over mountain passes, dissolved volatile hydrocarbon may vaporize resulting in a slack-line flow condition that is detrimental to the operation of the pipeline system. At the pipeline terminus or offtake nodes, volatile hydrocarbon may be removed from crude oil and used to power pipeline facilities.

Figure 3:
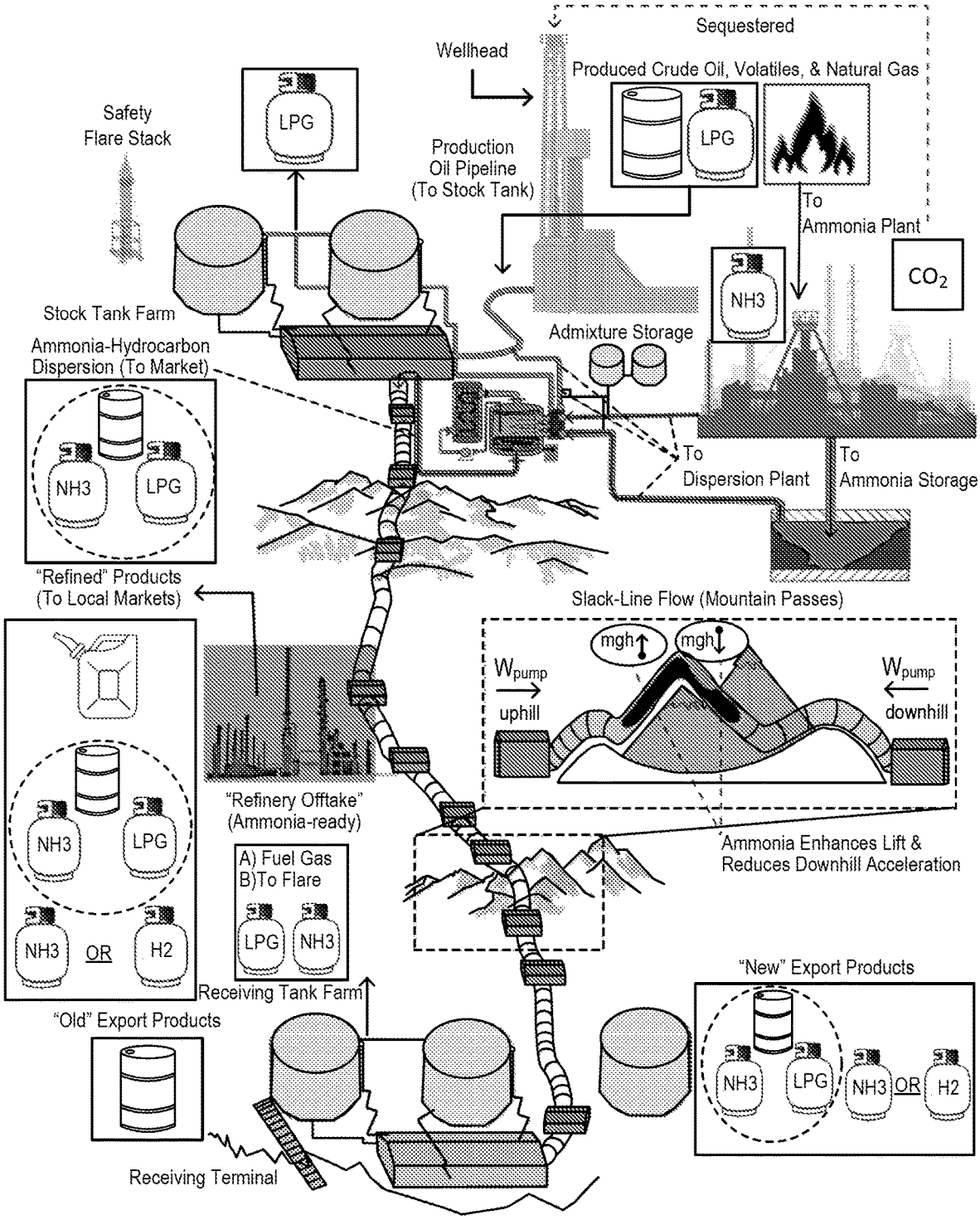
FIG. 3 illustrates a modified hydrocarbon processing system configured for transporting ammonia-hydrocarbon dispersions according to the present disclosure.

FIG. 3 illustrates a modified hydrocarbon processing system configured for transporting ammonia-hydrocarbon dispersions according to the present disclosure. Compared to the legacy system provides in FIG. 2, natural gas is transformed to ammonia and associated carbon dioxide emissions may be sequestered into a subterranean reservoir. In some embodiments, ammonia may also be stored in a subterranean reservoir thus reducing the need for surface storage tank farms. The ammonia is blended with hydrocarbon at a dispersion manufacturing plant prior to dispatch through the pipeline system. The properties of the ammonia-hydrocarbon dispersion provide for separation at offtake ports and a broad range of products may be recovered. In some embodiments, the presence of ammonia improves pumpability of hydrocarbon and mitigates the risk of a slack-line flow condition over mountain passes.

Figure 4:
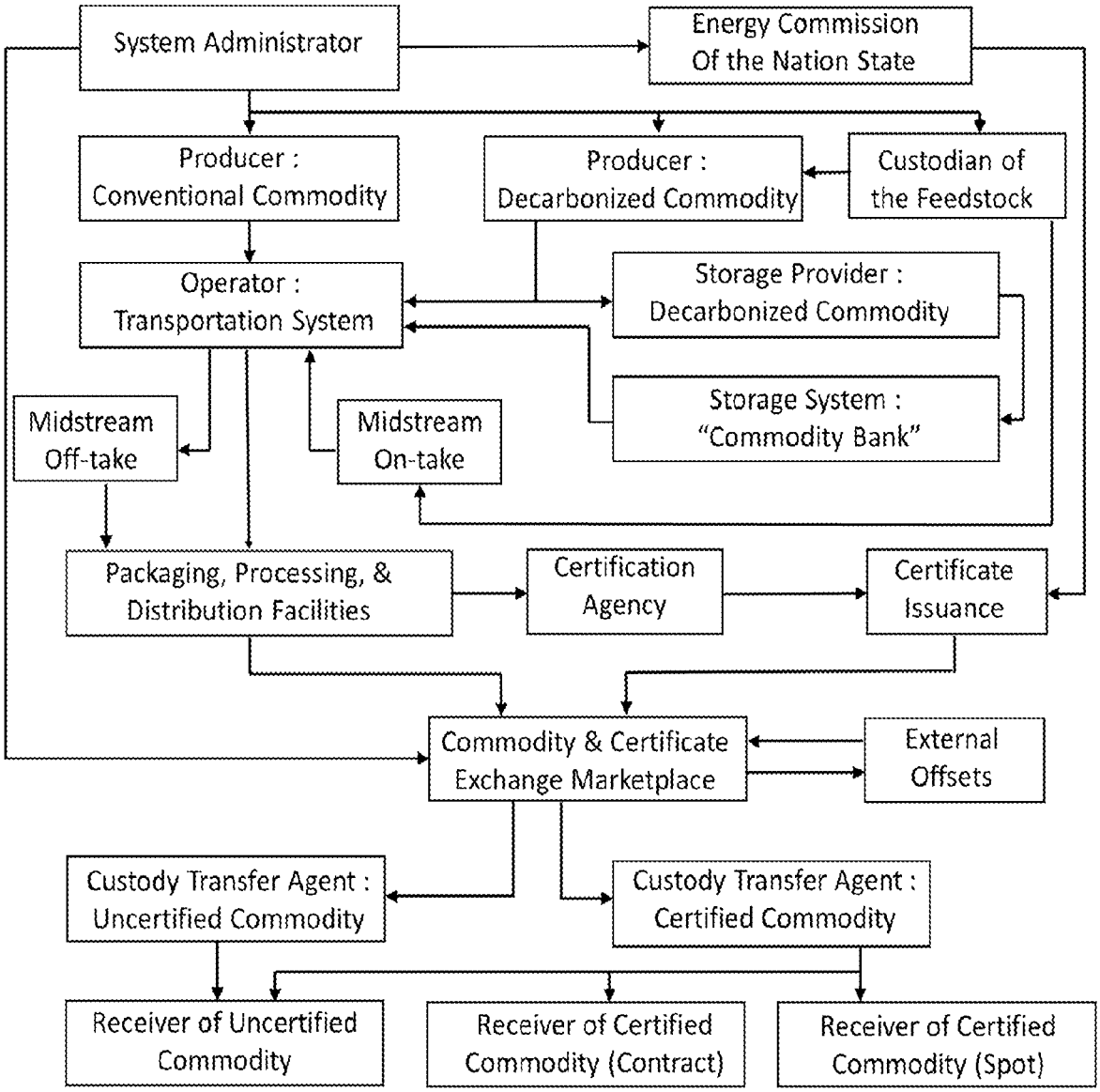
FIG. 4 is a schematic diagram of a material transfer process according to the present disclosure for delivery of carbon-free, partially decarbonized, or conventional fossil commodities via a shared transportation system.

As provided in FIG. 4, it is a schematic diagram of a material transfer process for delivery of carbon-free, partially decarbonized, or conventional fossil commodities via a shared transportation system.

A crude oil sales pipeline has regulatory and technical specifications related to the maximum permissible true vapor pressure (TVP) of crude oil transported or stored in the system. For temperature and pressure conditions representative of a hot oil pipeline, ammonia is a volatile substance that competes with volatile hydrocarbon for available 'vapor space'. This is an issue as volatile hydrocarbons are a source of revenue, useful in powering pipeline facilities, and in high demand during winter months. With such lower temperatures, ammonia's mutual solubility limit in hydrocarbon is progressively diminished as operating temperatures are lowered below about 20° C. Additionally, crude oil and other viscous hydrocarbon are less pumpable at low temperatures which increases transportation cost or precludes the use of pipelines as a land transportation mode entirely. Thus, the presently disclosed fuel dispensing system is capable of transporting ammonia and hydrocarbon by a method which maintains the pumpability of a viscous hydrocarbon at low temperatures.

In some embodiments, the method further comprises, before or after transferring the composition, implementing a delivery schedule of the fuel composition. For example, by facilitating material transfer during winter months when ambient temperatures are low, ammonia is more easily handled, and the price of conventional energy commodities high due to seasonal energy demand. In some embodiments, the ammonia may be stored for long periods of time in a storage reservoir prior to transfer. In some embodiments, technical, economic, or environmental benefits may be realized if the ammonia storage system is productively engaged with other hydrocarbon processing systems prior to delivery to the end-user. With the presently disclosed methods, the transport of ammonia-hydrocarbon dispersions in winter months results in lower transportation cost and environmental impacts due to lower ambient temperatures. Further, for example, in winter, the price of conventional energy commodities such as propane and liquefied natural gas (LNG) are typically high due to increased demand for heat. Additionally, also in winter, many regions including the northern hemisphere have decreased solar intensity which may result in the reduced availability of "green" hydrogen during such periods thus motivating the withdrawal and delivery of liquid ammonia as part of a delivery schedule.

In some embodiments, the presently disclosed ammonia-hydrocarbon dispersion may be dispensed from a pipeline facility into a storage system, such as but not necessarily limited to, a marine vessel. The motivation for doing so is that in response to current and planned International Maritime Organization (IMO) regulations on air pollution, it is now widely anticipated that ammonia will be adopted as an IMO 2020 low-sulfur and IMO 2050 low-carbon compliant maritime fuel. Furthermore, amendments to IMO MEPC 76 introduce a Carbon Intensity Indicator (CII) that requires polluting vessels to submit a corrective action plan to curtail emissions moving forward. Lowering the CII rating via fuel-switching to ammonia avoids an increase in transit times. Currently manufacturers are developing ammonia-ready LNG vessels, ammonia-powered engines, and retrofit kits for converting legacy oil-burning vessels to ammonia-service. Where information is available, these systems appear to operate using a dual-fuel approach where hydrocarbon and non-hydrocarbon fuels are stored separately increasing cost and complicating logistics associated with refueling.

In some embodiments, the method is directed to leveraging existing hydrocarbon processing systems in the production, delivery, and use of ammonia as a carbon-free energy source for accelerating the decarbonization of industrial, transportation, and power generation sectors. In this capacity, the methods described herein represents an improvement with respect to both pipeline flow and the discharge of ammonia-hydrocarbon blends from a storage tank into a receptacle or storage system such as a fuel tank or combustion system. In some embodiments, the ammonia-hydrocarbon dispersions of the presently disclosed composition may be engaged in a dual functional role of pipeline transmission fluid and partially decarbonized ammonia-hydrocarbon fuel blend. For example, an ammonia-hydrocarbon dispersion may be shuttled through a pipeline system, processed at a distribution facility, and delivered as a ready-to-use partially decarbonized fuel oil. By the presently disclosed methods, the carbon-free hydrogen energy contained in the ammonia molecule can be delivered at lower cost and with reduced environmental impact in comparison to other long-distance distribution methods or conventional fuel oils which require processing at refineries.

In some embodiments, the method leverages the pipeline system for the transport of "green" ammonia produced at high-potential renewable resource sites located along the pipeline route. While the moniker "green" refers to the production of ammonia using renewable electricity, other forms of distributed ammonia synthesis involving biogas or syngas might also be employed. Typically, renewable resources are distributed over vast geographic areas and the ability to dispense renewable commodities through a pipeline system while leveraging downstream processing facility improvements over standalone renewable projects where transportation is a bottleneck in the utilization of distributed renewable resources for chemical or fuel production. In some embodiments, "green" ammonia can be added into the existing ammonia-hydrocarbon dispersion unconstrained by solubility limits and without compromising flowability. For example, the improved fluidity of ammonia-continuous dispersions relative to viscous hydrocarbon solution lowers resistances to mass transfer, facilitates rapid-mixing, and reduces the likelihood of flow instability as the added ammonia is readily incorporated into the continuous ammonia-rich phase of the dispersed mixture.

Figure 5:
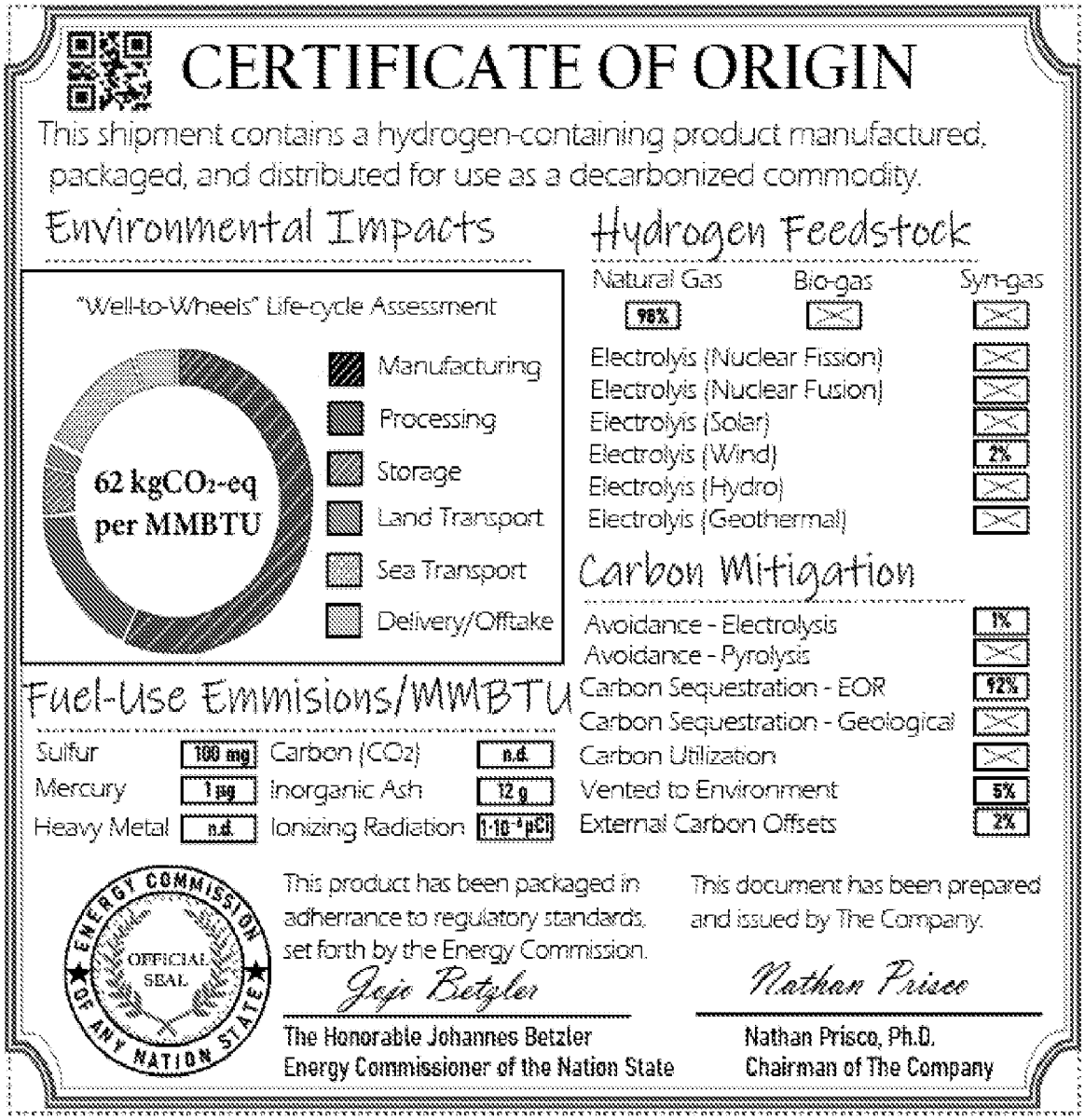
FIG. 5 illustrates a value-enhancing document that communicates information pertinent to the manufactured origin of a delivered commodity, fuel blend, or a fuel composition according to the present disclosure.

In some embodiments, the method is directed to transferring the compositions with a value-enhancing document that certifies the "green" or "blue" ammonia manufactured origin and provides quantitative metrics of environmental impacts associated with production and delivery to a location of use. For example, the proximity of the ammonia production site to the pipeline, the quality of the feedstock, the method of manufacture, and other unit operations may factor into the quantitative environmental impact metric. To facilitate this process, as discussed above, the present disclosed systems comprise computer hardware, instrumentation, process control equipment, software tools, financial products, and a document generating device to generate a certificate that is issued to the recipient of the ammonia-containing product. In some embodiments, this process increases the sale price of ammonia or hydrocarbon products in markets that value a reduction in carbon emissions and transparency in carbon-free energy supply chains. FIG. 5 illustrates a value-enhancing document that communications information pertinent to the manufactured origin of a delivered commodity or fuel blend. The value-enhancing document contains a QR code or certificate number which pertains to the "identity" of the certificate on a data registry such as a blockchain system or financial commodity.

Figure 6:
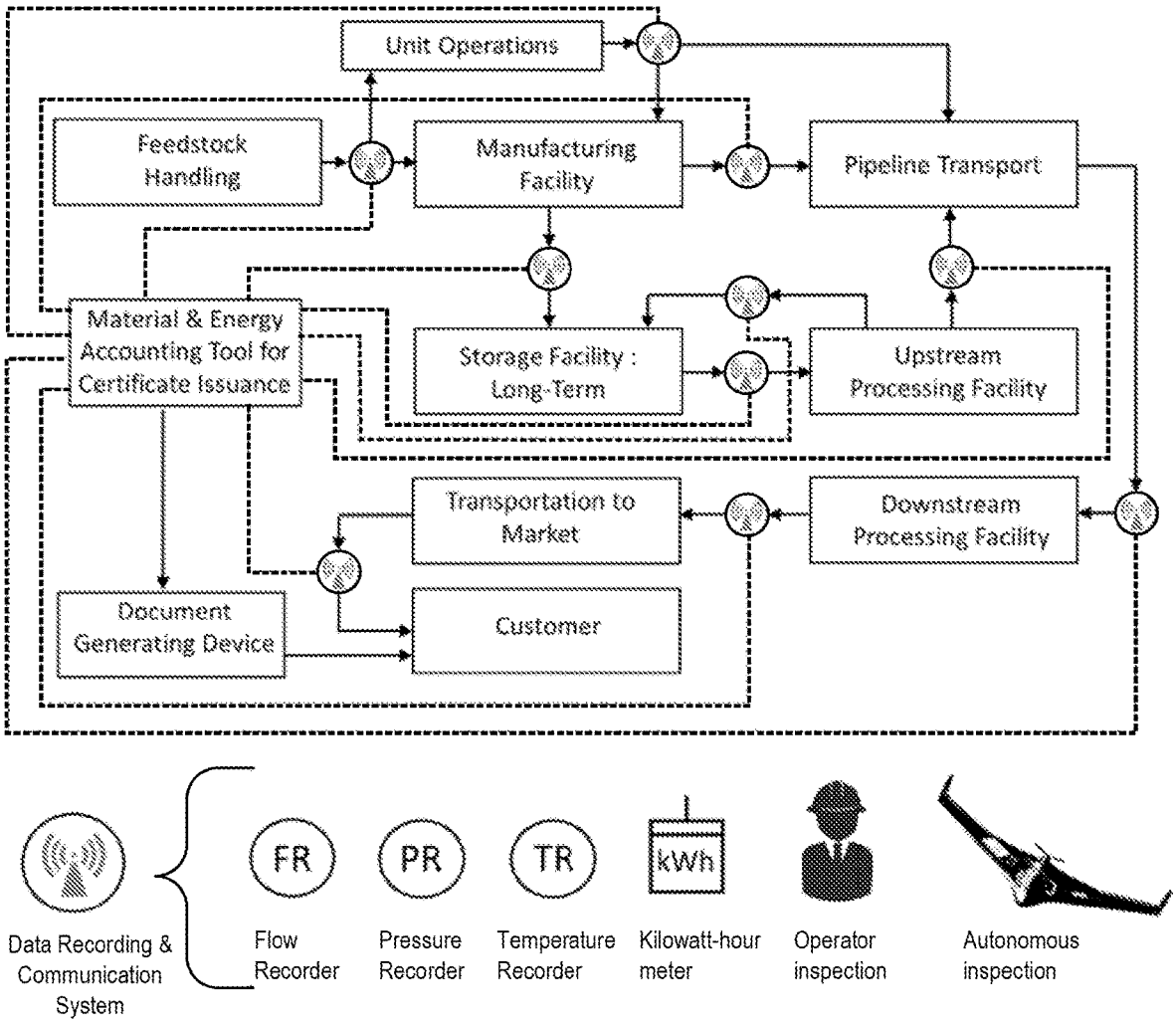
FIG. 6 is a schematic diagram of a combined material and information transfer process, according to the present disclosure.

FIG. 6 is a schematic diagram of a combined material and information transfer process. Here, a value-enhancing document is generated and transmitted along with a delivered commodity or fuel blend. Solid-lines correspond to material or processed data transfer and dashed-lines correspond to the transfer of raw data recorded from operation of the transportation system. In some embodiments, qualifying material or energy transfer event as defined by the system administrator or other party is recorded by use of instrumentation or through periodic inspection. The raw data is processed using computer hardware and software tools to generate a value-enhancing document to accompany a delivered commodity or fuel blend.

Figure 7:
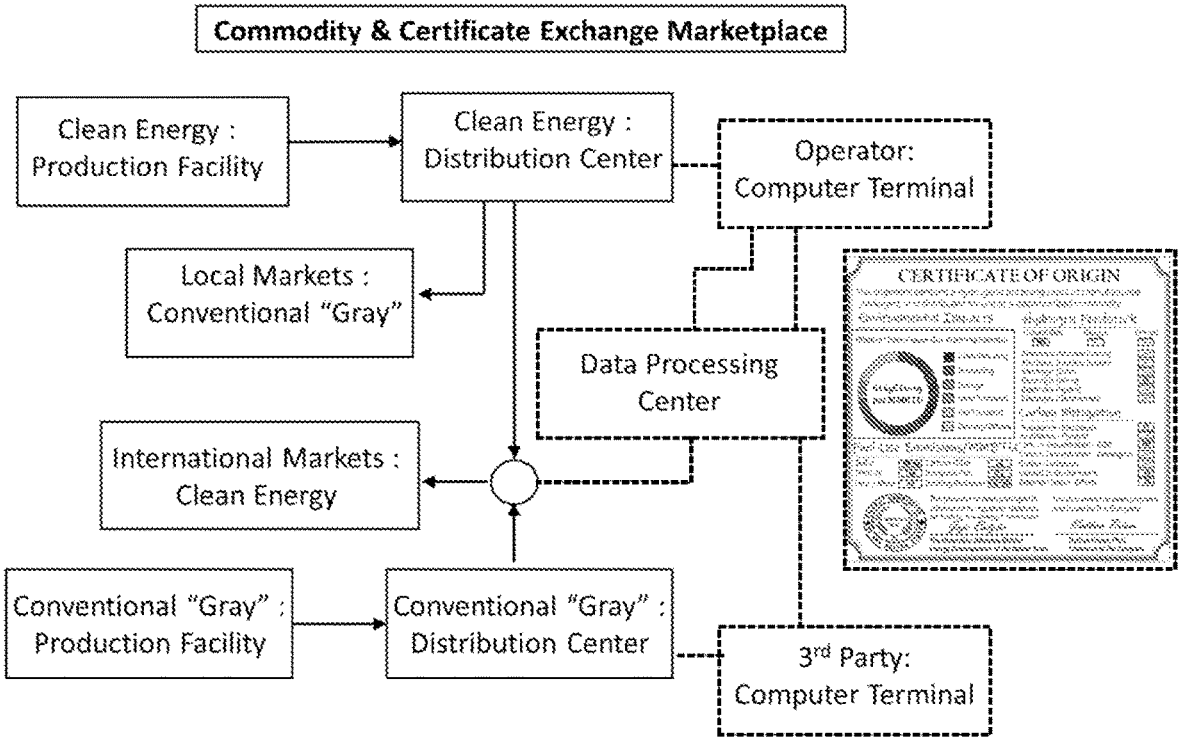
FIG. 7 is a schematic diagram of a material transfer process associated with a Commodity & Certification Exchange Marketplace, according to the present disclosure.

FIG. 7 is a schematic diagram of a material transfer process associated with a Commodity & Certification Exchange Marketplace. This process is carbon-free commodities that are physically indistinguishable from conventional "gray" commodities such that the manufactured origin may be traded between two or more production facilities to simplify supply chain logistics. For example, there are economic and environmental benefits associated with minimizing transportation logistics such that a commodity produced at a conventional "gray" facility may be assigned a certificate associated with a commodity produced at a carbon-free facility and vice-versa to reduce transportation distance to markets for carbon-free and "gray" commodities, respectively.

Figure 8:
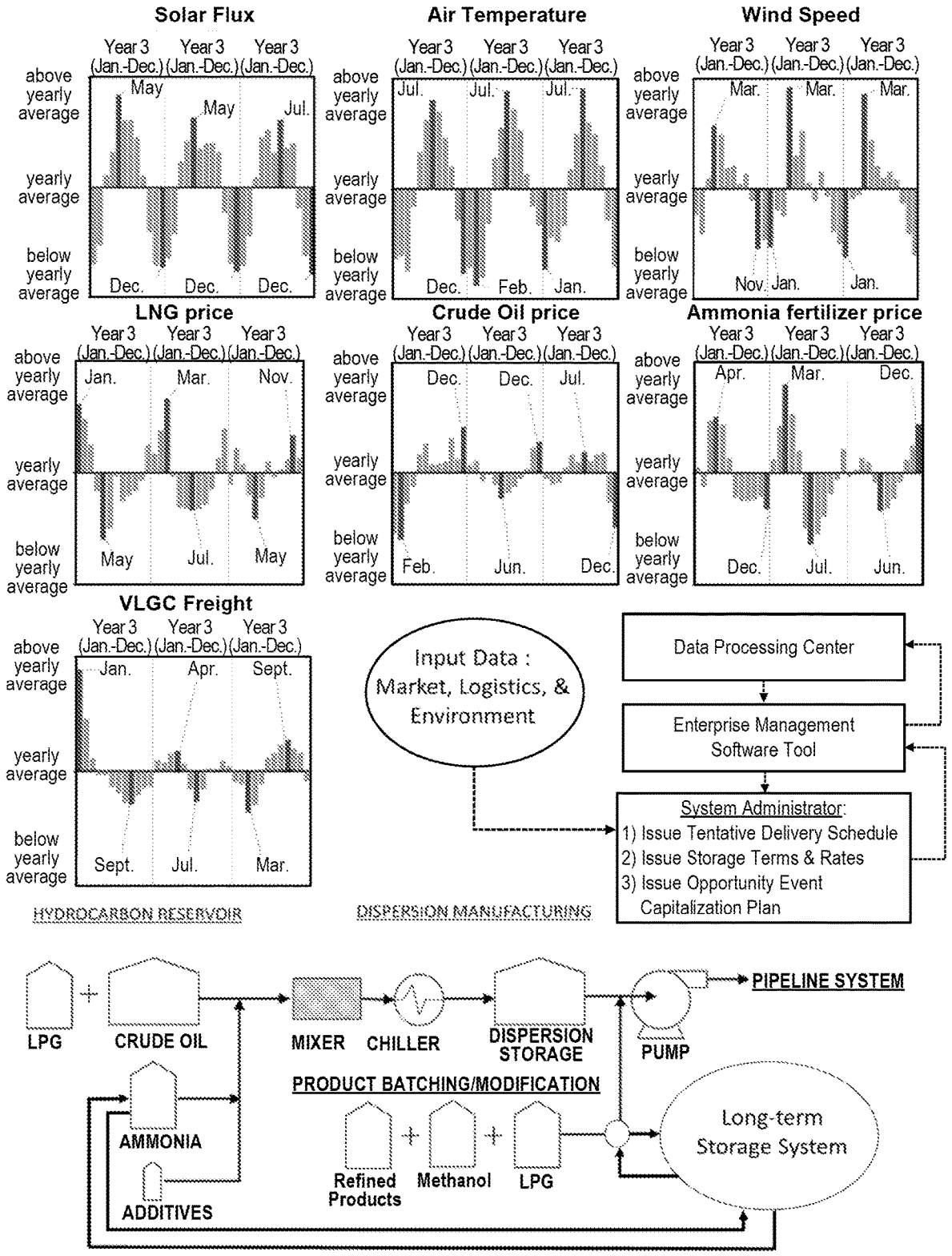
FIG. 8 is a schematic diagram of a process for transforming market, logistical, or environmental data to improve resource utilization as part of a flexible or seasonal delivery schedule, as provided in some embodiments of the present disclosure.

FIG. 8 is a schematic diagram of a process for transforming market, logistical, or environmental data to improve resource utilization as part of a flexible or seasonal delivery schedule, as provided in some embodiments of the present disclosure. FIGS. 9(A) and 9(B) illustrate embodiments of revenue-generating storage systems that provide for a carbon-free, partially decarbonized, or "gray" commodity introduced into a subterranean reservoir when not scheduled for immediate delivery.

In some embodiments, the presently disclosed methods are directed to preparing and dispatching ammonia-hydrocarbon dispersions from a production or storage location to a location of use. Here, in some embodiments, the presently disclosed methods and/or compositions provide for one or more of the following:

- Lowering operating temperatures down to −70 to −100° C. while maintaining pumpability of a liquid-solid ammonia-hydrocarbon dispersion.
- Enhancing the 'vapor capacity' of a pipeline system to accommodate additional sales of volatile hydrocarbon.
- Exploiting the high heat capacity of the ammonia media as a thermal sink to resist changes in temperature occurring during pipeline transport or extended storage periods which is useful in preventing boil-off of volatile hydrocarbons.
- Exploiting the high latent heat of ammonia vaporization to induce a rapid-cooling effect that is useful in lowering hydrocarbon mobility, reducing external refrigeration requirements, preventing cavitation at the pumping stations, reducing the amount and rate at which material is discharged from the pipeline or storage vessel in the event of system failure, and reducing the risk of slack-line flow relative to similarly volatile blending agents such as propane.
- Exploiting the chemical properties of ammonia at low-temperatures in the selective extractive of high-value aromatic and olefinic compounds.
- Exploiting the polarity of the ammonia-rich media to dissociate inorganic salts for the purpose of modifying chemical, physical, or rheological properties of the ammonia-hydrocarbon dispersion or to facilitate its separation into constitutive fractions.
- Inhibiting wax deposition on pipeline or storage container walls using a liquid-solid ammonia-hydrocarbon dispersion as paraffin waxes have a greater affinity for the solid-hydrocarbon particles and are immobilized.

Exploiting the viscosity reduction associated with the partial miscibility of ammonia and hydrocarbon in a manner useful to lowering production costs, reducing processing temperatures typically required for bitumen or heavy oil, and lowering the pressure required to mobilize viscous hydrocarbon through a small-flow channel such as a nozzle in a manner that is enabling to applications such as the production of fine dispersions.

Exploiting the low mass-density of liquid ammonia to reduce pumping costs as a mass diluent.

Exploiting the low mass-density and high-vapor pressure of liquid ammonia to discharge an ammonia-hydrocarbon dispersion from a storage tank in an aerosol-like manner which is useful in obviating the use of certain mechanical equipment onboard maritime vessels.

EMBODIMENTS

Without limitation, some embodiments of the disclosure include:

1. A fuel composition comprising: a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm.

2. The composition according to Embodiment 1, wherein the droplet size ranges from about 100 nm to about 10 μm.

3. The composition according to v 1, wherein the fuel composition is thermodynamically stable.

4. The composition according to Embodiment 1, wherein the fuel composition is kinetically stable, as 90% of the fuel composition remains homogenous for at least ten hours.

5. The composition according to Embodiment 1, further comprising a surfactant.

6. The composition according to Embodiment 5, wherein the surfactant is chosen from nonionic surfactants, anionic surfactants, and combinations thereof.

7. The composition according to Embodiment 6, wherein the nonionic surfactant is chosen from amides, diamides, polyglycol esters, alkyl polyglycosides, sorbitan esters, methyl glucoside esters, fluorocarbon polymers, alkylphenol ethoxylates, alcohol ethoxylates, and combinations thereof.

8. The composition according to Embodiment 6, wherein the anionic surfactant is chosen from stearates, gluconates, glutamates, sarcosinates, lactylates, fatty acid carboxylates, naphthenates, and combinations thereof.

9. The composition according to Embodiment 1, wherein the non-polar based discontinuous phase is saturated or under-saturated in view of the liquid ammonia.

10. The composition according to Embodiment 1, wherein the polar based continuous phase further comprises a polar co-solvent.

11. The composition according to Embodiment 10, wherein the polar co-solvent is chosen from water, alcohol, ether, and combinations thereof.

12. The composition according to Embodiment 1, wherein the polar based continuous phase further comprises from about 0.1% to about 19.0% by v/v of total polar phase of a polar co-solvent and a surfactant, wherein the surfactant comprises a nonionic surfactant chosen from amides, diamides, polyglycol esters, alkyl polyglycosides, sorbitan esters, methyl glucoside esters, fluorocarbon polymers, alkylphenol ethoxylates, alcohol ethoxylates, and combinations thereof; and/or an anionic surfactant chosen from stearates, gluconates, glutamates, sarcosinates, lactylates, fatty acid carboxylates, naphthenates, lignosulfonates, organic sulfonates, organic sulfates, organic sulfites, organic phosphates, and organic sulfosuccinates preferably containing an alkali metal, alkaline earth metal, transition metal, an ammonium cation, and combinations thereof.

13. The composition according to Embodiment 1, further comprising an inorganic salt.

14. The composition according to Embodiment 13, wherein the inorganic salt is chosen from ammonium nitrite, ammonium nitrate, ammonium chloride, ammonium bromide, ammonium iodide, ammonium hypochlorite, ammonium thiocyanate, sodium nitrate, potassium nitrate, cesium nitrate, sodium iodide, potassium iodide, and cesium iodide.

15. The composition according to Embodiment 1, wherein the non-polar based discontinuous phase further comprises a non-polar co-solvent.

16. The composition according to Embodiment 15, wherein the non-polar co-solvent is chosen from propane, other liquefied hydrocarbon gases, and combinations thereof.

17. A method for preparing a fuel product comprising: inverting a fuel composition with a physical stimulus, wherein the fuel composition comprises: a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm to generate the fuel product, and wherein the physical stimulus is chosen from a change in temperature, a change in pressure, a change in composition, and combinations thereof.

18. The method according to Embodiment 17, wherein the composition further comprises an inorganic salt.

19. The method according to Embodiment 18, wherein the inorganic salt is chosen from ammonium nitrite, ammonium nitrate, ammonium chloride, ammonium bromide, ammonium iodide, ammonium hypochlorite, ammonium thiocyanate, sodium nitrate, potassium nitrate, cesium nitrate, sodium iodide, potassium iodide, and cesium iodide.

20. The method according to Embodiment 17, further comprising storing the fuel product in a tank or a vessel at a temperature ranging from about minus 92° C. to about 45° C.

21. A fuel dispensing system for transporting, storing and/or delivering a fuel composition comprising at least a pipeline or flow conduit, wherein the fuel composition comprises: a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm.

22. The fuel dispensing system according to Embodiment 21, further comprising one or more of: (a) a storage vessel or reservoir; (b) a dispersion manufacturing production facility; (c) an offtake facility; (d) an ontake facility; (e) a product dispensing facility; (f) a data processing facility; and/or (g) a document generating facility.

23. The fuel dispensing system according to Embodiment 21, wherein the system comprises elements (a)-(g).

24. A method for transporting a fuel composition comprising: preparing a fuel composition comprising a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm; and transferring the fuel composition to a pipeline system to transport the fuel composition to a location of use or a production or storage location.

25. The method according to Embodiment 24, wherein the pipeline system is at a temperature ranging from a freezing point of the polar based continuous phase to about 10° C.

26. The method according to Embodiment 24, further comprising removing the polar based continuous phase and/or the non-polar based discontinuous phase from the composition at an offtake point along the pipeline system generating a remaining fuel composition and continuing to transfer the remaining fuel composition in the pipeline system to the location of use, wherein the remaining fuel composition does not invert.

27. The method according to Embodiment 24, further comprising adding a polar and/or a non-polar additive to an ontake point along the pipeline system forming a remaining fuel composition, wherein the remaining fuel composition does not invert.

28. The method according to Embodiment 24, wherein transferring the fuel composition further comprises a value-enhancing document to identify an origin of the fuel composition.

29. The method according to Embodiment 28, wherein the value-enhancing document is transferred via a certificate swap with a third party.

30. The method according to Embodiment 28, wherein transferring the composition comprises supervising the composition by a system administrator and verifying the value-enhancing document of the composition.

31. The method according to Embodiment 24, wherein the pipeline system is chosen from a crude oil sales pipeline system, a crude oil production pipeline system, a legacy hydrocarbon system, and combinations thereof.

32. The method according to Embodiment 24, further comprising, before or after transferring the fuel composition, implementing a delivery schedule of the fuel composition.

33. The method according to Embodiment 24, wherein the location of use is a subterranean reservoir.

34. The method according to Embodiment 24, wherein the frozen hydrocarbon is an ammonia saturated crude oil handled at a temperature below the gel point of the ammonia saturated crude oil.

35. The method according to Embodiment 24, wherein the viscous liquid hydrocarbon is an ammonia saturated crude oil handled at a temperature above the gel point of the ammonia saturated crude oil.

36. The method according to Embodiment 24, wherein the liquefied volatile hydrocarbon is propane.

37. The method according to Embodiment 24, wherein the storage location is chosen from a marine vessel, a fuel tank, a combustion system, and combinations thereof.

38. The method according to Embodiment 24, further comprising, after transferring, processing the fuel composition at a distribution facility to form a ready-to-use partially decarbonized fuel, and delivering the fuel.

39. A method for preparing a fuel composition of an ammonia-hydrocarbon dispersion comprising: combining ammonia, hydrocarbon, and a stabilization agent under temperature, pressure, and/or composition conditions to form an ammonia-hydrocarbon dispersion with a HLD>0; using temperature, pressure, and/or composition conditions to modify the ammonia-hydrocarbon dispersion to HLD~0; and transporting or storing the ammonia-hydrocarbon dispersion under temperature or pressure conditions corresponding to HLD<0.

40. The method according to Embodiment 39, wherein the ammonia-hydrocarbon dispersion is a kinetically stable dispersion.

41. The method according to Embodiment 39, wherein the stabilization agent is chosen from a surfactant, an inorganic clay, a pH-buffering composition, a polymer gelation agent, and combinations thereof.

42. The composition according to Embodiment 1, further comprising one or more of a corrosion inhibitor, an oxygen scavenger, a viscosity modifying agent, and a chemical additive.

43. The composition according to Embodiment 1, further comprising one or more of a polymer, a surfactant, an inorganic clay, a chemical additive, and a co-solvent.

44. A method for preparing a fuel product comprising: combining a hydrocarbon, a surfactant, and a co-solvent to form a hydrocarbon-rich precursor mixture; and subsequently combining the hydrocarbon-rich precursor mixture with a liquid ammonia that is under-saturated with respect to at least one surfactant or cosolvent to produce an ammonia-hydrocarbon dispersion under conditions corresponding to HLD>0, HLD~0, or HLD<0.

44. A method for preparing a fuel product comprising: combining a liquid ammonia, a surfactant, and a cosolvent to form an ammonia-rich precursor mixture; and combining the ammonia-rich precursor mixture with a hydrocarbon that is under-saturated with respect to at least one surfactant or cosolvent to produce an ammonia-hydrocarbon dispersion under conditions corresponding to HLD>0, HLD~0, or HLD<0.

Claims or descriptions that include "or" or "and/or" between at least one members of a group are considered satisfied if one, more than one, or all of the group members are present in, employed in, or otherwise relevant to a given product or process unless indicated to the contrary or otherwise evident from the context. The disclosure includes embodiments in which exactly one member of the group is present in, employed in, or otherwise relevant to a given product or process. The disclosure includes embodiments in which more than one, or all the group members are present in, employed in, or otherwise relevant to a given product or process.

Furthermore, the disclosure encompasses all variations, combinations, and permutations in which at least one limitation, element, clause, and descriptive term from at least one of the listed claims is introduced into another claim. For example, any claim that is dependent on another claim can be modified to include at least one limitation found in any other claim that is dependent on the same base claim. Where elements are presented as lists, such as, e.g., in Markush group format, each subgroup of the elements is also disclosed, and any element(s) can be removed from the group. It should be understood that, in general, where the disclosure, or aspects of the disclosure, is/are referred to as comprising particular elements and/or features, embodiments of the disclosure or aspects of the disclosure consist, or consist essentially of, such elements and/or features. For purposes of simplicity, those embodiments have not been specifically set forth in haec verba herein. Where ranges are given, endpoints are included. Furthermore, unless otherwise indicated or otherwise evident from the context and understanding of one of ordinary skill in the art, values that are expressed as ranges can assume any specific value or sub range within the stated ranges in different embodiments of the disclosure, unless the context clearly dictates otherwise.

Those of ordinary skill in the art will recognize or be able to ascertain using no more than routine experimentation, many equivalents to the specific embodiments of the disclosure described herein. Such equivalents are intended to be encompassed by the following claims.

EXAMPLES

Examples 1 and 2: Use of Surfactants

Ammonia hydrocarbon dispersions were prepared in a home-built high-pressure view cell constructed of Hastelloy C22 with an internal volume of 10.0 mL. The view cell contains three optically transparent sapphire windows enabling inspection of the fluid under pressure. To aid in visualization, a light source was situated at one of the windows to direct light through the view-cell. Three copper heat exchanger tubes were installed by drilling holes through the corners of the view cell. The copper tubes were coated with a thermally conductive grease to improve thermal contact with the Hastelloy C22 vessel.

The apparatus was thermally insulated with aluminum foil and rubber padding. Experiments were conducted under industrially relevant temperature and pressure conditions maintained by use of a recirculating chiller and the self-pressure of ammonia within the vessel, respectively. As provided herein, industrially relevant conditions refer to the handling of ammonia-hydrocarbon dispersions under controlled pressure conditions sufficient to maintain the ammonia in the liquid state over temperature conditions ranging from about −40° C. to 10° C. The temperature of the system was indirectly monitored by installation of a thermocouple into the Hastelloy C22 block. A spring-type 800 psig pressure relief device was installed to avoid over-pressure due to volume-expansion of liquid ammonia within the confined volume. A magnetic stir bar was placed inside the view cell and where applicable a stirring rate of 500 rpm was used due to convenience; however, in the practice of the invention, any stir rate or method of mixing ammonia and hydrocarbon may be employed without limitation. Initially, the lowest temperature that could be attained by the recirculating chiller was ~7 to 8° C. A schematic diagram and photograph of the view-cell apparatus is depicted below in FIG. 16.

Ammonia-hydrocarbon dispersions (AHD's) were produced with and without stabilizing surfactant for the purpose of comparing the relative stability of the produced mixtures. Although ammonia, hydrocarbon, and surfactant may be combined by any means, the following procedure was used to prepare AHD-1 (no stabilizer) and AHD-2 (with stabilizer) comprised of 60-40 hydrocarbon-ammonia:

i) The view-cell was partially evacuated of air using a weak vacuum system (~0.1 bar). Removal of oxygen was not essential to this demonstration given the high chemical-resistance of Hastelloy 22C. For some embodiments, where ammonia is transported through a system constructed of carbon-steel, the removal of gaseous or dissolved oxygen to levels below 50 ppm reduces the risk of stress-corrosion cracking.

ii) A pre-weighed mass of crude oil was injected into the view cell by use of a syringe. It was necessary to pre-warm the crude oil to about 50° C. to improve fluidity so that the oil could be injected by hand through the narrow ⅛" or 1/16" diameter injection line.

iii) In the case of AHD-2, the commercially relevant nonionic alcohol ethoxylate surfactant Triton-X100 was dissolved into the crude oil at temperatures of about 45° C. to about 65° C. at a concentration of about 50 lb's surfactant per barrel of oil. The use of such a high surfactant concentration is uneconomical, in some embodiments of this disclosure, but is useful in optimizing the dispersion formulation as part of the example. In subsequent formulations, a concentration of about 1.25 lb's surfactant per barrel of oil was used with satisfactory results. Also, Triton-X100 is insoluble in crude oil at room temperature but freely soluble at temperatures greater than about 50° C. In some embodiments, this property of nonionic ethoxylate surfactants is useful in generating low-cost dispersions by the method of phase inversion.

iv) Because an ammonia-compatible pump was not available, the view-cell apparatus was pre-cooled to about 15° C. prior to ammonia injection so that ammonia liquid can be condensed within the view-cell to fill the remaining space not occupied by crude oil or surfactant. Due to the simplicity of this apparatus, it was not possible to rapidly cool the system (such as in phase inversion processes) as the recirculating chiller and heat exchanger system takes roughly 30 to 60 minutes to equilibrate to a new set point.

v) A small-volume of gaseous ammonia was used to purge the view-cell several times to displace air from the system.

vi) Gaseous ammonia was condensed directly from an ammonia cylinder under ambient temperature about 23° C. into the view-cell vessel which was pre-cooled to under about 15° C. As depicted in FIG. 11, there is a violent foamy reaction between the ammonia and hydrocarbon under these conditions which facilitates rapid-mixing. This occurs partly because ammonia is close to its dew point such that ammonia condenses and boils in contact with hydrocarbon. Although a homogeneous dispersion is obtained within about 30 seconds of contacting the ammonia and hydrocarbon, the ammonia cylinder is left open for a period of 15 to 30 minutes to ensure the volume is filled.

As can be seen in FIG. 11, the 60-40 hydrocarbon-ammonia blends are highly opaque which makes it challenging to fully resolve the kinetic stability of the dispersion over time. To evaluate stability, the blends were stirred at 500 rpm at a temperature of about 8° C. for roughly one hour without any indication of phase separation occurring. Subsequently, the stir plate was deactivated, and the blends were gradually heated to 65° C. In addition to photographic and video evidence provided in FIG. 17, the following observations were made in Table IV:

TABLE IV

| Dispersion | Observation |
|---|---|
| AHD-1 | Initially a homogeneous mixture was formed that was highly opaque. Once stirring was ceased and the temperature reached |

TABLE IV-continued

| Dispersion | Observation |
|---|---|
| | about 20° C. to 30° C., the mixture rapidly separated into two distinct phases. Unlike water-oil dispersions where water is the denser phase, ammonia has a lower density than crude oil and floats to the top. Notably, the ammonia-rich phase was optically transparent as seen in FIG. 17. Once phase separation had occurred, the dispersion could not be reformed simply by reducing temperature back to about 8° C. |
| AHD-2 | Initially, a homogeneous mixture was formed that was highly opaque. Once stirring was ceased and the temperature rose to about 20° C. to 30° C., there was slight indication of settling of hydrocarbon material but the mixture was largely homogeneous. Upon reaching temperatures of about 45° C. to 55° C., slow and prolonged separation of the mixture began to occur. Separation appeared to be accelerated by the formation of ammonia vapor bubbles in the hydrocarbon-rich phase which rose and re-condensed within the ammonia-rich phase. As seen in FIG. 11, the ammonia-rich phase emerged as a partially-opaque brown fluid that gradually lightened to a semi-translucent brown-grey fluid over a period of four to six hours at temperatures of about 65° C. Although compositional analysis was not performed, it is highly likely that residual surfactant in the ammonia-rich fraction promotes the solubilization of certain hydrocarbon compounds. Like AHD-1, it was not possible to reform the AHD-2 dispersion simply by lowering temperature back to about 8° C. under stirring. |

In some embodiments, ammonia-hydrocarbon dispersions can be readily broken under mild temperature and pressure conditions even at high surfactant loadings for use in downstream processing and separations. Furthermore, the nonionic ethoxylate surfactants exhibit a chemical affinity for ammonia even at high temperatures which, in some embodiments, may improve surfactant recovery factors. This might be expected as ammonia is known for its remarkable properties as a universal hydrogen-bond acceptor and strong chemical affinity for alcohol/ether moieties. In some embodiments, if phase separation occurs during transport or storage, then it is useful if a homogeneous ammonia-hydrocarbon dispersion can be reformed.

As shown in FIG. 11 the ammonia-hydrocarbon dispersion may be reformed by flashing a portion of the ammonia under controlled temperature or pressure conditions. It is further shown that the ammonia-hydrocarbon dispersions have vastly improved stability at low-temperatures (<about 10° C.) but have an increased tendency to separate into two or more fractions at high-temperatures (>about 25° C.). For example, vaporization of ammonia enhances mixing, the temperature is rapidly reduced due to ammonia's high latent heat of vaporization (see FIG. 12(A)), and the remaining liquid composition is enriched in hydrocarbon by removal of ammonia promoting a higher effective viscosity.

Example 3: Stabilized Dispersion

To demonstrate that ammonia-hydrocarbon dispersions can be stabilized for the purpose of transport or storage, a similar experiment to Example 1-2 was performed for a third specimen AHD-3. Here, the concentration of Triton-X100 corresponded to about 1.25 lb surfactant per barrel of oil which is a commercially relevant concentration. To improve the optical transparency this mixture, AHD-3 was comprised of 40-60 hydrocarbon-ammonia. Rather than heating the mixture, once prepared it was stored under 500 rpm stirring at a temperature of about 8° C. Due to the simplicity of the apparatus and position of the magnetic stir bar, stirring was localized to a small central region within the view-cell. As depicted in FIG. 17, there are differences in the refractive properties between AHD-3 stored for two hours and at five hours. Likely, this is due to the coalescence and settling of hydrocarbon droplets, as illustrated in FIG. 23. There was a reddish hue of the illuminated emulsions, which is consistent with Rayleigh scattering arising from particle sizes on the order of 100 nm to 1,000 nm, as provided in FIG. 17. With a lower temperature, stability could be improved due to an increase in the viscosity and density of the ammonia-rich fraction, in conjunction with the freezing of hydrocarbon droplets.

For the fuel compositions described in Examples 1-3, the hydrocarbon used is an Alaskan North Slope (ANS) medium API° grade crude oil (hereafter referred to as "ANS medium oil") of unknown origin that had been stored in an opaque glass bottle for greater than ten years prior to use. The following dynamic viscosity values for the ANS medium oil were determined to be 715 cP (0° C.), 211 CP (20° C.), 68 cP (40° C.), and 28 cP (60° C.) by rheology.

To provide further discussion of Example 3 above, it is noted that Rayleigh scattering is not responsible for the red hue observed through the view cell in FIG. 17. Inspection of the UV-vis absorption spectral range typical of crude oil specimens which have strong absorption bands at shorter wavelengths (about 380 to 500 nm-1, violet to green) but very weak absorption bands at longer wavelengths (about 550 to 750 nm-1, yellow to red); see to UV-vis absorption spectra of crude oil presented in the research article Naseer Mahdi Hadi, et al. "Determination of Absorption and Fluorescence Spectrum of Iraqi Crude Oil. American Journal of Physics and Applications". *American Journal of Physics and Applications*, Vol. 4, No. 3, 2016, pp. 78-83. Thus, the red hue observed for AHD-3 is consistent with absorption and scattering through a particle suspension comprising crude oil droplets. With respect to AHD-3 (stored at 8° C., under 500 RPM stirring) stable lifetime, a significant fraction of hydrocarbon droplet coalescence and settles over the course of a few hours.

As depicted in FIG. 17, optical transmittance through AHD-3 is apparent in the image acquired at 2 h and becomes more pronounced in the image acquired at 5 h which comprises fewer suspended hydrocarbon droplets. Dark regions are clusters of suspended hydrocarbon droplets, some of these appear larger than the 2.5 to 10 μm pixel size of the microscope camera (Celestron—5 MP Digital Microscope Pro—Handheld USB Microscope). Particle-size distributions are typically measured for dilute dispersions comprising sub-10 μm droplets by use of techniques such as dynamic light scattering (DLS). Because a specialized high-pressure DLS instrument would be needed to measure particle-size distributions of ammonia-hydrocarbon dispersions, these analyses were not performed. With the additional context provided by Examples 4-10 below, the relatively high coalescence rate observed for AHD-3 can be satisfactorily explained by the present disclosures.

Examples 4-8: Preparation and Use of AHD Comprising a High-Viscosity Hydrocarbon To further demonstrate the usefulness of the disclosed ammonia-hydrocarbon dispersion as a fuel composition, two crude oil specimens that comprised a light and heavy crude oil by API° gravity classification, respectively, were selected as the viscous hydrocarbon. As discussed, crude oil sales pipelines transport liquid hydrocarbon over great distances, often hundreds of miles. The maximum kinematic viscosity limit for crude oil pipeline transportation ranges between 250 and 400 cSt at 100° F. (37.8° C.) according to the referenced article José A. D. Muñoz, Jorge Ancheyta, Luis C. Castañeda, *Energy Fuels,* 2016, 30, 11, 8850-8854. However, these maximum viscosity values correspond to crude oil pipeline systems specifically designed for transporting high-viscosity crude oils (low ° API). The American Petroleum Institute classification system is provided TABLE V below:

TABLE V

| API gravity classification system for crude oil |
|---|
| Light crude oil: higher than 31.1° API (less than 870 kg/m$^3$) |
| Medium crude oil: 31.1° API to 22.3° API (870 to 920 kg/m$^3$) |
| Heavy crude oil: 22.3° API to 10° API (920 to 1000 kg/m$^3$) |
| Extra-heavy crude oil: below 10° API (higher than 1000 kg/m$^3$) |

With relevance to pipeline transportation and use of fuel compositions, market forecasts now predict that crude oil demand will peak sometime between the next few years and in a couple of decades, it will be replaced by clean hydrogen and low-carbon electricity. Continued development of unconventional oil resources including shale oil has contributed to a supply glut of light crude oils (high ° API) in some regions. This is not an issue for processing at simple topping refineries (distillation), but complex refineries (distillation, catalytic cracking, hydrocracking, coking) require supplies of medium, heavy, or extra-heavy crude oils (lower ° API) to operate efficiently and enhance diesel/gasoline yields. For this reason, it is common practice that large volumes of crude oil are exported at the same time large volumes of crude oil must be imported to the same region. Complex refineries are where most hydrogen is consumed today, for example, as part of a hydrocracking process. These complex refineries often have compressed hydrogen gas pipelines and equipment that can be configured to recover clean ammonia from a fuel composition and crack it into molecular hydrogen for use in vehicle transportation or any other purpose. As such, there still remains a need for a stable fuel composition comprising a mixture of clean ammonia and high-viscosity crude oils (lower ° API gravity) useful as a refinery feedstock to produce lower GHG life-cycle emission diesel/gasoline transportation fuels and fuel-cell grade molecular hydrogen.

Meanwhile, many existing petroleum reservoirs are serviced by crude oil pipelines dedicated to the transport of low-viscosity crude oils (i.e., as part of a "legacy hydrocarbon system"). Over time, these low-viscosity crude oils (high ° API) have been largely depleted, motivating oil producers in these regions to either retire their assets or pursue development of low ° API crude oil reservoirs. For the latter, such reservoirs are typically located in shallower formations situated above a conventional light oil reservoir that may also contain natural gas or volatile hydrocarbon. To a limited extent, these high-viscosity crude oils (low ° API) can be processed or blended with low-viscosity crude oils (high ° API) to enable transportation via a legacy hydrocarbon system. It is not possible, however, to transport large volumes of the high-viscosity crude oil (low ° API) via a legacy hydrocarbon system without a method for reducing the viscosity of the low ° API crude oil. As previously discussed, one such approach is to use hydrocarbon diluent (i.e., light naphtha) but this adds major cost and requires access to a large, finite diluent supply.

The referenced U.S. Pat. No. 3,480,024 asserts that liquid ammonia can be injected into a hydrocarbon pipeline at 10% vol to 50% vol to form a mixture comprising viscous hydrocarbon by balance that is suitable for pipeline transport over great distance. However, as part of the present disclosure, it was discovered that the method of the prior art did not produce a fuel composition meeting the maximum viscosity specifications of a crude oil sales pipeline as specified above. In Examples 4-10 and detailed descriptions that follow, it is demonstrated that the spontaneous mixing and phase inversion methods, of the present disclosure, are successful in producing a fuel composition meeting the maximum viscosity specifications of a crude oil sales pipeline as specified above. In some embodiments, the greater viscosity reduction achieved by an ammonia hydrocarbon dispersion is an improvement over diluent and enables a high-viscosity crude oil (low ° API) to be transported in a pipeline initially designed for low-viscosity crude oil (high ° API) as part of a fuel composition.

In TABLE VI below, viscosity data is presented for an Alaskan light crude oil (32.1° API) and an Alaskan heavy crude oil (19° API):

TABLE VI

Viscosity Comparison of ANS Light and Heavy Crude Oil

| Temperature | ANS Stock Tank Oil | Schrader Bluff Oil |
|---|---|---|
| 60° C. | 3.2 cP (3.7 cSt) | 58 cP (62 cSt) |
| 40° C. | 4.7 cP (5.4 cSt) | 171 cP (182 cSt) |
| 20° C. | 7.9 cP (9.1 cSt) | 706 cP (751 cSt) |
| 0° C. | 13.5 cP (15.6 cSt) | 3,313 cP (3,524 cSt) |

From TABLE VI, the heavy crude oil, hereafter simply referred to as Schrader Bluff oil, has a dynamic viscosity of 3,313 cP (3,534 cSt) at 0° C. which greatly exceeds the maximum viscosity specification of a pipeline designed for high-viscosity crude oil (low ° API). At the same temperature, the light crude oil, hereafter simply referred to as ANS Stock Tank oil, has a dynamic viscosity of 13.5 cP (15.7 cSt) which is assumed to be the maximum viscosity specification for a pipeline designed for low-viscosity crude oil (high ° API). It is known for this pipeline system, and other pipeline systems located in cold climates, that the pipeline temperature often reaches freezing temperatures during winter months. Unlike hydrocarbon diluent, the presence of liquid ammonia in a hydrocarbon pipeline imparts beneficial characteristics by functioning as a freeze suppressant to prevent ice accumulations that would otherwise require costly maintenance procedures to remove (i.e., pigging).

Example 4: Method of the Prior Art

Following the method described by U.S. Pat. No. 3,480,024, a total volume of 10.7 mL of liquid ammonia was injected from a syringe pump into a rheometer cell comprising a concentric cylinder spindle operating at a constant shear rate of 100 $s^{-1}$ and containing 12 mL of Schrader Bluff oil, in the absence of any externally added surfactant, that was pre-cooled to 0° C. Notably, the selected shear rate is more representative of conditions encountered during pipeline flow as opposed to larger shear rates of 20,000 to 100,000 $s^{-1}$ that are representative of high-energy mixing processes (e.g., commercial rotor-stator emulsion mixers). It should be recognized that the rotating concentric cylinder spindle is ineffective as a process mixer but shears fluid in the annulus of the rheometer cell. As shown in the viscosity data presented in FIG. 18, it is seen that the dynamic viscosity was only reduced from 3,313 cP to 510 cP. For this example, which simulates injecting liquid ammonia into a liquid hydrocarbon pipeline containing a high-viscosity crude oil (low ° API), it was not possible to produce the inventive fuel composition by the method of the prior art. Further examples show that the inventive fuel composition meets the maximum viscosity specification for pipeline transport.

Examples 5-7: Preparation of the Fuel Composition by Inventive Method of Spontaneous Mixing at Various Temperatures Using the same procedure as Example 4, additional samples were prepared but the difference was that the hydrocarbon now contained a dispersed nonionic alcohol ethoxylate surfactant to induce spontaneous mixing. Following the procedure used for AHD-2 and AHD-3, the surfactant was dispersed into the viscous hydrocarbon at temperatures of about 60° C. prior to pre-cooling the rheometer cell to the desired temperature under a continuously applied shear rate of 100 $s^{-1}$. Subsequently, while still applying shear, liquid ammonia at ambient temperature was injected into the rheometer cell at temperatures of 0° C., 30° C., and 70° C. to produce AHD-5, AHD-6, and AHD-7, respectively. In those examples, liquid ammonia was injected in a single volume of about 10 mL but this should not be construed as limiting to the present disclosure. In practice, it is expected that the order and rate of addition used to combine liquid ammonia, viscous hydrocarbon, and surfactant will influence the compositions and properties of the resulting ammonia hydrocarbon dispersions.

Example 5

FIG. 19 depicts a dynamic viscosity reduction for Schrader Bluff oil containing surfactant at a temperature of 0° C. from 3,290 cP to 70 cP upon injection of a liquid ammonia to produce AHD-5. Assuming a mixture density of 800 kg/$m^3$, the kinematic viscosity of this liquid ammonia and hydrocarbon mixture was 87.5 cSt which is below the maximum viscosity specification of a crude oil sales pipeline as referenced above. The viscosity of this fuel composition is suitable for pipeline transportation.

Example 6

FIG. 20 depicts a dynamic viscosity reduction for Schrader Bluff oil containing surfactant at a temperature of 30° C. from 334 cP to 10 cP upon injection of a liquid ammonia to produce AHD-6. Surprisingly, between 33 min to 42 min of elapsed time, there was an increase in the dynamic viscosity followed by a decrease stabilizing at an even lower dynamic viscosity value of 3 cP. Assuming a mixture density of 800 kg/$m^3$, the kinematic viscosity of this liquid ammonia and hydrocarbon mixture was 3.75 cSt, lower than the kinematic viscosity of the ANS Stock Tank oil at 104° F. (40° C.). The viscosity of this fuel composition is suitable for pipeline transportation.

Example 7

When the same procedure was conducted at a temperature of 70° C., it was discovered that it was not possible to inject liquid ammonia into the rheometer cell due to a flow obstruction that rapidly developed. The procedure was ceased, and the flow obstruction diagnosed. The rheometer cell was dismantled and cleaned with several laboratory solvents. It was discovered that the flow obstruction was removed upon rinsing with toluene, the source of the plugging was then identified to be asphaltene deposition. Further discussion of asphaltene deposition is herein provided within the context of the preceding examples and according to the present disclosure.

Asphaltene deposition is a well-known issue that causes flow obstructions in the oil and gas industry. In many cases, a deciding factor in assessing the economic viability of a discovered crude oil deposit is whether asphaltene deposition can be managed. Heavy crude oils typically contain greater asphaltene concentrations than light crude oils. Crude oil de-asphalting is a process used to prepare heavy crude oils for pipeline transport and processing at a refinery to avoid equipment failure. Because asphaltenes comprise a major fraction of sulfur, metals, and other undesirable contaminants present in a crude oil specimen, their removal can enhance the value of a fuel composition. It is known in the petroleum sciences that asphaltenes are stabilized in crude oil by the presence of aromatic hydrocarbons such as BTX compounds (benzene, toluene, xylenes) but destabilized upon addition of paraffinic hydrocarbons (a.k.a., saturates). For this reason, solvent de-asphalting is typically facilitated using saturates such as pentanes or propane within a solvent de-asphalting unit.

It is generally understood that asphaltene sedimentation occurs as asphaltenes dissolve into solution and reach a critical concentration at which they flocculate (i.e., self-aggregate) to form asphaltene particles. Asphaltene flocculation processes are documented in literature and are characterized by a similar transient viscosity response as observed in FIG. 20; see to transient viscosity response in the cited research article Joel Escobedo, G. Ali Mansoori. "Viscometric determination of the onset of asphaltene flocculation: A novel method". *SPE Production and Facilities,* 1995, 10, 2, pp 115-119. For example, dynamic viscosity values increase as asphaltenes aggregate to form a colloidal suspension then viscosity values subsequently decline as asphaltene particles sediment out of the suspension. These asphaltene particles ultimately tend to deposit onto pipeline walls, process equipment, or mineral surfaces within a reservoir causing flow obstruction and economic loss. After removal, the remaining hydrocarbon composition is said to be de-asphalted and typically has a lower viscosity value than the original hydrocarbon composition prior to removal of asphaltenes.

In some embodiments, according to the present disclosure, a method for crude oil de-asphalting is disclosed comprising: 1) heating an ammonia hydrocarbon dispersion to precipitate asphaltenes and 2) obtaining a de-asphalted fuel composition. In some embodiments, the de-asphalted fuel composition has improved transportation properties (e.g., lower viscosity) and enhanced value as a fuel product due to the partial removal of sulfur and metal impurities. In the preceding examples, including AHD-2 and AHD-5, evidence for asphaltene precipitation was only observed at temperatures equal to or greater than about 30° C. In some embodiments, ammonia hydrocarbon dispersions are processed at low temperatures (i.e., below about 10° C.) to avoid destabilizing asphaltenes.

Example 8: Measuring the HLD~0 Condition and Preparation of the Fuel Composition by Inventive Method of Phase Inversion An example is provided to demonstrate how the HLD~0 condition may be measured. In this example, according to the present disclosure, the fuel composition comprises a surfactant, specifically a nonionic alcohol ethoxylate surfactant, for which the HLD balance is sensitive to temperature changes. Further, as part of this procedure, the method of phase inversion is also demonstrated according to the present disclosure.

FIG. 21A shows the viscosity of a mixture of Schrader Bluff and nonionic surfactant measured in a rheometer cell using a concentric cylinder spindle operating at a constant shear rate of 100 $s^{-1}$ as the hydrocarbon was cooled slowly from about 20° C. to about 0° C. Here, the dynamic viscosity increases monotonically from about 445 cP to 3,180 cP. This is included to provide a baseline viscosity profile over the selected temperature regime.

FIG. 21B shows the viscosity of a mixture of Schrader Bluff oil, liquid ammonia, and nonionic alcohol ethoxylate surfactant measured in a rheometer cell using a concentric cylinder spindle operated at a constant shear of 100 $s^{-1}$ as the mixture was cooled slowly from about 27° C. to about 1° C. Prior to this procedure, the mixture was prepared by stagnantly heating (in the absence of shear) the de-asphalted fuel composition of Example-6 at 30° C. for several hours to induce separation into a mixture comprising a polar based ammonia-rich upper phase and nonpolar based hydrocarbon-rich lower phase. The hydrocarbon-rich lower phase is the inverse fuel composition, which comprises a hydrocarbon continuous phase comprising ammonia droplets. A representative image for such a mixture is provided in FIG. 24, where due to the opaqueness of the continuous hydrocarbon phase, the discontinuous liquid ammonia droplets comprised within the inverse fuel composition are only observed at the meniscus formed at the two-phase mixture interface. During the procedure, as in FIG. 21A, the mixture viscosity initially increased monotonically from about 100 cP to 463 cP for the temperature regime spanning 27° C. to 6° C. However, approaching the HLD~0 condition, the hydrocarbon-rich lower phase inverted and recombined with the ammonia-rich upper phase to produce a liquid ammonia continuous hydrocarbon dispersion. From FIG. 21B, the HLD~0 condition corresponds to a temperature of about 3.5° C. for this fuel composition, but the minimum viscosity value of 48 cP was observed to occur at temperatures slightly greater than the HLD~0 condition. By this procedure, the low-energy mixing regime for this fuel composition was also determined. Here, the low-energy mixing regime was defined as the temperature range over which a relatively low shear rate of 100 $s^{-1}$ is sufficient to induce ammonia and hydrocarbon to form a dispersion. From FIG. 21B, this coincides to a temperature range of about +/−2° C. around the HLD~0 condition. The advantage of producing a dispersion within the low-energy mixing region is that high-shear or high-pressure mixing equipment can be avoided. To preserve stability during transport or storage for dispersions produced by the phase inversion method or any other method, the dispersion should not be handled in the low-energy mixing regime without mixing. For example, due to low interfacial surface tension, coalescence rates are higher closer to the HLD~0 condition such that dispersions are easily formed but prone to rapid separation in this regime.

For the prior example of AHD-3, it was initially assumed that the HLD~0 condition would occur at temperatures greater than 25° C. Although the HLD condition varies with fuel composition, the unexpectedly low temperature of 3.5° C. measured as part of Example-8 is consistent with the high coalescence rates that were observed in Example-3. In practice, the HLD~0 condition can be adjusted for any fuel composition by adjusting surfactant composition or adding cosolvent.

Example 9: Storage Stability of Fuel Composition without Stirring

As demonstrated for the fuel composition of Example-5 (prepared by the spontaneous mixing method at a temperature of 0° C.), the fuel compositions of this invention can be produced at conditions corresponding to HLD<0.

As demonstrated for the fuel composition of Example-6 (prepared by the spontaneous mixing method at a temperature of 30° C.), the fuel compositions of this disclosure can be produced at conditions corresponding to HLD>0. Positive HLD indicates that surfactant curvature does not favor a liquid ammonia continuous dispersion under such conditions. Despite this fact, these dispersions can be handled if stirred or entrained in pipeline flow because the low-viscosity ammonia-rich liquid will be favored as the continuous phase over viscous hydrocarbon under such conditions due to the balance of viscous drag forces and surface tension. Nevertheless, for distribution and use as a fuel product involving tank storage, it is desirable to store the presently disclosed fuel compositions at conditions corresponding to HLD<<0 where long-term stability is possible in the absence of stirring.

As an example, FIG. 22 depicts images from long-term storage stability screening conducted using 2.375 mL ANS Stock Tank oil, 7.125 mL liquid ammonia, and 0.5 mL Triton X-100. This fuel composition was prepared by the spontaneous emulsion method at about 15° C. as detailed above. The fuel compositions were initially heated to 45° C. at a stir rate of 500 RPM, held at that temperature for about an hour, and then cooled to 42° C., 27° C., 4° C., and −15° C., respectively for each trial. At the beginning of each trial, stirring was stopped and a camera recorded the time for the mixture to destabilize. In FIG. 22, it is observed that the fuel composition stored at minus 15° C. (HLD<<0) showed no signs of disassociation after 48 hours in the absence of stirring. A similar procedure was conducted for a fuel composition comprising 2.375 mL Schrader Bluff Oil, 7.125 mL liquid ammonia, and 0.5 mL nonionic alcohol ethoxylate. The same conditions were used, however, the first trial conducted at 0° C. indicated a stability greater than 48 hours and no further trials were conducted with this fuel composition. In some embodiments, the fuel composition storage lifetime is improved for hydrocarbon comprising a heavy crude oil with less than 20° API gravity.

Example 10: Improved Safety for Liquid Ammonia

In some embodiments, the present disclosure is directed to a method for transporting liquid ammonia over land. Clean ammonia provides a cost-effective means of clean hydrogen delivery when transoceanic shipping is required. However, the transport of large volumes of clean ammonia over land faces regulatory, environmental, technical, and societal barriers discouraging clean ammonia production in non-coastal locations. A safer method of transporting a liquid ammonia in large volumes over land is motivated. Specifically, a method that reduces inhalation risk associated with a potential release from an anhydrous ammonia pipeline.

As an example, a fuel composition, according to the present disclosure, was discharged from a pressure-relief valve as part of a cleaning procedure. The fuel composition comprised 11.5 mL Schrader Bluff oil, 10 mL anhydrous ammonia, and 1.0 mL nonionic alcohol ethoxylate surfactant stored in a container at a temperature of 70° F. (21.1° C.) under self-pressure of 129 psi. Upon discharge to an atmospheric ventilation chamber, the release was observed occur in three stages:

STAGE I) A small portion of the liquid ammonia was flash vaporized cooling the remaining fuel composition to minus 33.4° C.

STAGE II) A low-viscosity caramel colored fluid, similar in color to de-asphalted oil (DAO), was subsequently ejected at a temperature of minus 33.4° C. It boiled off ammonia vapor for a period of about 5 to 7 minutes appearing to be delayed by the absorption of atmospheric water onto the fluid puddle surface.

STAGE III) A high-viscosity metallic black colored paste was subsequently ejected at a temperature of minus 33.4° C. It has the appearance of boiling frozen plastic, it did not spread on surfaces, and it expanded in volume due to trapped gas bubbles. It boiled off ammonia vapor gradually for a period of about 15 to 30 minutes.

Although these observations are qualitative, they illustrate physical phenomena which, improve the safety of transporting large volumes of liquid ammonia over land. As an emergency response procedure, it is common practice to place physical barriers near the source of anhydrous ammonia release to block wind currents such that the stagnant vapor cloud pools and less is emanated to the surrounding environment.

Based on the presently disclosed fuel compositions, flash-cooling of hydrocarbon creates an additional viscous barrier. In the extreme event of a total pipeline rupture, a viscous plug can similarly set within a flow conduit obstructing further release. It is well known in the chemical process industry that degassing a fluid entrained in a bed of small particles takes longer than degassing a fluid entrained in a bed of large particles. In some embodiments, according to the present disclosure, a fuel composition comprising a stable liquid ammonia continuous hydrocarbon discontinuous mixture that comprises particle sizes ranging from 100 nm to 250 μm, such as particle sizes ranging from 100 nm to 10 μm lowers inhalation risks potentially associated with the storage or transport of a liquid ammonia.

Example 11: Prophetic Use of a Fuel Product

As previously discussed, the fuel composition of the present disclosure can be efficiently transported by pipeline and stored as a stable fuel product in a fuel tank. Beneficially, prior to use as a fuel, the fuel composition can be inverted to form the inverse fuel composition according to the methods disclosed. In some embodiments, including combustion in a diesel engine, the inverse fuel composition is utilized. A known issue associated with the combustion of heavy fuel oil in a diesel engine is its poor fuel atomization resulting in incomplete combustion, reduced combustion efficiency, and greater carbon black emissions. Here, in some embodiments, it is beneficial to store a stable fuel composition in a fuel tank and deliver the fuel composition to a combustor such that it inverts into the inverse fuel composition.

For example, JFE Holdings, Inc. has commercialized a 3,000 to 24,000 KW class 4-stroke diesel engine as the main engine for ships. Currently, the engine can use a dual-fuel mixture comprising 50% ammonia and 50% heavy fuel oil. Gaseous ammonia is mixed with air and injected by air-intake valve into the combustion chamber; heavy fuel oi is injected by liquid fuel nozzle into the combustion chamber. In this example, the above described engine is used with a fuel product according to the present disclosure.

A fuel composition comprising 50% vol ammonia, 48% vol heavy fuel oil, and 2% vol nonionic alcohol ethoxylate comprising a droplet size ranging from 100 nm to 250 μm is stored in a fuel tank at 0° F. (−17.8° C.) at a pressure of 30.4 psi. The fuel composition is pumped through a heat exchanger and discharged into an isothermal flash drum at a temperature of 104° F. (40° C.) and pressure of 225.4 psi operating with a vapor/liquid separation ratio of 80/20 in view of ammonia. Vaporized ammonia is recovered from the vessel and combined with a combustion stoichiometry of air. The remaining fuel composition inverts to form an inverse fuel composition comprising a liquid composition of 16.7% vol ammonia, 80.0% vol heavy fuel oil, and 3.3% vol nonionic alcohol ethoxylate surfactant. The air-ammonia gaseous mixture and the inverse fuel composition are injected into the 4-stroke diesel engine, as described above, via an air intake valve and liquid fuel injection nozzle, respectively. Based on the use of the fuel product according to the present disclosure, the use of inverse fuel composition, in view of heavy fuel oil, improves combustion efficiency and lowers carbon black emissions. Additionally, this example illustrates that consolidating multiple fuel tanks into a single blended fuel tank can create room for additional cargo and simplified refueling logistics at a marine port. While this example was not conducted, it illustrates a non-limiting embodiment of the disclosed fuel composition as a means to consolidate multiple fuel tanks into a single blended fuel tank.

What is claimed is:

1. A fuel composition comprising:

a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm.

2. The composition according to claim 1, wherein the droplet size ranges from about 100 nm to about 10 μm.

3. The composition according to claim 1, wherein the fuel composition is thermodynamically stable.

4. The composition according to claim 1, wherein the fuel composition is kinetically stable, as 90% of the fuel composition remains homogenous for at least ten hours.

5. The composition according to claim 1, further comprising a surfactant.

6. The composition according to claim 5, wherein the surfactant is chosen from nonionic surfactants, anionic surfactants, and combinations thereof.

7. The composition according to claim 6, wherein the nonionic surfactant is chosen from amides, diamides, polyglycol esters, alkyl polyglycosides, sorbitan esters, methyl glucoside esters, fluorocarbon polymers, alkylphenol sinkethoxylates, alcohol ethoxylates, and combinations thereof.

8. The composition according to claim 6, wherein the anionic surfactant is chosen from stearates, gluconates, glutamates, sarcosinates, lactylates, fatty acid carboxylates, naphthenates, and combinations thereof.

9. The composition according to claim 1, wherein the non-polar based discontinuous phase is saturated or undersaturated in view of the liquid ammonia.

10. The composition according to claim 1, wherein the polar based continuous phase further comprises a polar co-solvent.

11. The composition according to claim 10, wherein the polar co-solvent is chosen from water, alcohol, ether, and combinations thereof.

12. The composition according to claim 1, wherein the polar based continuous phase further comprises from about 0.1% to about 19.0% by v/v of total polar phase of a polar co-solvent and a surfactant, wherein the surfactant comprises a nonionic surfactant chosen from amides, diamides, polyglycol esters, alkyl polyglycosides, sorbitan esters, methyl glucoside esters, fluorocarbon polymers, alkylphenol ethoxylates, alcohol ethoxylates, and combinations thereof; and/or an anionic surfactant chosen from stearates, gluconates, glutamates, sarcosinates, lactylates, fatty acid carboxylates, naphthenates, lignosulfonates, organic sulfonates, organic sulfates, organic sulfites, organic phosphates, and organic sulfosuccinates preferably containing an alkali metal, alkaline earth metal, transition metal, an ammonium cation, and combinations thereof.

13. The composition according to claim 1, further comprising an inorganic salt.

14. The composition according to claim 13, wherein the inorganic salt is chosen from ammonium nitrite, ammonium nitrate, ammonium chloride, ammonium bromide, ammonium iodide, ammonium hypochlorite, ammonium thiocyanate, sodium nitrate, potassium nitrate, cesium nitrate, sodium iodide, potassium iodide, and cesium iodide.

15. The composition according to claim 1, wherein the non-polar based discontinuous phase further comprises a non-polar co-solvent.

16. The composition according to claim 15, wherein the non-polar co-solvent is chosen from propane, other liquefied hydrocarbon gases, and combinations thereof.

17. A method for preparing a fuel product comprising:

inverting a fuel composition with a physical stimulus, wherein the fuel composition comprises: a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm to generate the fuel product, and wherein the physical stimulus is chosen from a change in temperature, a change in pressure, a change in composition, and combinations thereof.

18. The method according to claim 17, wherein the composition further comprises an inorganic salt.

19. The method according to claim 18, wherein the inorganic salt is chosen from ammonium nitrite, ammonium nitrate, ammonium chloride, ammonium bromide, ammonium iodide, ammonium hypochlorite, ammonium thiocyanate, sodium nitrate, potassium nitrate, cesium nitrate, sodium iodide, potassium iodide, and cesium iodide.

20. The method according to claim 17, further comprising storing the fuel product in a tank or a vessel at a temperature ranging from about minus 92° C. to about 45° C.

21. A fuel dispensing system for transporting, storing and/or delivering a fuel composition comprising at least a pipeline or flow conduit, wherein the fuel composition comprises: a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm.

22. The fuel dispensing system according to claim 21, further comprising one or more of: (a) a storage vessel or reservoir; (b) a dispersion manufacturing production facility; (c) an offtake facility; (d) an ontake facility; (e) a product dispensing facility; (f) a data processing facility; and/or (g) a document generating facility.

23. The fuel dispensing system according to claim 21, wherein the system comprises elements (a)-(g).

24. A method for transporting a fuel composition comprising:

preparing a fuel composition comprising a polar based continuous phase comprising a liquid ammonia with a concentration greater than about 81% by v/v of total polar phase; and a non-polar based discontinuous phase comprising one or more of a frozen hydrocarbon, a viscous liquid hydrocarbon, and a liquefied volatile hydrocarbon, wherein the fuel composition has a droplet size ranging from about 100 nm to about 250 μm; and transferring the fuel composition to a pipeline system to transport the fuel composition to a location of use or a production or storage location.

25. The method according to claim 24, wherein the pipeline system is at a temperature ranging from a freezing point of the polar based continuous phase to about 10° C.

26. The method according to claim 24, further comprising removing the polar based continuous phase and/or the non-polar based discontinuous phase from the composition at an offtake point along the pipeline system generating a remaining fuel composition and continuing to transfer the remaining fuel composition in the pipeline system to the location of use, wherein the remaining fuel composition does not invert.

27. The method according to claim 24, further comprising adding a polar and/or a non-polar additive to an ontake point along the pipeline system forming a remaining fuel composition, wherein the remaining fuel composition does not invert.

28. The method according to claim 24, wherein transferring the fuel composition further comprises a value-enhancing document to identify an origin of the fuel composition.

29. The method according to claim 28, wherein the value-enhancing document is transferred via a certificate swap with a third party.

30. The method according to claim 28, wherein transferring the composition comprises supervising the composition by a system administrator and verifying the value-enhancing document of the composition.

31. The method according to claim 24, wherein the pipeline system is chosen from a crude oil sales pipeline system, a crude oil production pipeline system, a legacy hydrocarbon system, and combinations thereof.

32. The method according to claim 24, further comprising, before or after transferring the fuel composition, implementing a delivery schedule of the fuel composition.

33. The method according to claim 24, wherein the location of use is a subterranean reservoir.

34. The method according to claim 24, wherein the frozen hydrocarbon is an ammonia saturated crude oil handled at a temperature below the gel point of the ammonia saturated crude oil.

35. The method according to claim 24, wherein the viscous liquid hydrocarbon is an ammonia saturated crude oil handled at a temperature above the gel point of the ammonia saturated crude oil.

36. The method according to claim 24, wherein the liquefied volatile hydrocarbon is propane.

37. The method according to claim 24, wherein the storage location is chosen from a marine vessel, a fuel tank, a combustion system, and combinations thereof.

38. The method according to claim 24, further comprising, after transferring, processing the fuel composition at a distribution facility to form a ready-to-use partially decarbonized fuel, and delivering the fuel.

39. A method for preparing a fuel composition of an ammonia-hydrocarbon dispersion comprising:

combining ammonia, hydrocarbon, and a stabilization agent under temperature, pressure, and/or composition conditions to form an ammonia-hydrocarbon dispersion with a HLD>0;

using temperature, pressure, and/or composition conditions to modify the ammonia-hydrocarbon dispersion to HLD~0; and transporting or storing the ammonia-hydrocarbon dispersion under temperature or pressure conditions corresponding to HLD<0.

40. The method according to claim 39, wherein the ammonia-hydrocarbon dispersion is a kinetically stable dispersion.

41. The method according to claim 39, wherein the stabilization agent is chosen from a surfactant, an inorganic clay, a pH-buffering composition, a polymer gelation agent, and combinations thereof.

42. A method for preparing a fuel product comprising:

combining a hydrocarbon, a surfactant, and a co-solvent to form a hydrocarbon-rich precursor mixture; and subsequently combining the hydrocarbon-rich precursor mixture with a liquid ammonia that is under-saturated with respect to at least one surfactant or cosolvent to produce an ammonia-hydrocarbon dispersion under conditions corresponding to HLD>0, HLD~0, or HLD<0.

43. A method for preparing a fuel product comprising:

combining a liquid ammonia, a surfactant, and a cosolvent to form an ammonia-rich precursor mixture; and subsequently combining the ammonia-rich precursor mixture with a hydrocarbon that is under-saturated with respect to at least one surfactant or cosolvent to produce an ammonia-hydrocarbon dispersion under conditions corresponding to HLD>0, HLD~0, or HLD<0.

* * * * *